US011302185B2

(12) United States Patent
Leung

(10) Patent No.: US 11,302,185 B2
(45) Date of Patent: Apr. 12, 2022

(54) SYNERGISTIC RECONFIGURABLE TRAFFIC INTERSECTION

(71) Applicant: Valiant Yuk Yuen Leung, Narwee (AU)

(72) Inventor: Valiant Yuk Yuen Leung, Narwee (AU)

( * ) Notice: Subject to any disclaimer, the term of this patent is extended or adjusted under 35 U.S.C. 154(b) by 0 days.

(21) Appl. No.: 17/047,620

(22) PCT Filed: Dec. 21, 2018

(86) PCT No.: PCT/AU2018/051398
§ 371 (c)(1),
(2) Date: Oct. 14, 2020

(87) PCT Pub. No.: WO2019/200423
PCT Pub. Date: Oct. 24, 2019

(65) Prior Publication Data

US 2021/0158698 A1 May 27, 2021

(30) Foreign Application Priority Data

Apr. 17, 2018 (AU) ..... 2018901278

(51) Int. Cl.
*G08G 1/081* (2006.01)
*G08G 1/01* (2006.01)
*G08G 1/095* (2006.01)

(52) U.S. Cl.
CPC ..... *G08G 1/081* (2013.01); *G08G 1/0116* (2013.01); *G08G 1/0133* (2013.01); *G08G 1/0145* (2013.01); *G08G 1/095* (2013.01)

(58) Field of Classification Search
CPC .... G08G 1/081; G08G 1/0116; G08G 1/0133; G08G 1/0145; G08G 1/095
See application file for complete search history.

(56) References Cited

U.S. PATENT DOCUMENTS 10,235,882 B1 * 3/2019 Aoude ..... G06N 5/046
10,922,964 B2 * 2/2021 Fowe ..... G08G 1/0967
(Continued)

FOREIGN PATENT DOCUMENTS

CN 101256716 A 9/2008
CN 101320518 A 12/2008
(Continued)

OTHER PUBLICATIONS

Written Opinion of International Search Authority and International Search Report for International Application No. PCT/AU2018/051398.
(Continued)

*Primary Examiner* — Mohamed Barakat
(74) *Attorney, Agent, or Firm* — JCIP; Joseph G. Chu; Jeremy I. Maynard

(57) ABSTRACT

The present invention relates to a traffic intersection and traffic guidance system therefor, that has an intersection region where two roads cross, and a distal crossover zone that allows vehicles that are turning to the right (on a left-hand-drive road) to crossover to the right hands side of the road at a distance from the intersection. In this way, a separate right turn phase is not required by the traffic lights at the intersection, and vehicles turning right can turn at the same time as vehicle moving straight over the intersection or turning left. The turning right lane approaching the distal crossover zone from a distal side of the distal crossover zone is located on the far left, allowing vehicles going straight to continue to move in a straight line. Lanes that guide vehicles moving straight are reconfigurable to guide vehicles to move in opposed directions at different time of the day, depending on the traffic loading, and are also reconfigurable as parking spaces. Bicycle lanes are also provided that are received form the intersection region between the turning right lane
(Continued)

proximal of the distal crossover zone and the going straight lanes approaching the intersection region.

10 Claims, 61 Drawing Sheets

(56) References Cited

U.S. PATENT DOCUMENTS

| | | | | |
|---|---|---|---|---|
| 2016/0063859 | A1* | 3/2016 | Leung | G08G 1/005 404/1 |
| 2018/0181095 | A1* | 6/2018 | Funk | G05B 19/048 |
| 2018/0253965 | A1* | 9/2018 | Su | G08G 1/095 |
| 2019/0311619 | A1* | 10/2019 | Tao | G08G 1/0112 |

FOREIGN PATENT DOCUMENTS

| | | | |
|---|---|---|---|
| CN | 102024329 | A | 4/2011 |
| CN | 102051845 | A | 5/2011 |
| CN | 103295405 | A | 9/2013 |
| CN | 103898818 | A | 7/2014 |
| CN | 105070080 | A | 11/2015 |
| CN | 105350416 | A | 2/2016 |
| CN | 107287997 | A | 10/2017 |
| CN | 107326758 | A | 11/2017 |
| WO | 9218961 | A1 | 10/1992 |
| WO | 2017197460 | A1 | 11/2017 |

OTHER PUBLICATIONS

International Preliminary Report on Patentability for International Application No. PCT/AU2018/051398.

The Development of the Displaced Right Turn Intersection Brian F Simmonite (JCT Consultancy Ltd, Unit 4, Nettleham, Lincoln, LN2 2NR, UK, tel: + 44 1522 754681, fax: + 44 1522 753606, e-mail: bfs@jctconsultancy.co.uk) and Marcus J Chick (Parsons Brinckerhoff Ltd, Calyx House, South Road, Taunton, Somerset, TA1 3DU, UK, tel: +44 1823 424440, fax: +44 1823 424401, e-mail: chickm@pbworld.com).

CFI Guideline A UDOT Guide to Continuous Flow Intersections—Jul. 2013.

US Dot Federal Highway Administration Summary Report: Publication No. FHWA-HRT-08-071 Date: Feb. 2009.

* cited by examiner

SYNERGISTIC RECONFIGURABLE TRAFFIC INTERSECTION

FIELD OF THE INVENTION

The present invention relates to a traffic intersection, a system for directing traffic and a method therefor.

The invention has been developed primarily for use in/with regard to traffic intersections and traffic flow on congested roads and will be described hereinafter with reference to this application. However, it will be appreciated that the invention is not limited to this particular field of use.

BACKGROUND OF THE INVENTION

Increasingly large cities worldwide have led to increased traffic congestion. Larger roads are being designed and created, with more lanes to them, to handle increasingly larger numbers of vehicles.

However, where such larger roads intersect, each with many lanes, the flow of traffic can be interrupted by a long waiting period at traffic lights. This is typically caused by the road users having to wait for all the various combinations and permutations of signals to be processed for cars, pedestrians and bicycles approaching from different sides, and that are turning in various different directions and/or proceeding straight.

These long waiting periods may create additional congestion on busy roads.

Further, traffic flows in any particular direction (for example into or out of a city centre) can vary widely depending on the time of the day.

It is to be understood that, if any prior art information is referred to herein, such reference does not constitute an admission that the information forms part of the common general knowledge in the art, in Australia or any other country.

SUMMARY OF THE INVENTION

The invention seeks to provide a traffic intersection, a system for directing traffic and a method therefor, which will overcome or substantially ameliorate at least some of the deficiencies of the prior art, or to at least provide an alternative.

According to a first aspect, the invention may be said to consist in a traffic intersection comprising a. an intersection of at least two multilane roads, at least one of the roads including at least three or more traffic lanes spaced adjacent each other;
b. an intersection region wherein the intersecting roads overlap;
c. at least one of the intersecting roads comprising
   i. a proximate region in which each road approaching the intersection defines a plurality of transit lanes in which vehicles are travelling, the transit lanes including:
      1. one or more selected from
         a. a going straight lane for guiding vehicles approaching the intersection region to move straight through the intersection on the same road; and
         b. a turning left lane for guiding vehicles approaching the intersection region to turn left at the intersection onto an intersecting road;
      2. at least one receiving lane for receiving vehicles moving from the intersection region into the intersecting road; and 3. at least one turning right lane for guiding vehicles approaching the intersection region to turn right at the intersection onto the intersecting road;
   d. wherein the turning right lane is spaced from the said at least one or more selected from the going straight lane and the turning left lane by at least the receiving lane;
   e. a distal crossover zone distal of the proximate region;
   f. at least one approaching lane configured for guiding vehicles approaching the distal crossover zone into the at least one turning right lane;
   g. wherein the at least one approaching lane is located left most of the transit lanes.

According to another aspect, the invention may be said to broadly consist in a traffic intersection located at an intersection of two multilane roads, at least one of the roads comprising at least three or more traffic lanes spaced adjacent each other, the traffic intersection comprising:

a. an intersection region wherein the surface area of the intersecting roads overlap;
b. a proximate region in which each road approaching the intersection defines a plurality of transit lanes in which vehicles are travelling, including:
   i. at least one turning right lane for guiding vehicles to turn right at the intersection onto the intersecting road;
   ii. at least one receiving lane for receiving vehicles moving into the proximate region from the intersection region;
   iii. at least one going straight receiving lane for receiving vehicles moving straight through the intersection;
c. wherein the turning right lane is configured to split from the going straight lane in the proximate region by crossing through a distal crossover zone, so that vehicles travelling straight through the intersection in an opposite direction along the same road are guided to move between the turning right lane and the going straight lane in the going straight receiving lane; and
d. wherein at least one of the at least one turning right lanes distal of the distal crossover zone is located leftmost of the transit lanes.

In one embodiment, the receiving lanes include a going straight receiving lane for receiving vehicles moving across the intersection region on the same road.

In one embodiment, the distal crossover zone includes at least one or more traffic lights for guiding the movement of vehicles in the turning right lane over the crossover zone.

In one embodiment, at least one of the intersecting roads comprises five lanes, and at least one or more of the going straight lanes of that road is configured as a reconfigurable lane in which the direction of travel of vehicles is reversible.

In one embodiment, the at least one or more reconfigurable lanes include a signalling device configured for signalling the direction of travel of the reconfigurable lane.

In one embodiment, at least one of the reconfigurable lanes include reconfigurable parking lanes that are reconfigurable as vehicle parking.

In one embodiment, at least one or more reconfigurable parking lanes are spaced intermediate a pair of reconfigurable lanes.

In one embodiment the going straight lanes are configured for guiding vehicles over the intersection in a straight line to the said at least one or more going straight receiving lanes.

In one embodiment, the proximate region further comprises at least one or more turning left lanes configured for guiding vehicles to turn left at the intersection onto the intersecting road.

In one embodiment, the proximate region comprises a plurality of turning left lanes, and at least one of the turning left lanes is reconfigurable as parking space.

In one embodiment, the traffic intersection comprises signalling devices configured for signalling whether the turning left lanes are currently configured as a transit lane or parking space.

In one embodiment, the proximate region comprises a plurality of turning right lanes, and at least one of the turning right lanes is reconfigurable as parking space.

In one embodiment, the traffic intersection comprises signalling devices configured for signalling whether the turning left lanes are currently configured as a transit lane or parking space.

In one embodiment, the turning left lane is configured for guiding vehicles to turn from the turning left lane of one of the intersecting road into a going straight receiving lane on the other of the intersecting roads.

In one embodiment, at least one or more selected from the turning left lane and the going straight lanes are configured to terminate in a staggered fashion adjacent the intersection region to thereby allow space for a proximal crossover zone.

In one embodiment, at least one of the intersecting roads comprises a plurality of going straight lanes that terminate in a staggered fashion adjacent the intersection region, to thereby allow space for the proximal crossover zone, the proximal crossover zone being configured for allowing vehicles turning from a turning right lane in the intersecting road a variety of pathing routes past pedestrians that are crossing the road that the proximal crossover zone is in.

In one embodiment, the proximate region defines a combination turning left and a proximal crossover zone is disposed adjacent a combination turning left and going straight lane and is configured to receive vehicles that are moving straight through the intersection, thereby allowing the vehicles moving straight through the intersection to pass vehicles that are turning left from the combination turning left and going straight lane.

In one embodiment, the road with the proximal crossover zone is a four-lane road.

In one embodiment, the distal crossover zone is configured for guiding vehicles to do a U-turn.

In one embodiment, at least one or more selected from the turning left lanes and the going straight lanes are configured to terminate in a staggered fashion adjacent the intersection region to thereby allow space for the proximal crossover zone.

In one embodiment, the proximal crossover zone is configured substantially triangularly.

In one embodiment, the proximal crossover zone is configured for allowing vehicles turning from a turning right lane in the intersecting road a variety of pathing routes past pedestrians that are crossing the road that the proximal crossover zone is in.

In one embodiment, each of the going straight receiving lanes is configured to guide vehicles to the distal crossover zone, to allow vehicles moving straight through the intersection region to cross the distal crossover zone.

In one embodiment, the going straight lane in the proximate region is also configured as a turning left lane for guiding vehicles to turn left at the intersection region onto the intersecting road.

In one embodiment, the traffic intersection comprises visual signalling devices configured for safely directing vehicles on the roads through the intersection region.

In one embodiment, the visual signalling devices are operable in one of only two modes of operation.

In one embodiment, each of the visual signalling devices are operable in a go condition and a stop condition.

In one embodiment, each of the visual signalling devices are operable in a go condition, a stop condition and a slow condition.

In one embodiment, the visual signalling devices of the traffic intersection are operable together in two phases.

In one embodiment, the visual signalling devices of the traffic intersection are operable together in three phases.

In one embodiment, the visual signalling devices of the traffic intersection are operable together in a number of phases equal to the number of pairs of roads approaching the intersection, or parts thereof.

In one embodiment, the visual signalling devices of the traffic intersection are operable together in a number of phases equal to the number of pairs of roads approaching the intersection or parts thereof, plus one.

In one embodiment, the visual signalling devices are configured for safely directing pedestrians across at least one of the roads at the proximate region.

In one embodiment, the proximate region further comprises at least one turning receiving lane configured for receiving and guiding one or both selected from a) vehicles turning right from the intersecting road; and b) vehicles turning left from the intersecting road.

In one embodiment the proximate region comprises a plurality of turning receiving lanes.

In one embodiment, the turning right lane is configured to diverge from the other lanes in the proximate region by crossing through the distal crossover zone so that going straight receiving lanes for guiding vehicles moving straight across the intersection from the opposing side extends between the turning right lane and the going straight lane.

In one embodiment, the going straight lanes and going straight receiving lanes of at least one road on opposed sides of the intersection region are aligned in a straight line.

In one embodiment, the traffic intersection comprises at least one or more intermediate visual signalling arrangements configured for visually signalling one or more selected from a vehicle and a bicycle in the proximate region approaching the distal crossover zone.

In one embodiment, the intermediate visual signalling devices configured for safely directing vehicles approaching from the proximate region and the distal region through the distal crossover zone.

In one embodiment, the intermediate visual signalling devices are traffic lights.

In one embodiment, the traffic intersection comprises a plurality of bicycle lanes.

In one embodiment, the bicycle lanes are configured for extending along at least one of the roads adjacent the side of the road.

In one embodiment, the traffic intersection defines pedestrian crossings configured for guiding pedestrians across at least one of the intersecting roads.

In one embodiment, the distal crossover zone is distal to the intersection region and the proximal crossover zone is more proximate to the intersection region.

In one embodiment, the traffic intersection comprises at least one or more intermediate lanes extending between the distal crossover zone and the proximal crossover zone.

In one embodiment, the traffic intersection includes a distal region distal of the distal crossover zone from the intersection region.

In one embodiment, the distal region includes at least one approaching lane for vehicles approaching the traffic intersection.

In one embodiment, the distal region includes at least one leaving lane for vehicles leaving or travelling away from the traffic intersection region.

In one embodiment, at least one of the approaching lanes is a turning right approaching lane for vehicles intending to turn right at the intersection into an intersecting road.

In one embodiment, at least one of the approaching lanes is a going straight approaching lane configured for guiding vehicles straight over the intersection on the same road.

In one embodiment, at least one of the approaching lanes is a combination going straight and turning left approaching lane configured for guiding vehicles to turn left at the intersection or move straight over the intersection.

In one embodiment, at least one of the approaching lanes is turning left approaching lane configured for guiding vehicles to turn left at the intersection.

In one embodiment, the traffic intersection includes at least one or more bicycle lanes extending along at least one of the intersecting roads.

In one embodiment, the traffic intersection includes a bicycle receiving lane for receiving bicycles that have traversed the intersection region.

In one embodiment, the bicycle receiving lane extends between the turning right lane and the receiving lane in the proximate region.

In one embodiment, the bicycle receiving lane extends over the distal crossover zone.

In one embodiment, the traffic intersection includes at least one visual signalling device for signalling the bicycle receiving lane as it approaches the distal crossover zone from the intersection.

In one embodiment, the traffic intersection includes a bicycle approach lane for guiding bicycles to approach the intersection region.

In one embodiment, the bicycle approach lane extends adjacent the side of the intersecting road.

In one embodiment, the traffic intersection includes at least one or more bicycle waiting zones in the intersection region.

In one embodiment, the bicycle waiting zones are located proximate a central island in the intersection region.

In one embodiment, the bicycle waiting zones are located around the periphery of a central island in the intersection region.

In one embodiment, the bicycle waiting zones are located around the periphery of the intersection region.

In one embodiment, the bicycle approach lane splits up into one or more selected from:

a. a turning left bicycle lane;
b. a turning right bicycle lane;
c. a moving straight bicycle lane;
d. a U-turn bicycle lane.

In one embodiment, the traffic intersection includes at least one visual signalling device for signalling to bicycles in the bicycle approach lane as they approach intersection region.

In one embodiment, the traffic intersection comprises at least one or more bus stop bays located adjacent the distal crossover zone.

In one embodiment, the traffic intersection includes pedestrian pathways extending along the sides of at least one of the roads.

In one embodiment, the bicycle lanes are configured to join the pedestrian walkway distally of the distal crossover zone.

In one embodiment, at least one of the bicycle lanes is reconfigurable as vehicle parking.

In one embodiment, the turning left bicycle lane is reconfigurable as vehicle parking.

In one embodiment, the moving straight bicycle lane is reconfigurable as vehicle parking.

According to another aspect, the invention may be said to broadly consist in a traffic guidance system for deployment at a traffic intersection as described above, the traffic guidance system comprising a. at least one or more visual signalling devices configured for displaying guidance signals to vehicles on both intersecting roads, including displaying guidance signals to vehicles turning across the flow of oncoming traffic;
b. a control system configured for controlling operation of the visual signalling devices to thereby guide vehicles to move safely across the intersection and the distal crossover zone.

In one embodiment, the control system is configured for controlling operation of the visual signalling devices in one of two configurations.

In one embodiment, the control system is configured for controlling operation of the visual signalling devices in one of three configurations.

In one embodiment, the three configurations of the visual signalling devices include a green signal, a red signal, and an amber signal.

In one embodiment, the control system is configured for controlling operation of the visual signalling devices in two phases In one embodiment, the control system is configured for controlling operation of the visual signalling devices in:

a. a first phase in which vehicles in going straight lanes on an intersecting road are signalled to move straight across the intersection; and
b. a second phase in which vehicles in going straight lanes on that intersecting road are signalled to stop.

In one embodiment, the two phases are:

a. a first phase wherein all vehicles along one of the intersecting roads are signalled to move straight across the intersection and to turn from the road that they are on, onto the intersecting road, while all vehicles are prevented from crossing the distal crossover zone to move into the turning right lane;
b. a second phase wherein all vehicles along the other of the intersecting roads that are moving straight and/or turning right and/or turning left are signalled to stop at the intersection region, while vehicles in the distal right turning lane are signalled to move over the distal intersection region into the proximal right turning lane.

In one embodiment, the control system is further configured for controlling operation of the visual signalling devices in a. a third phase wherein all vehicles moving along both of the intersecting roads are stopped, and one or more selected from pedestrians and bicycles are signalled to cross the intersecting roads, while the while vehicles in the distal right turning lane are signalled to move over the distal intersection region into the proximal right turning lane.

In one embodiment, the control system is configured for controlling operation of the visual signalling devices in two sub-phases.

In one embodiment, the two sub-phases for the first phase include:

a. a first sub-phase in which vehicles in the turning left lane from one of the intersecting roads are signalled to stop, and vehicles in the turning right lane from an opposed side of the same intersecting road are signalled to go; and b. a second sub-phase in which vehicles in the turning left lane from one of the intersecting roads are signalled to go, and vehicles in the turning right lane from an opposed side of the same intersecting road are signalled to stop.

In one embodiment, the control system is configured for controlling operation of the visual signalling devices in the first sub-phase to also control:

a. bicycles in the turning left bicycle lane are signaled to go, and bicycles in the moving straight bicycle lane moving straight across the intersection are signalled to go.

In one embodiment, the control system is configured for controlling operation of the visual signalling devices in the second sub-phase to also control:

a. bicycles in the turning left bicycle lane are signalled to stop, and bicycles in the moving straight bicycle lane are signalled to stop.

In one embodiment, the control system is configured for controlling operation of the visual signalling devices at the distal crossover zone.

In one embodiment, the controller is configured for controlling of the visual signalling devices during the first sub-phase of the first phase to cause vehicles in the going straight approaching lane and/or combination approaching lane to move over the distal crossover zone.

In one embodiment, the controller is configured for controlling of the visual signalling devices during the first sub-phase of the first phase to cause vehicles in the receiving lane to cross over the distal crossover zone.

In one embodiment, the controller is configured for controlling of the visual signalling devices during the first sub-phase of the first phase to cause bicycles in the bicycle U-turn lane to stop.

In one embodiment, the controller is configured for controlling of the visual signalling devices during the second sub-phase of the first phase to cause vehicles in the going straight approaching lane and/or combination approaching lane to stop.

In one embodiment, the controller is configured for controlling of the visual signalling devices during the second sub-phase of the first phase to cause vehicles approaching the distal crossover zone in the receiving lanes to stop.

In one embodiment, the controller is configured for controlling of the visual signalling devices during the second sub-phase of the first phase to cause vehicles in the right turn approaching lane approaching the distal crossover zone to go.

In one embodiment, the controller is configured for controlling of the visual signalling devices during the first sub-phase of the second phase to cause vehicles in the right turn approaching lane approaching the distal crossover zone to go.

In one embodiment, the controller is configured for controlling of the visual signalling devices during the first sub-phase of the second phase to cause the bicycle U-turn lanes to stop.

In one embodiment, the controller is configured for controlling of the visual signalling devices during the first sub-phase of the second phase to cause the vehicles approaching the distal crossover zone in the receiving lanes to go over the distal crossover zone.

In one embodiment, the controller is configured for controlling of the visual signalling devices during the second sub-phase of the second phase to cause vehicles in the going straight approaching lane and/or combination approaching lane to stop before the distal crossover zone.

In one embodiment, the controller is configured for controlling of the visual signalling devices during the second sub-phase of the second phase to cause vehicles in the receiving lanes to stop before the distal crossover zone In one embodiment, the controller is configured for controlling of the visual signalling devices during the second sub-phase of the second phase to cause vehicles in the right turn approaching lane to move across the distal crossover zone.

In one embodiment, the controller is configured for controlling of the visual signalling devices during the second sub-phase of the second phase to cause bicycles in the bicycle receiving lane to stop before the distal crossover zone.

In one embodiment, when the controller is configured for controlling the visual signalling devices to signal vehicles in the going straight lanes to stop for the second phase, the controller is controlling the visual signalling devices to the U-turn bicycle lane to cause bicycle to carry out U-turns proximate the intersecting region.

In one embodiment, when the controller is configured for controlling the visual signalling devices to signal vehicles in the going straight lanes to stop for the second phase, the controller is controlling the visual signalling devices to the turning right lane to go.

In one embodiment, the traffic intersection includes at least one or more reconfigurable lanes that are reconfigurable to travel in opposed directions, and control system is configured for controlling operation of at least one or more visual signalling devices to reverse the direction of flow of a reconfigurable lane.

In one embodiment, the controller is configured for controlling of the visual signalling devices controlling movement of vehicles in the reconfigurable lanes correlate with the going straight lane moving in the same direction as intended by the reconfigurable lanes.

In one embodiment, at least one of the reconfigurable lanes include reconfigurable parking lanes that are reconfigurable as vehicle parking, and the control system is configured for controlling operation of at least one or more visual signalling devices to stop movement along the reconfigurable parking lanes.

In one embodiment, at least one or more reconfigurable parking lanes are spaced intermediate a pair of reconfigurable lanes.

In one embodiment, the traffic intersection includes a bicycle leaving lane extending distally of the distal crossover zone.

In one embodiment, the bicycle leaving lane extends adjacent a side of the road.

In one embodiment, at least one of the bicycle lanes is reconfigurable as vehicle parking, and the control system is configured for controlling operation of at least one or more bicycle visual signalling devices In one embodiment, the turning left bicycle lane is reconfigurable as vehicle parking.

In one embodiment, the moving straight bicycle lane is reconfigurable as vehicle parking.

According to a further aspect, the present invention may be said to consist in a traffic intersection located at an intersection of two multilane roads, at least one of the roads comprising at least three or more traffic lanes spaced adjacent each other, the traffic intersection comprising:

a. an intersection region wherein the surface area of the intersecting roads overlap;

b. a proximate region in which each road approaching the intersection includes a plurality of transit lanes in which vehicles are travelling, including:

i. at least one turning right lane for guiding vehicles to turn right at the intersection onto the intersecting road;

ii. at least one going straight lane for guiding vehicles to move straight through the intersection on the same road; and iii. at least one receiving lane for receiving vehicles moving into the proximate region from the intersection region;

iv. wherein the turning right lane is configured to split from the going straight lane in the proximate region by crossing through a distal crossover zone, so that vehicles travelling straight through the intersection in an opposite direction along the same road are guided to move between the turning right lane and the going straight lane in the going straight receiving lane;

c. the proximate region further including at least one bicycle lane, including:

i. a receiving bicycle lane extending between the turning right lane and the receiving lane.

In one embodiment, the proximate region includes a plurality of bicycle lanes.

In one embodiment, the proximate region includes a bicycle approach lane for guiding bicycles approaching the intersection region in the proximate region.

In one embodiment, the receiving lanes include a going straight receiving lane for receiving vehicles moving across the intersection region on the same road.

In one embodiment, the traffic intersection includes a bicycle leaving lane extending distally of the distal crossover zone.

In one embodiment, the bicycle leaving lane extends adjacent a side of the road.

Other aspects of the invention are also disclosed.

BRIEF DESCRIPTION OF THE DRAWINGS

Notwithstanding any other forms which may fall within the scope of the present invention, preferred embodiments of the invention will now be described, by way of example only, with reference to the accompanying drawings in which.

DESCRIPTION OF EMBODIMENTS

Figure 1:
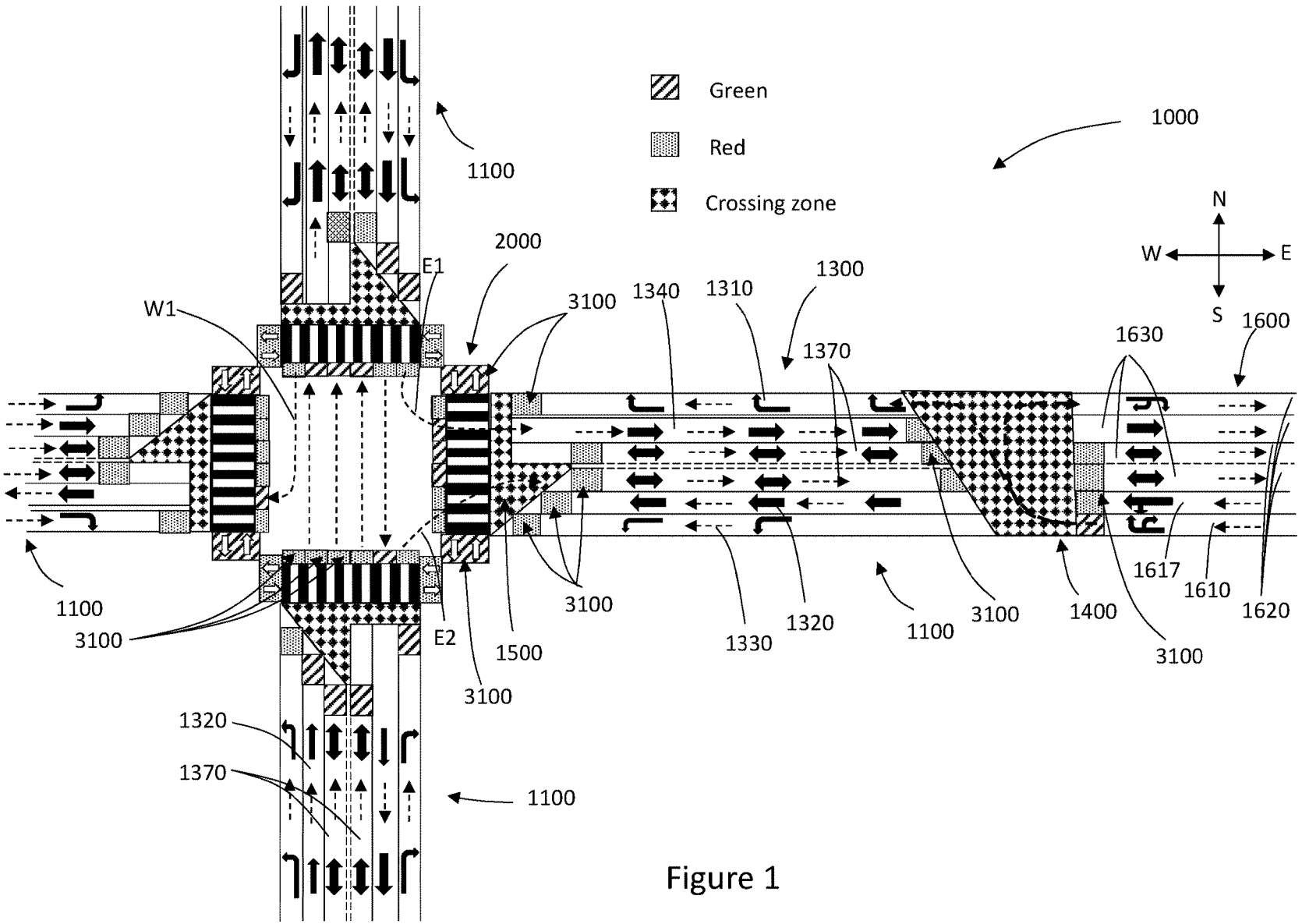
FIG. 1 shows a schematic view of a traffic intersection of a six lane road crossing a six lane road, with vehicles moving in both directions on each road with the visual signalling devices being in a first phase.

It should be noted in the following description that like or the same reference numerals in different embodiments denote the same or similar features.

Traffic Intersection

For the purposes of explanation of the present invention, the intersections and traffic guidance systems of the present invention will be described with reference to road laws requiring vehicles to drive on the left hand side of the road. However, it will be appreciated that the invention may be carried out as effectively on intersections and using traffic guidance systems operational in countries where vehicles drive on the right-hand side of the road by interchanging any reference to the word "right" with the word "left", and any reference to the word "left" with the word "right", and by mirroring the figures shown.

In one embodiment now described with reference to the figures, there is provided a traffic intersection 1000. The traffic intersection 1000 is located at an intersection of two multilane roads 1100. Each road comprises a plurality of traffic lanes as will be described in more detail below. Each traffic lane is spaced adjacent each other, possibly allowing for safety barriers and/or pedestrian islands between them.

The traffic intersection 1000 comprises an intersection region 1200 where the surface area of the intersecting roads 1100 substantially overlap, and proximate region 1300 that is located proximate the intersection region 1200. The proximate region 1300 includes a turning right lane 1310 for guiding vehicles to turn right at the intersection on to the intersecting road 1100. The proximate region 1300 further includes a going straight lane 1320 for guiding vehicles to move straight through the intersection on the same road 1100. Distally of the proximate region 1300, the traffic intersection comprises a distal crossover zone 1400. Distally of the distal crossover zone 1400 is a distal region 1600. The distal region 1600 includes at least one approaching lane as described below, for vehicles approaching the traffic intersection, and at least one leaving lane 1630 for vehicles leaving or travelling away from the traffic intersection. It will be appreciated that between one intersection 1000 and the next intersection 1000, a leaving lane will become an approaching lane.

In the embodiments shown in FIGS. 1-5, one of the approaching lanes is a turning right approaching lane 1610. This is used by vehicles that wish to turn right at the intersection onto an intersecting road 1100. Another of the approaching lanes is a going straight approaching lane 1620, that is used by vehicles wishing to travel straight over the intersection on the same road 1100. Leaving lanes are generally referenced by 1630. It is envisaged that in certain embodiments, for example as shown in FIGS. 19-23, a single combination approaching lane 1615 can be provided for vehicles intending to turn right at the intersection, move straight over the intersection, or turn left at the intersection. In the embodiment shown in FIGS. 14-15, a single turning right approaching lane 1610 is provided, together with a combination going straight and turning left approaching lane 1617. The use of the various combinations described above will depend on the number of lanes available for use in each intersecting road 1100.

In the proximate region 1300, and as shown in FIGS. 1-18, a dedicated turning left lane 1330 is provided for guiding vehicles to turn left from a road onto an intersecting road. However, this may not always be the case, as shown in FIGS. 19-24 where a combination going straight and turning left lane 1325 is shown.

The proximate region 1300 further comprises one or more receiving lanes 1340 for receiving vehicles moving straight over the intersection region 1200 from an opposed side, and preferably for receiving vehicles turning left or right from the intersecting road into the proximate region 1300.

It is envisaged that the receiving lanes 1340 will also be used for receiving vehicles that have traversed through the intersection region 1200 after turning left from the intersecting road 1100, as well as for receiving vehicles that have traversed through the intersection region 1200 after turning right from the intersecting road 1100.

Importantly, the traffic intersection 1000 is configured to guide vehicles in the turning right approaching lane 1610 to move to a turning right lane 1310 when crossing the distal crossing zone 1400. The turning right lane 1310 is disposed apart from the going straight lane 1320 in the proximate region 1300. The receiving lanes 1340 for guiding vehicles having travelled over the intersection region 1200 will guide vehicles moving away from the intersection region 1200 towards the distal crossover zone 1400. The receiving lanes 1340 extend between the turning right lane 1310 and the going straight lane 1320, but with the vehicles being guided to move in an opposed direction.

Vehicles travelling away from the intersection region 1200 will be guided by the receiving lane 1340 to the distal crossover zone 1400, where they will cross directly over the distal crossover zone 1400, preferably in a straight line. Vehicles approaching the distal crossover zone 1400 in both directions will be guided by a traffic guidance system 3000, including visual signalling devices 3100 and a controller 3200. Similarly, vehicles approaching the intersection region 1200 will be guided by visual signalling devices 3100, as will vehicles approaching the distal crossover zone 1400 from the distal region 1600.

Vehicles approaching the distal crossover zone 1400 moving towards the intersection region 1200, that want to turn right into the intersecting road will be guided by visual signalling devices 3100 such as a traffic light to yield to vehicles in the receiving lanes coming from the intersection region 1200. Once it is safe, the vehicles will cross over the distal crossover zone 1400 to move over to preferably the far right lane of the multilane road.

All of the vehicle lanes described in which the vehicles are in transit (i.e. not parked) are referred to as transit lanes.

Figure 7:
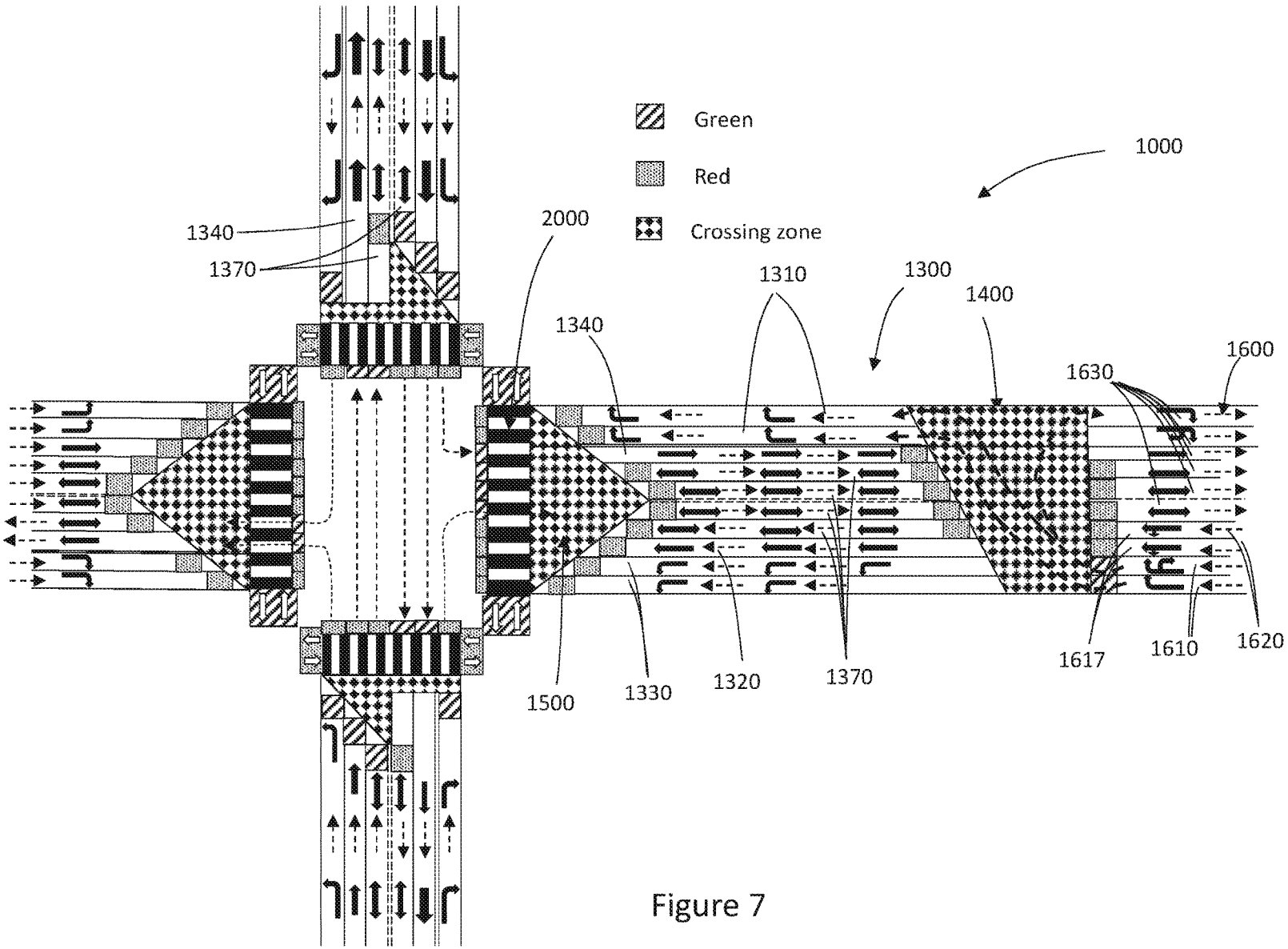
FIG. 7 shows a schematic view of a third embodiment of a traffic intersection of a ten lane road crossing a six lane road, with vehicles moving in both directions on each road, and with the visual signalling devices being in a first phase, and the reconfigurable lanes being in a first configuration.

Importantly, the approaching lanes of vehicles to be guided to turn right at the intersection are located left most of the transit lanes as they approach the distal crossover zone 1400 from the distal region 1600. Where additional right turn approaching lanes 1610 are required, these are located in the lanes adjacent to the left most of the transit lanes as they approach the distal crossover zone 1400 from the distal region 1600. An example of this is shown in FIG. 7. Other approaching lanes distally of the distal crossover zone 1400 are aligned adjacent the right turn approaching lanes 1610. This lane configuration preferably allows vehicles that are moving straight through the intersection to remain on a straight road, without the requirement for staggered lanes, and movement between staggered lanes.

As shown in the figures, allowing vehicles to move straight through the intersection to remain on a straight road also allows for one or more of the lanes moving straight through the intersection on the same road 1100 to be reconfigurable lanes 1370 to guide traffic in one of two directions. This will allow for increased traffic flow in a particular direction at different times of the day (for example during rush hour when most traffic is heading away from the city). It is envisaged that the reconfigurable lanes 1370 will preferably only relate to or be associated with going straight lanes 1320, although it is envisaged that in a less preferred embodiment (not shown) turning left lanes 1330 or turning right lanes 1310 could also be reconfigured as going straight lanes 1320. Reconfigurable lanes that are leaving the intersection distally of the distal crossover zone are accordingly regarded as both approaching lanes and leaving lanes 1630 at different times.

Figure 9:
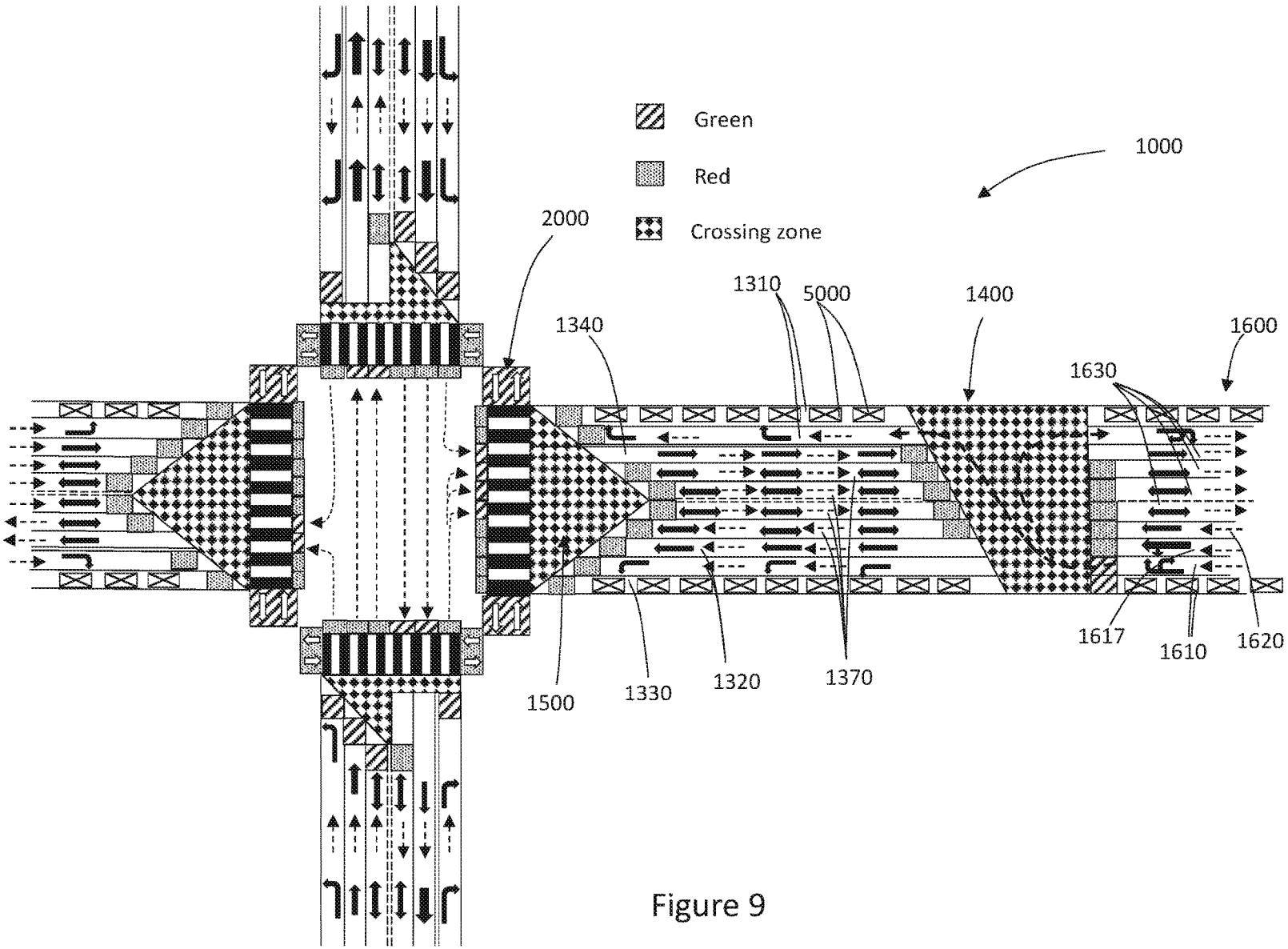
FIG. 9 shows a schematic view of the third embodiment of a traffic intersection of a ten lane road crossing a six lane road, with the leftmost left turn lane and at the right most right turn lane being reconfigurable as parking spaces.

In addition, as shown in FIGS. 7 and 9, it is envisaged that the turning left lane 1330 and/or turning right lanes 1310 and/or right turn approaching lane 1610 could be reconfigured as parking lanes at particular times of the day when it is convenient to do so. This is illustrated in FIG. 9, where vehicles 5000 are shown parked in the turning left lane and turning right lane, proximally of the distal crossover zone. Such reconfiguration of turning left lanes and/or turning right lanes would typically only occur where multiple such lanes are provided.

It is envisaged that suitable visual signalling devices 3100 will be provided to ensure that vehicles do not travel the wrong way down the reconfigurable lanes 1370. It is further envisaged that the controller 3200 can be configured for changing the configuration of the reconfigurable lanes 1370 for different times of the day, or in response to changing traffic conditions, such as the presence of roadworks, or the presence of a road blockage such as an accident. It is further envisaged that a single traffic guidance system 3000 can control multiple controllers relating to a plurality of traffic intersections 1000 to thereby facilitate enhanced traffic flow.

The traffic intersection 1000 further includes pedestrian crossings 2000 that are preferably configured for guiding pedestrians to traverse each of the intersecting roads on both sides of the intersection region 1200.

Figure 10:
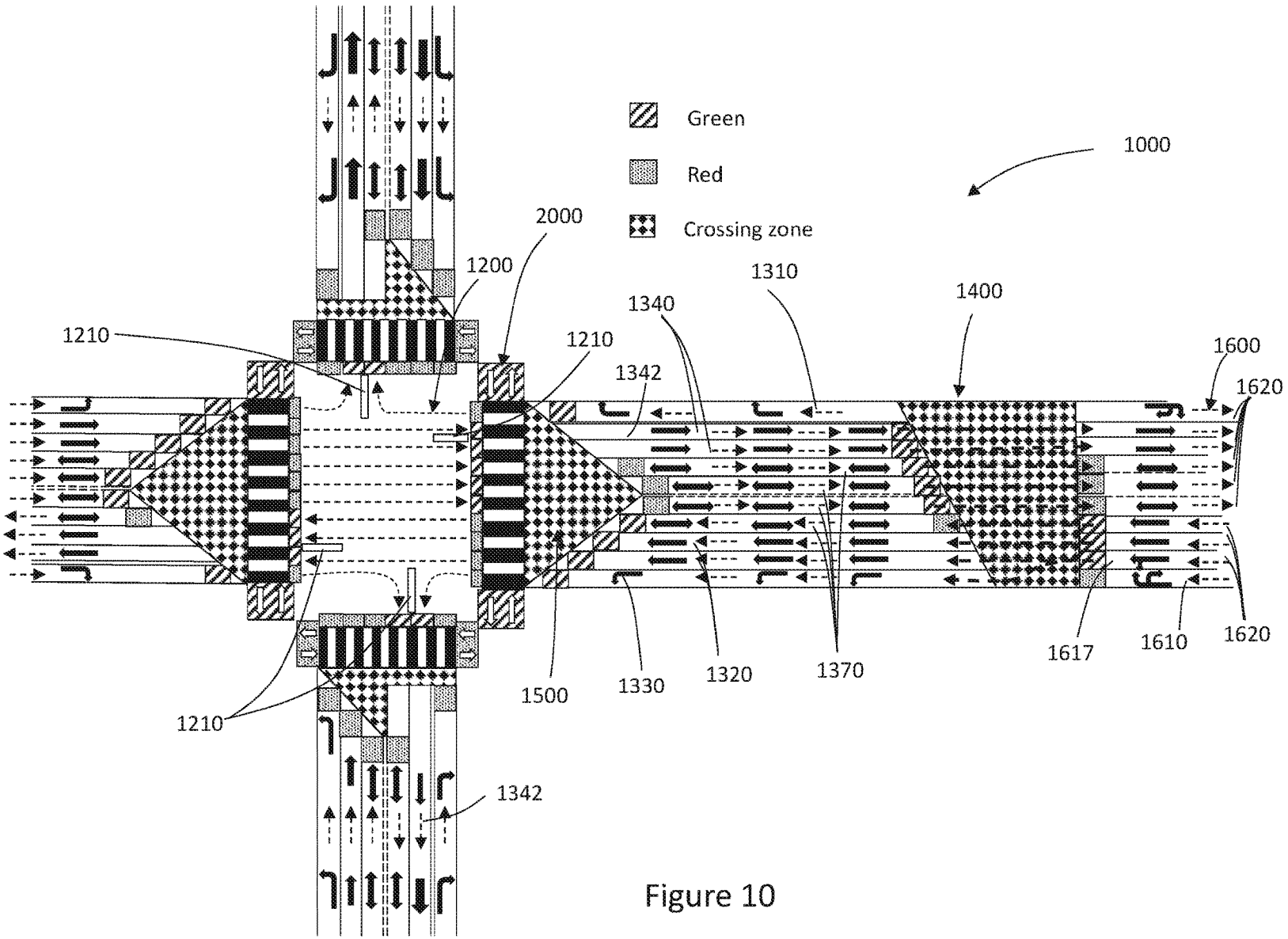
FIG. 10 shows a schematic view of a fourth embodiment of a traffic intersection of a 10 lane road crossing a six lane road, with vehicles moving in both directions on each road, with the visual signalling devices in a first phase, with a single left turn lane on each of the intersecting roads, and including a buffer in the intersection for each left turn lane.
Figure 11:
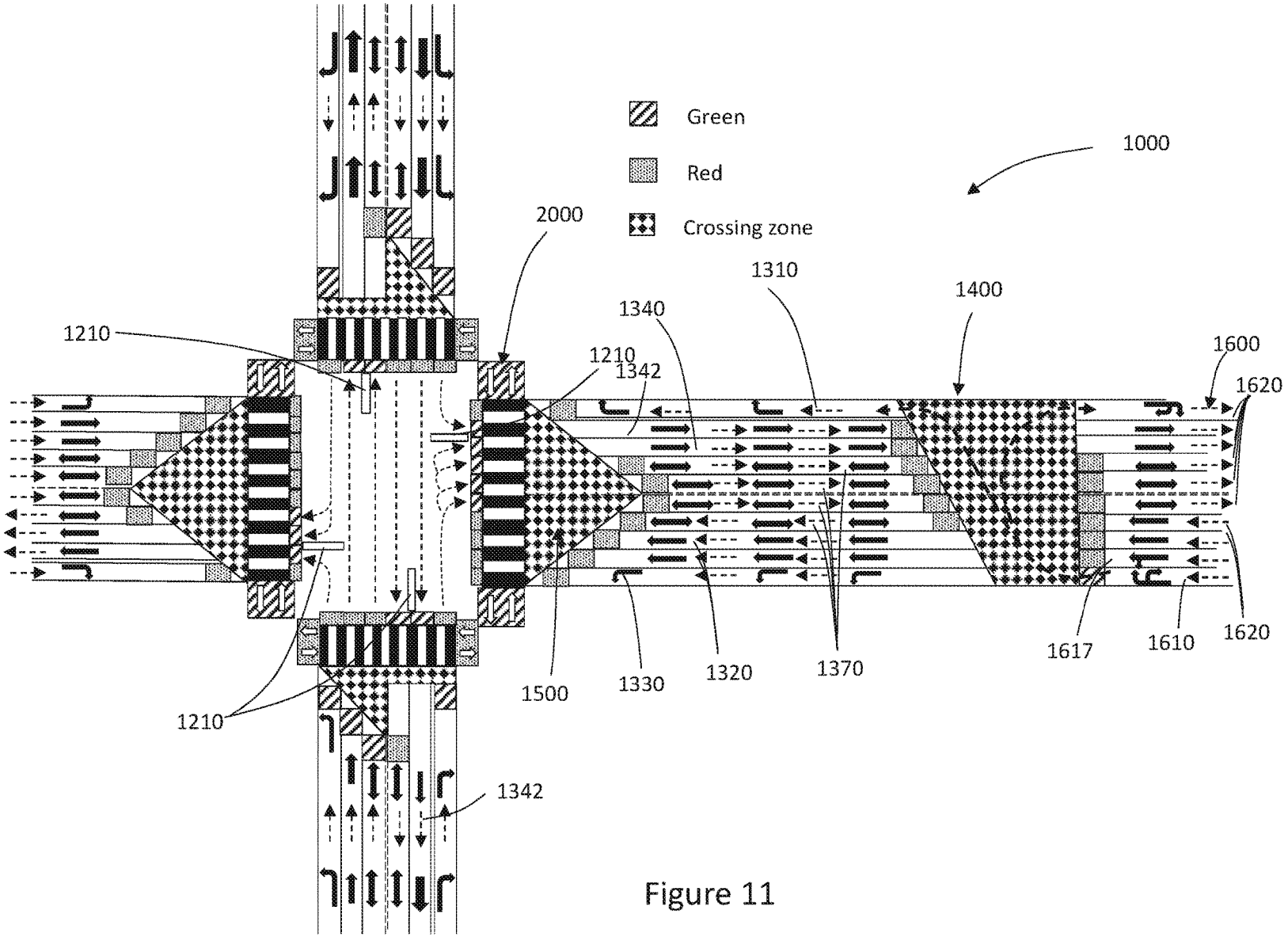
FIG. 11 shows a schematic view of the fourth embodiment of a traffic intersection shown in FIG. 10, with the visual signalling devices in a second phase.

It is envisaged that where a dedicated left turn receiving lane 1342 is provided, for receiving vehicle that are turning left at the intersection, the traffic intersection may include one or more barriers or buffers 1210, as shown in FIGS. 10 and 11. The buffers 1210 are located within the intersection region 1200, and are configured for preventing vehicles in the right turning lane from turning into the receiving lane that the vehicles in the left turning lane are turning into from an opposed side of the intersection. It is envisaged that a barrier or buffer 1210 could be in the form of a wall, a curb, bollard or similar road barrier. It is further envisaged that the buffers 1210 could be movable, for example to be moved at different times of the day. In addition to the safety provided, it is envisaged that the buffers 1210 will also prevent the headlights of vehicles from blinding vehicles across the intersection region 1200 at night.

It will be appreciated that buffers 1210 can only be utilised where there are sufficient lanes for vehicles turning left and vehicles turning right from the intersecting road. For example, buffers could not be used in the embodiment shown in FIG. 14, where vehicles turning left and turning right from the intersecting road are received into the same receiving lane.

In addition to the barriers, it is envisaged that the receiving lane 1340 that will be used for receiving vehicles turning left can be configured to have an increased width, to facilitate the prevention of collision of two vehicles turning into adjacent receiving lanes 1340 at the same time from the turning right lane and the turning left lane of the intersecting roads.

It is further envisaged that the traffic intersection 1000 need not be configured with reconfigurable lanes. In the embodiment shown in FIGS. 14 and 15, a traffic intersection 1000 is shown which does not include reconfigurable lanes, but still includes a right turn approaching lane that stops at the distal crossover zone 1400 from the distal region 1600 in the leftmost transit lane of the road 1100.

Figure 14:
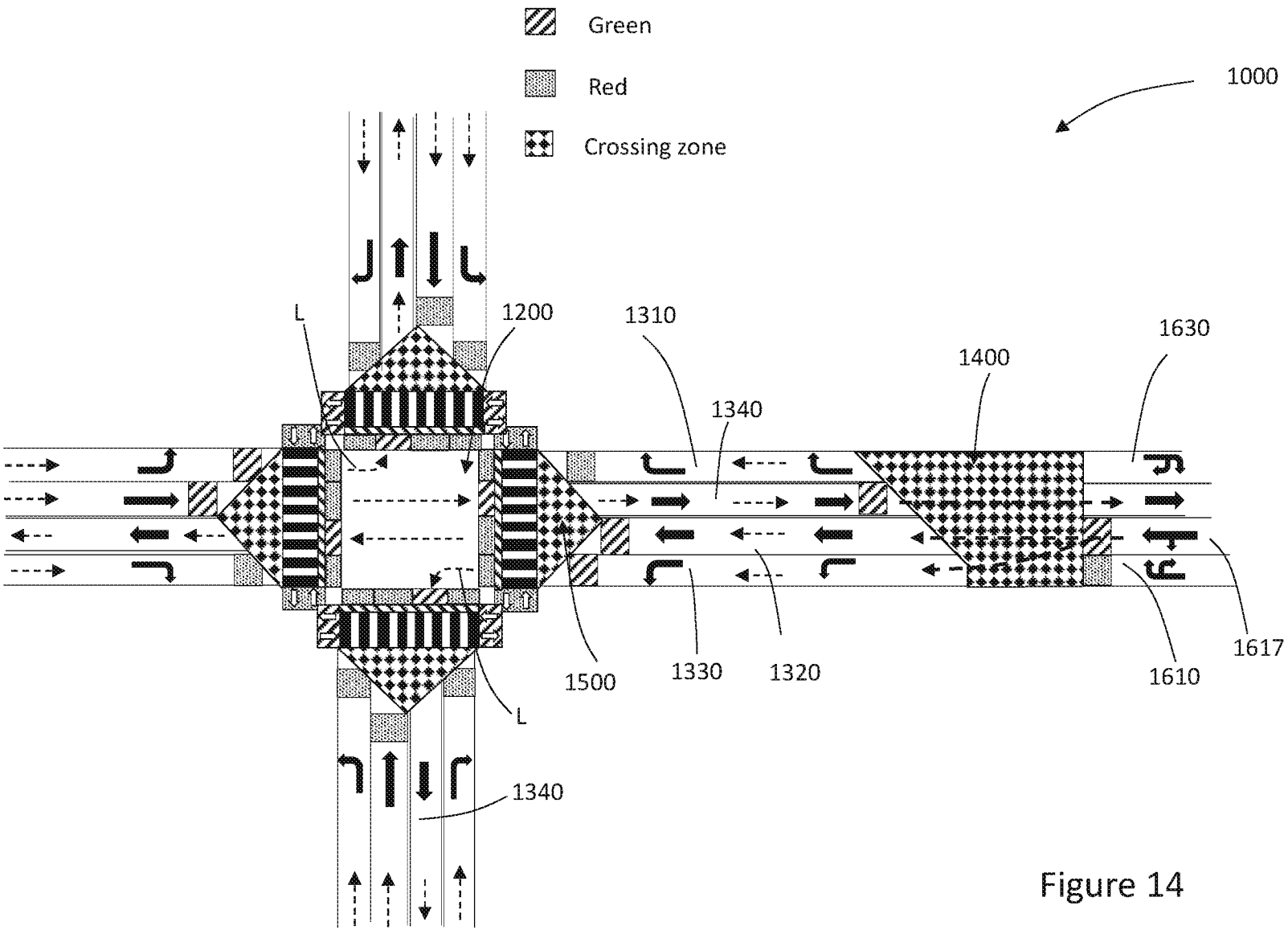
FIG. 14 shows a schematic view of a sixth embodiment of a traffic intersection, including two intersecting four lane roads showing the turning left lane turning left during a sub phase of the traffic guidance system.
Figure 15:
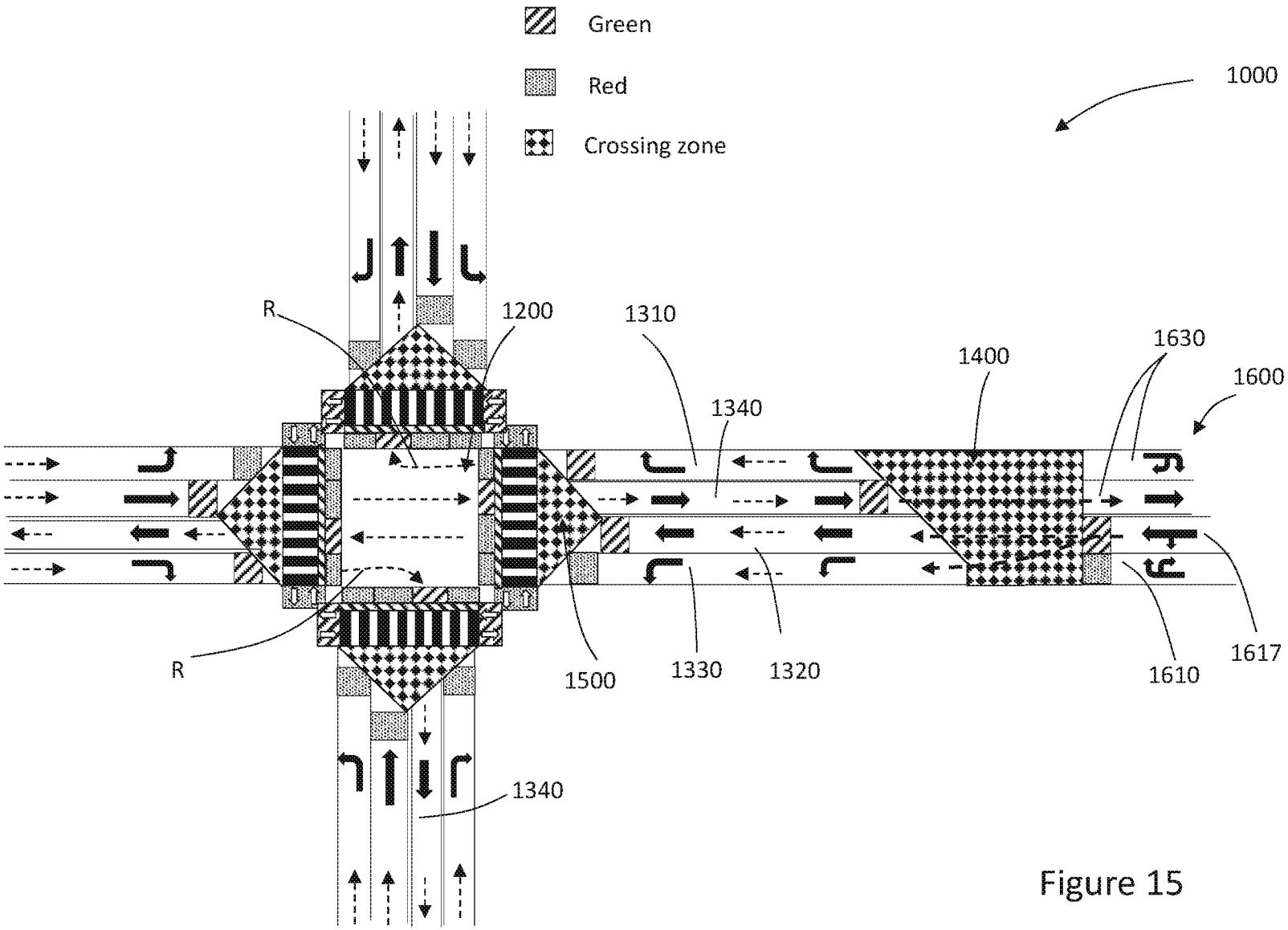
FIG. 15 shows a schematic view of the traffic intersection of FIG. 14, showing the turning right lane turning right in during another sub phase of the traffic guidance system.

It is further envisaged that at least one of the receiving lanes 1340 can be guided into a pair of leaving lanes 1630 as they transit over the distal crossover zone towards the distal region 1600. An example of this is shown in FIGS. 14 and 15.

In the embodiment shown in FIGS. 19-23, a traffic intersection comprising two intersecting roads of three lanes each is shown. In this embodiment, the middle lane of each road in the proximal region 1300 is used as a receiving lane 1340, and guides vehicles away from the intersection 1000 in each direction. It is envisaged that in this embodiment, three separate phases of the visual signalling devices will be used to guide vehicles through the traffic intersection 1000. This is discussed in more detail below. In the embodiments shown in FIGS. 19-23, the vehicles moving in the receiving lanes 1340 away from the intersection region 1200 are guided by visual signalling devices 3100 as they approach the distal crossover zone 1400, and will only be permitted to cross over the distal crossover zone 1400 when vehicles in the turning right lane are not moving across the distal crossover zone into the turning right lanes 1310 in the proximal region 1300. Vehicles are guided from the receiving lane 1340 into two leaving lanes 1630 as they crossover the distal crossover zone 1400. As may be seen in FIG. 22, the two leaving lanes 1630 are then merged back into a single combination approaching lane 1615 as the distal crossover zone 1400 of the next intersection 1000 is approached. This will provide space for bus stops, ride sharing, loading zones and parking, etc. In this way, traffic flow through the intersection using a small number of traffic phases can be provided.

Figure 24:
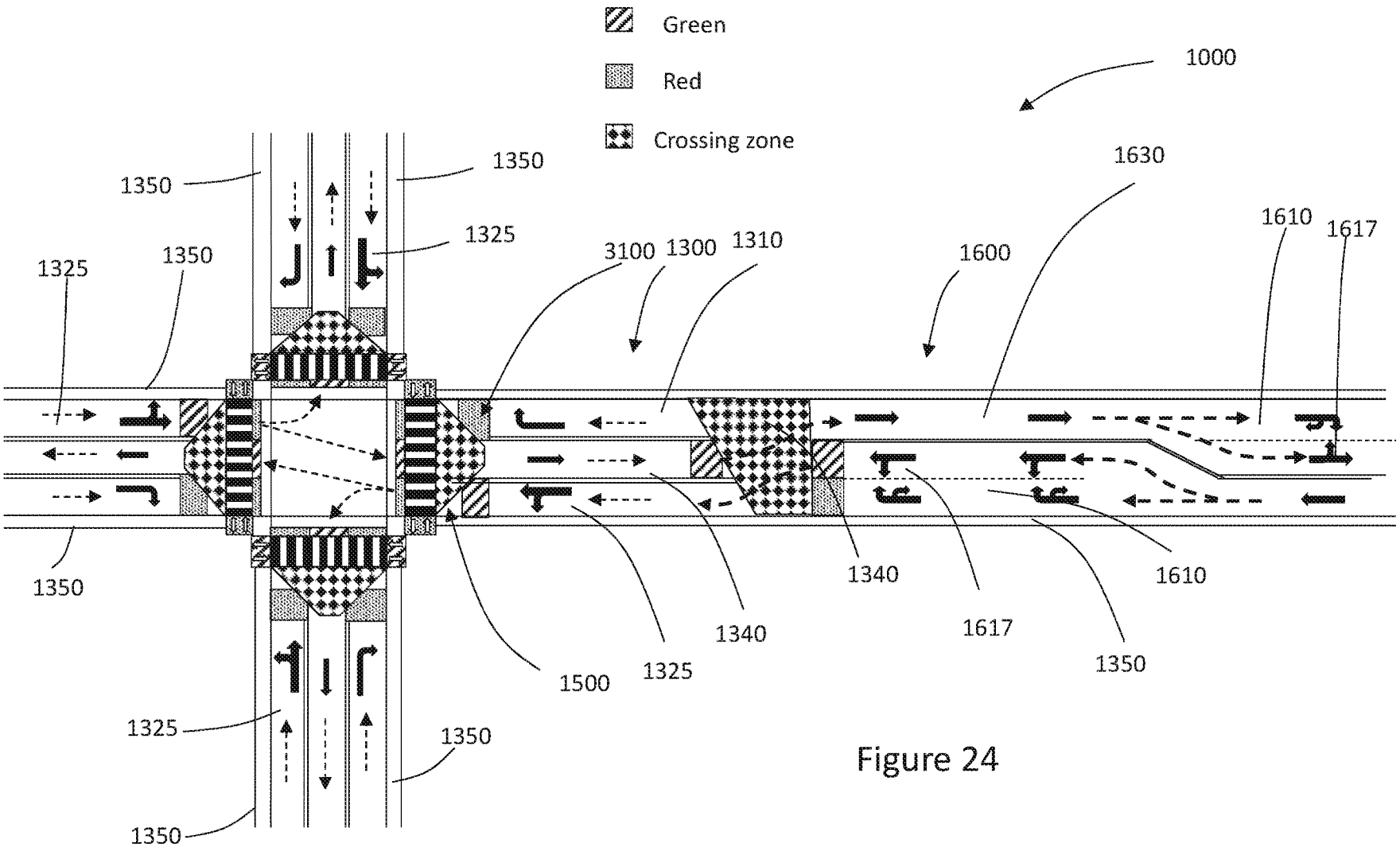
FIG. 24 shows a ninth embodiment of a traffic intersection, including two intersecting three lane roads, in a first phase.

A further embodiment of a traffic intersection comprising two intersecting roads of three lanes each is shown in FIG. 24. In this embodiment, each of the receiving lanes 1340 in the proximal region 1300 each guide vehicles to move away from the intersection region 1200. However, this embodiment is not preferred, as vehicles approaching the distal crossover zone 1400 are moving in an opposite direction to and in the same lane as the vehicles in the receiving lane 1340 moving away from the intersection region 1200. While the vehicles moving away from the intersection region 1200 in the receiving lane would be guided by visual signalling devices, this is not a preferable scenario.

Figure 22:
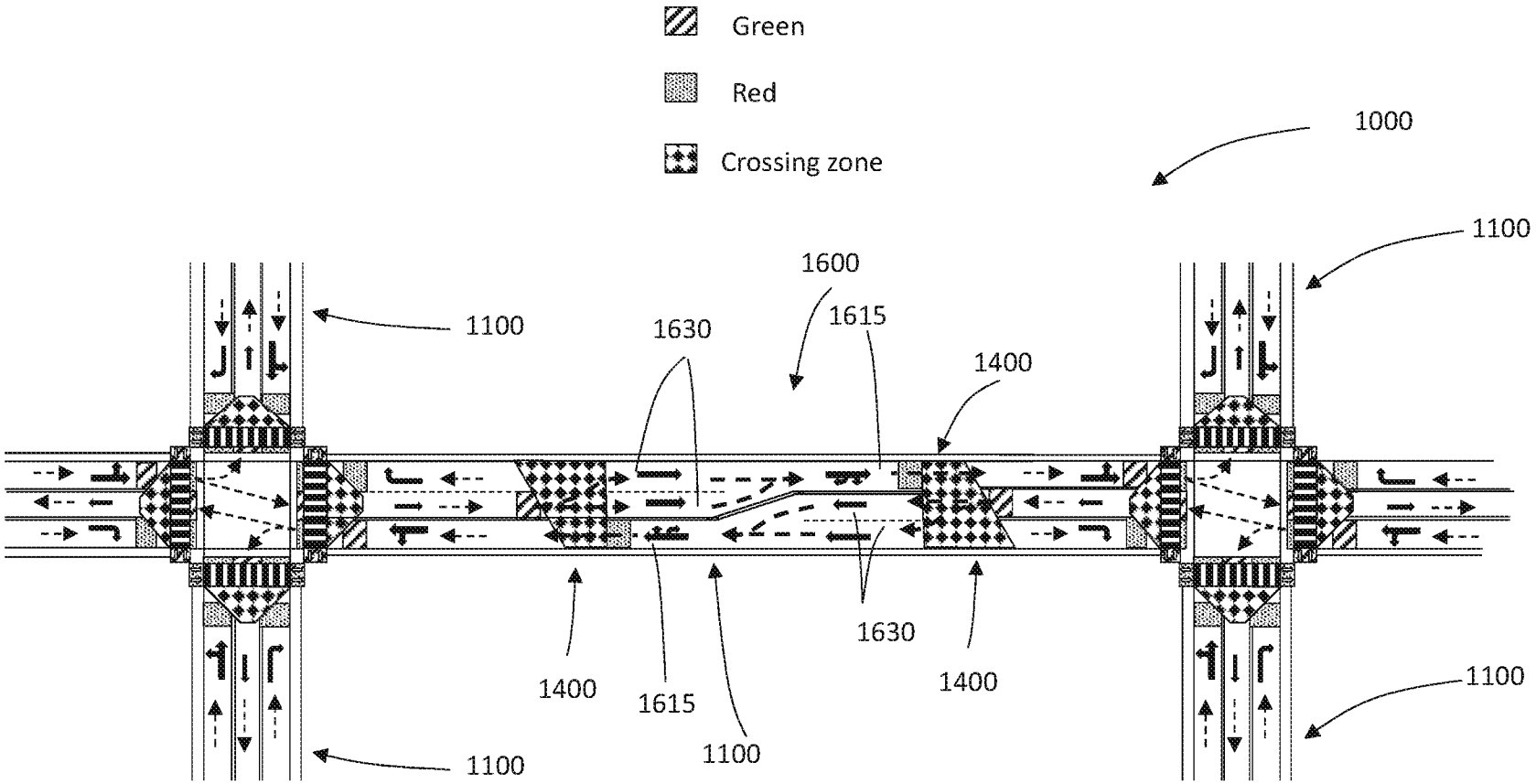
FIG. 22 shows the interrelationship of a pair of traffic intersections of FIG. 19.
Figure 23:
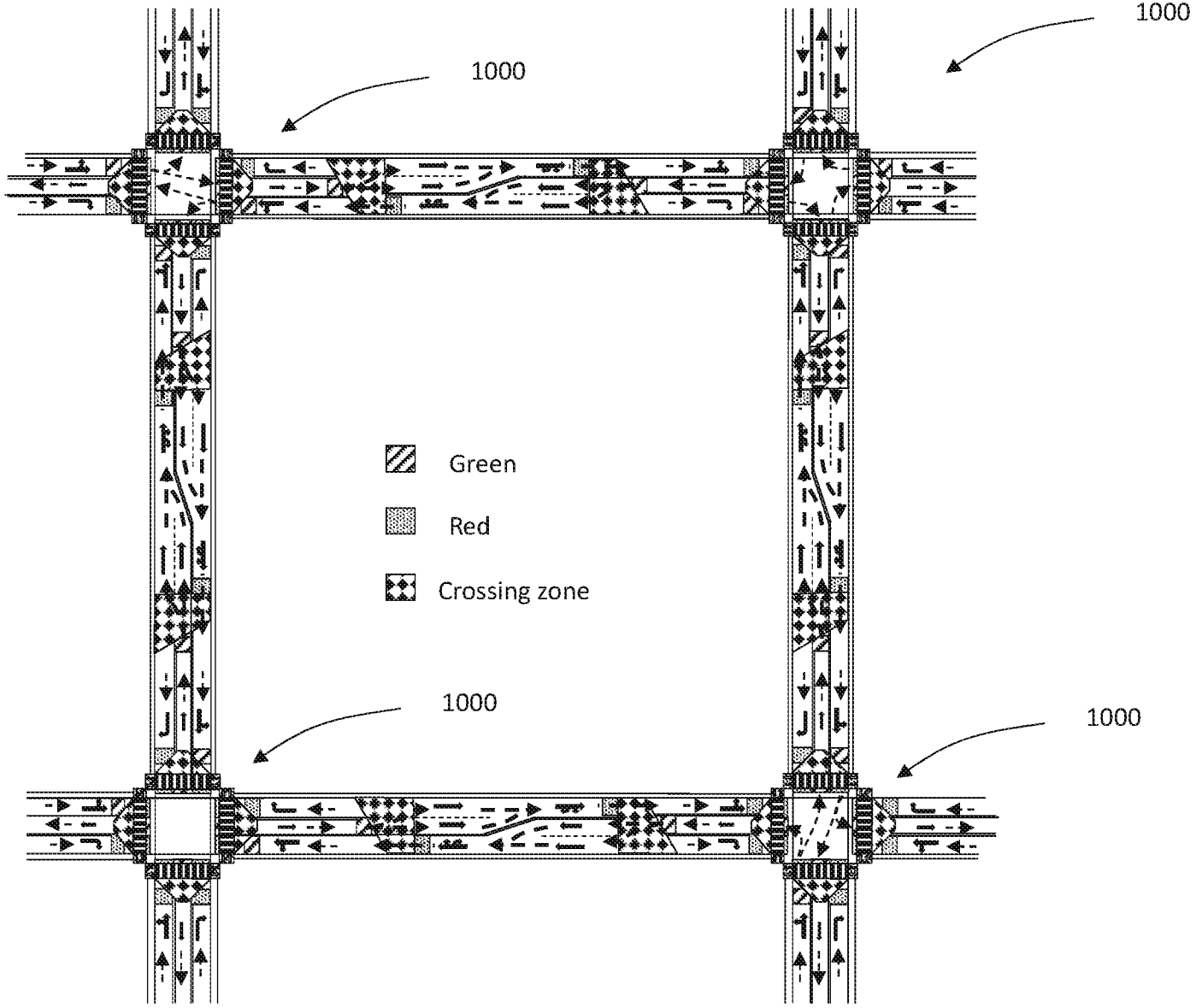
FIG. 23 shows a block of intersections of FIG. 19, each intersection in a separate phase.

In the embodiment shown in FIGS. 22 and 23, a pair of approaching lanes are guided to merge into a single combination approaching lane 1615 as shown in FIG. 22.

Lastly, in the embodiment shown in FIGS. 19-24, bicycle lanes 1350 are provided for guiding bicycles alongside the intersecting roads 1100. It will be appreciated by a person skilled in the art that bicycle lanes 1350 are optional to any embodiment.

It will be appreciated that in any of the embodiments in which vehicles are guided to turn into the right most of the turning right lanes 1310, the vehicles can also guided to carry out a U-turn in the distal crossover zone 1400.

By way of explanation, reconfigurable lanes 1370 in FIGS. 25-46 are shown having a "ying-yang" symbol as an indication of their dual nature.

Figure 42:
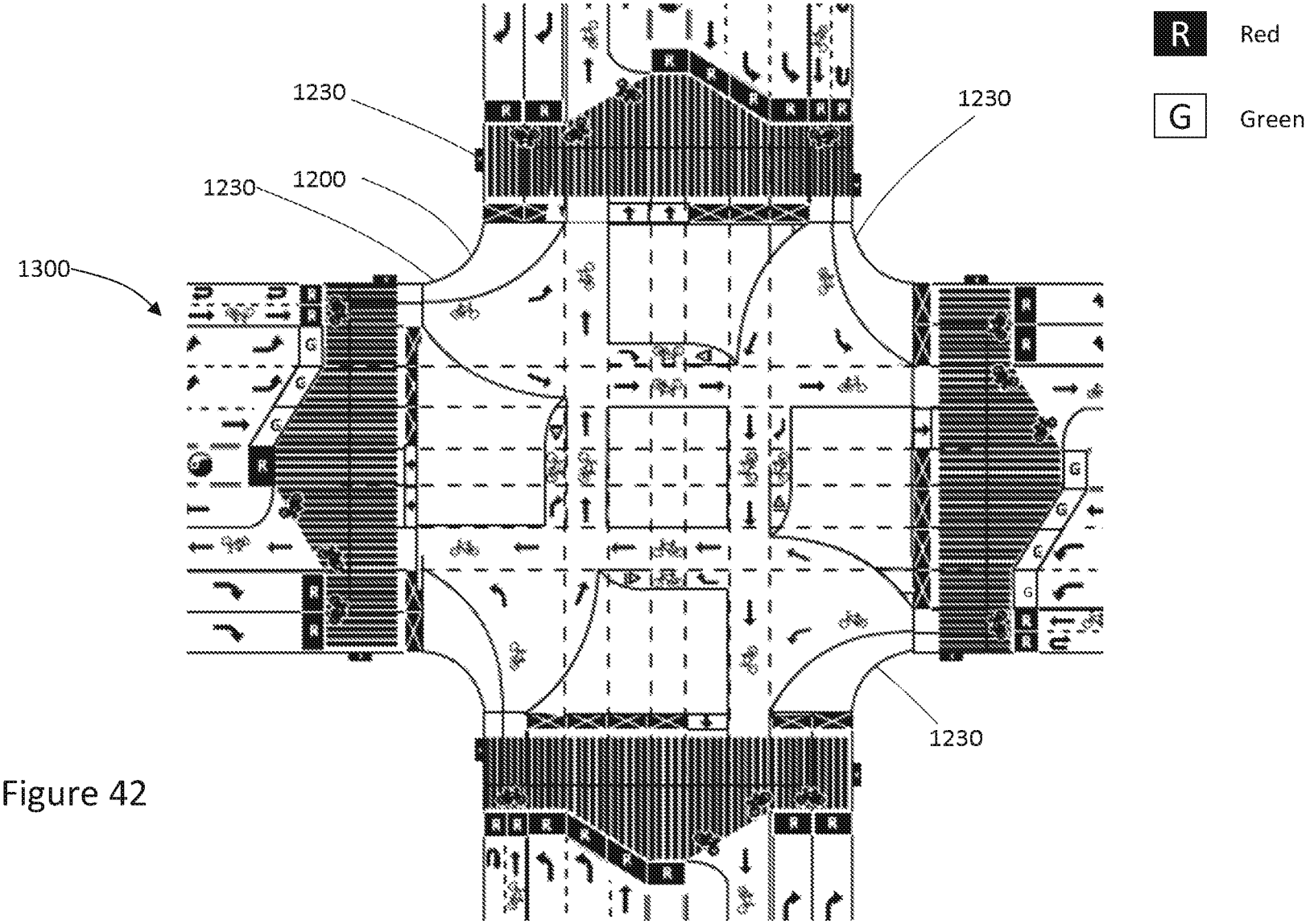
FIG. 42 shows a close-up view of the intersection of FIG. 41.
Figure 43:
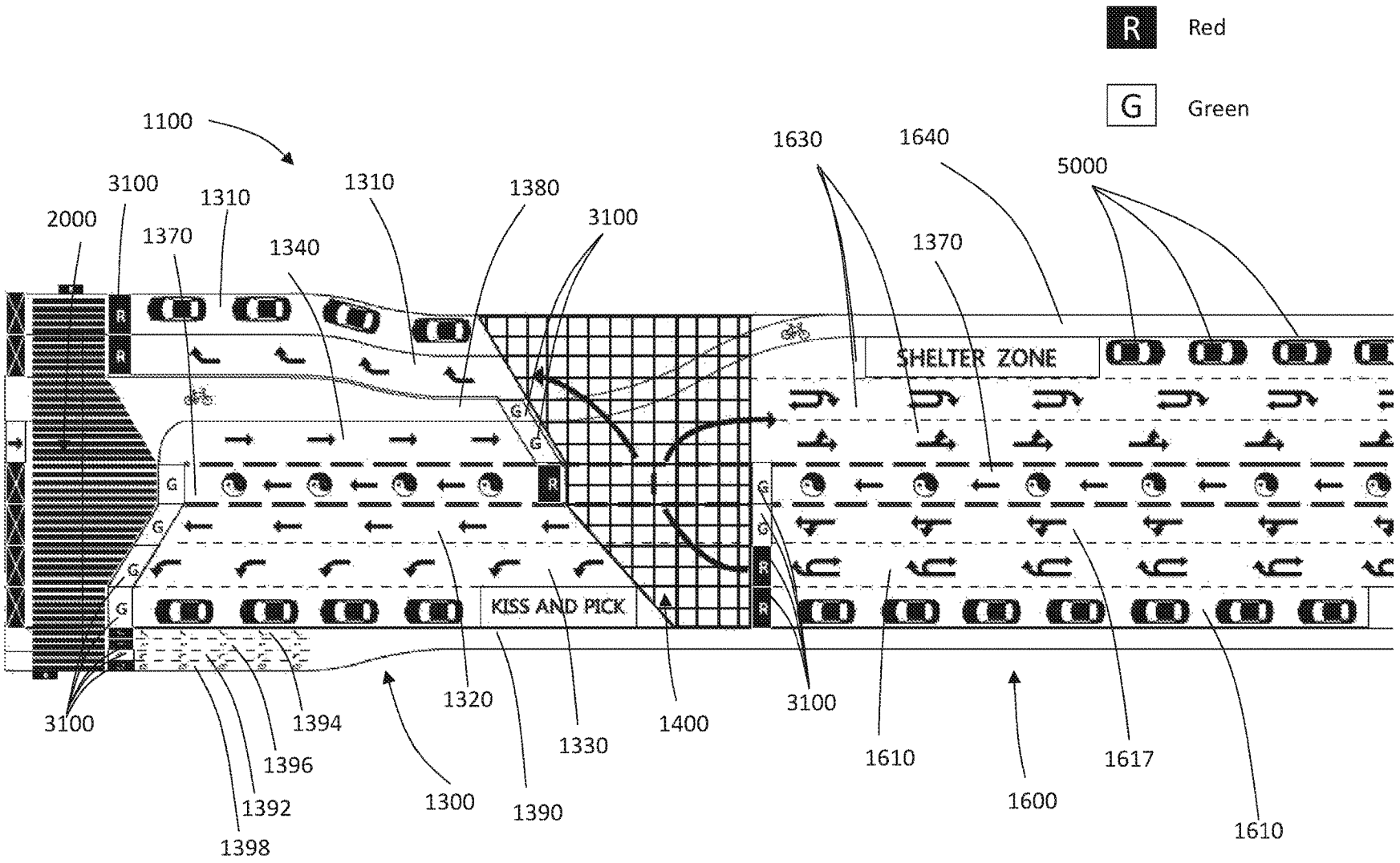
FIG. 43 shows a schematic view of an eight lane road of a traffic intersection, including a pair of turning right lanes and a pair of turning left lanes, with one of the turning right lanes and one of the turning left lanes being used as parking space.
Figure 44:
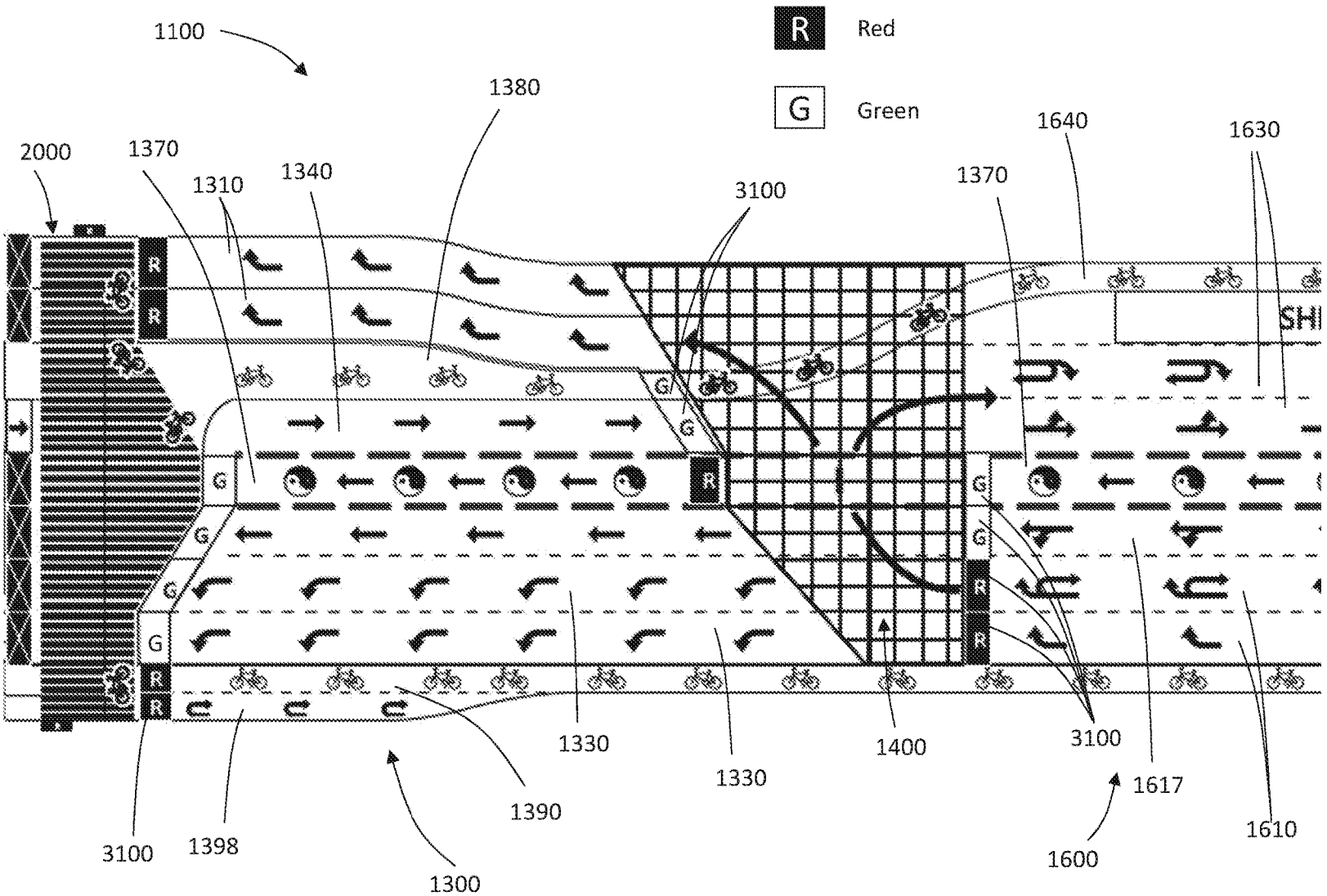
FIG. 44 shows a schematic view of an eight lane road, with all of the turning right lanes and turning left lanes being used for traffic.

In the embodiments shown in FIGS. 25-44, and shown in clearer detail in FIGS. 43 and 44, a different configuration of bicycle lanes are shown to the embodiments shown in FIGS. 1-25. The bicycle lanes extend along the intersecting roads, and include a receiving bicycle lane 1380 in the proximal region for receiving bicycles (not shown) that have traversed the intersection region 1200, either by turning from an intersecting road 1100, or by traversing directly across the intersection region in a straight line as will be described in more detail below.

As shown in FIGS. 25-47, the receiving bicycle lane 1380 extends between the turning right lane 1310 and the receiving lane 1340 in the proximate region 1300. The receiving bicycle lane 1380 extends to the distal crossover zone 1400, and a leaving bicycle lane 1640 extends distally of the distal crossover zone, with bicycles moving from the receiving bicycle lane 1380 to the leaving bicycle lane 1640 over the distal crossover zone. The leaving bicycle lane 1640 preferably extends adjacent a side of a road 1100.

Further, the traffic intersection 1000 includes an approach bicycle lane 1390 for guiding bicycles approaching the intersection region. The approach bicycle lane 1390 is preferably located adjacent a side of a road 1100.

It will be appreciated that bicycles crossing the distal crossover zone 1400 from the receiving bicycle lane 1382 the leaving bicycle lane 1640 may crossover the pathing of vehicles that may be moving over the distal crossover zone 1400 towards the intersection region 1200 from the right turn approaching lane 1610 to the turning right lane 1310. For this reason, it is envisaged that the traffic intersection will include visual signalling devices in the form of traffic lights for signalling to bicycles in the bicycle lanes. More specifically, visual signalling devices 3100 will be provided to bicycles approaching the distal crossover zone 1400 on the bicycle receiving lane 1380, as well as bicycles approaching the intersection region 1200 on the approach bicycle lane 1390.

As the approach bicycle lane 1390 approaches the intersection region 1200, it may split into several smaller lanes (which can each be provided with their own visual signalling device), including a turning left bicycle lane 1392, a turning right bicycle lane 1394, a moving straight bicycle lane 1396, and a U-turn bicycle lane 1398, as shown in FIG. 43.

In the embodiments shown in FIGS. 25-44, four bicycle waiting zones 1230 are provided in the intersection region 1200. The bicycle waiting zones 1230 are provided for bicycles that wish to turn right at the intersection to wait in until the sub phase has changed to a configuration in which they are able to traverse in the direction in which they are turning. The sub phase in which the bicycles waiting at the bicycle waiting zones 1230 would preferably be a sub phase that coincides with a phase that allows vehicles moving straight across the intersection along the intersecting road into which the bicycles are turning. This will be explained in more detail below.

In the embodiments shown in FIGS. 25-29, and 35-40, the bicycle waiting zones 1230 are provided proximate a central island 1220 located centrally of the intersection region 1200, arranged around the periphery of the island 1220. It must be noted that the central island is not an island in the traditional sense where it may be raised, and vehicles drive around it. The island 1220 is preferably a set of markings on the ground denoting a central region where vehicles can be expected to pass directly over in order to traverse the intersection by moving straight across it on the same road. The bicycle waiting zones 1230 are then configured to be to the side of the central island 1220, so that the bicycles are not in the way of vehicles while waiting in the bicycle waiting zones 1230.

In the embodiments shown in FIGS. 30-34 and 41-42, the bicycle waiting zones 1230 are provided around the periphery of the intersection region 1200. As will be apparent, the bicycle waiting zones are also out of the way of vehicles traversing directly across the intersection in the same phase.

In the embodiment shown in FIGS. 47-51, the configuration of the bicycle lanes is subtly different with respect to the extension of a pedestrian walkway 2100 that extends along the sides of the roads 1100. The bicycle receiving lane 1380 in the proximate region 1300 is the same as that shown in FIGS. 25-44, however distally of the distal crossover zone 1400, the bicycle lanes (referenced by 1382 in FIGS. 47-51) extend along the side of the road in the same area as a pedestrian walkway or pathway 2100 would be. An advantage of this configuration is that in contrast with the embodiment shown in FIGS. 25-44, the bicycle zones will not be removing a lane from the road 1100 (two bicycle lanes typically making up the width of a single lane of the road). This configuration also has positive implications for the safety of cyclists.

In the embodiments shown in FIGS. 52-61, the traffic intersection 1000 allows for increased parking opportunities in off-peak periods. In the embodiment shown in FIG. 52, both the turning left bicycle lane 1392 as well as the moving straight bicycle lane 1396 is reconfigurable into a reconfigurable bicycle parking lane 1399 that provides parking spaces for vehicles during off-peak times. When volumes of bicycle traffic are low, the turning right bicycle lane 1394 can be used by bicycles that are turning left, moving straight or turning right.

In the embodiments shown in FIGS. 53-61, one or more of the reconfigurable lanes 1370 are also configured as reconfigurable parking lanes 1372 that can be reconfigured as vehicle parking, preferably during off-peak times. Preferably, one or two reconfigurable parking lanes 1372 are spaced intermediate a pair of reconfigurable lanes 1370, thereby allowing access by vehicles into individual parking spots.

Traffic Guidance System

It is envisaged that the traffic intersection 1000 will be equipped with a traffic guidance system 3000 that comprises a controller 3200 that is configured for connecting to and controlling visual signalling devices 3100, preferably in the form of traffic lights. It is further envisaged that the controller can be connected to cameras 3300 configured to relay a view of the distal crossover zones 1400 and/or the intersection region 1200 and/or the proximal crossover zones 1500 to a control centre (not shown). By being able to view and record traffic in these areas, police and emergency vehicles can be dispatched quickly to ensure that the crossover zones are maintained free and free and clear of vehicles, to allow for flow of traffic even in the event of an accident or similar.

Preferably, at least one visual signalling device 3100 will be provided for each of the turning right lane, going straight lane, turning left lane, and/or combination going straight and turning left lane (where applicable) at each side of the intersection region 1200. Visual signalling devices 2100 will further be provided for lanes approaching the distal crossover zone. The visual signalling devices 3100 can, in addition to being configured for signalling to vehicles, also be configured for signalling to pedestrians on the pedestrian crossings 2000.

In a preferred embodiment, the visual signalling devices 3100 will together preferably be operable in one of three configurations. The configuration is envisaged include a green (go) signal, a red (stop) signal, and an amber (slow in preparation for stop) signal as is known on conventional traffic lights.

However, the visual signalling devices 3100 will also be controlled by the controller 3200 to operate in two main phases, with an optional third phase being possible. Each of the two main phases may also be subdivided into two sub phases.

In a first of the main phases, vehicles moving straight across the intersection will be guided to proceed, and vehicles turning left and right into the intersecting road 1100 will also be directed to proceed at some stage during the main phase.

In a second of the main phases, vehicles moving straight across the intersection will be guided to stop before the intersection region, while vehicles turning left and right into the intersecting road 1100 will also be directed to stop.

During the first sub phase of the first main phase, vehicles turning left will initially be stopped before the intersection region, and bicycles in the approach bicycle lane 1390 from the same side of the intersection will be guided to proceed, while vehicles turning right from an opposed side of the intersection will be guided to proceed. Vehicles turning right from an opposed side of the intersection are more likely to see bicycles turning left from the turning left bicycle lane 1392. Simultaneously, while bicycles turning left are allowed to proceed, bicycles proceeding straight from the moving straight bicycle lane 1396 will be signalled to proceed. Bicycles in the turning right bicycle lane 1394 will also be guided to proceed to the relevant bicycle waiting zone 1230.

In this way, bicycles are prevented from being inadvertently knocked over by vehicles turning left, as the vehicles turning left would be traversing over the path of bicycles moving straight or turning right, and the likelihood of collisions would be higher.

During the second sub phase of the first main phase, bicycles in the approach bicycle lane 1390 will be stopped, while vehicles in the turning left lane 1330 will be signalled to proceed. Simultaneously, vehicles at an opposed side of intersection in the turning right lane will be signalled to stop. In this regard, it is pointed out that bicycle waiting zones 1230 are provided in a location in the intersection region 1200 where bicycles that wish to turn right are allowed to move into the intersection region during a first main phase, and wait out of the path of vehicles traversing directly across the intersection. The bicycles are then guided to proceed in turning right at the start of the second main phase, when vehicles traversing directly across the intersection on the road that intersects the road that the bicycles have turned from, start to move.

In FIGS. 1-24, the integration of bicycle lanes with the traffic intersection 1000 and traffic guidance system 3000 is not considered, and controlling of traffic is described in terms of the main phases and sub phases, and with reference to the reconfigurable lanes 1370. A first main phase is shown in FIG. 1, wherein vehicles travelling in the North-South direction on one of the intersecting roads are visually signalled by the visual signalling devices to go, while vehicles travelling in the East-West direction on the other of the intersecting roads are visually signalled by the visual signalling devices to stop. In FIG. 1, the reconfigurable lanes 1370 are configured to allow increased flow of vehicles towards the north, and east on each of the intersecting roads.

In FIG. 1, vehicles turning left and/or right onto an intersecting road to move in an easterly direction (shown as E1 and E2 on FIG. 1) are guided by the traffic guidance system to turn at simultaneous times. This is because sufficient lanes in the form of the receiving lane 1340 as well as the reconfigurable lanes 1370 are available to receive at least two lanes of vehicles turning onto that road. However, vehicles turning at the intersection to move into a westerly direction (shown as W1 on FIG. 1) only have a single receiving lane 1340 available for receiving turning vehicles. Accordingly, the traffic guidance system will be configured to operate the visual signalling devices 3100 in separate sub phases so that only one of the turning left or turning right lanes are operated at a time to move into the receiving lane 1340 of the road moving east.

At the same time, visual signalling devices 3100 signalling those pedestrian crossings 2000 that traverse the intersecting road where vehicles have been signalled to go, will signal for pedestrians and/or bicycles crossing that road to stop.

However, visual signalling devices 3100 signalling those pedestrian crossings 2000 that traverse the intersecting road where vehicles have been signalled to stop, will signal to pedestrians and/or bicycles respectively to go.

On the intersecting road on which vehicles have been signalled to stop, the visual signalling devices 3100 will signal for vehicles in the turning right lane to proceed through the distal crossover zone 1400 into the proximal right turning lane 1310.

When the visual signalling devices 3100 have signalled for vehicles on an intersecting road to move over the intersection region 1200, then the visual signalling devices signalling the vehicles approaching the distal crossover zone 1400 will cause these vehicles to stop.

Figure 2:
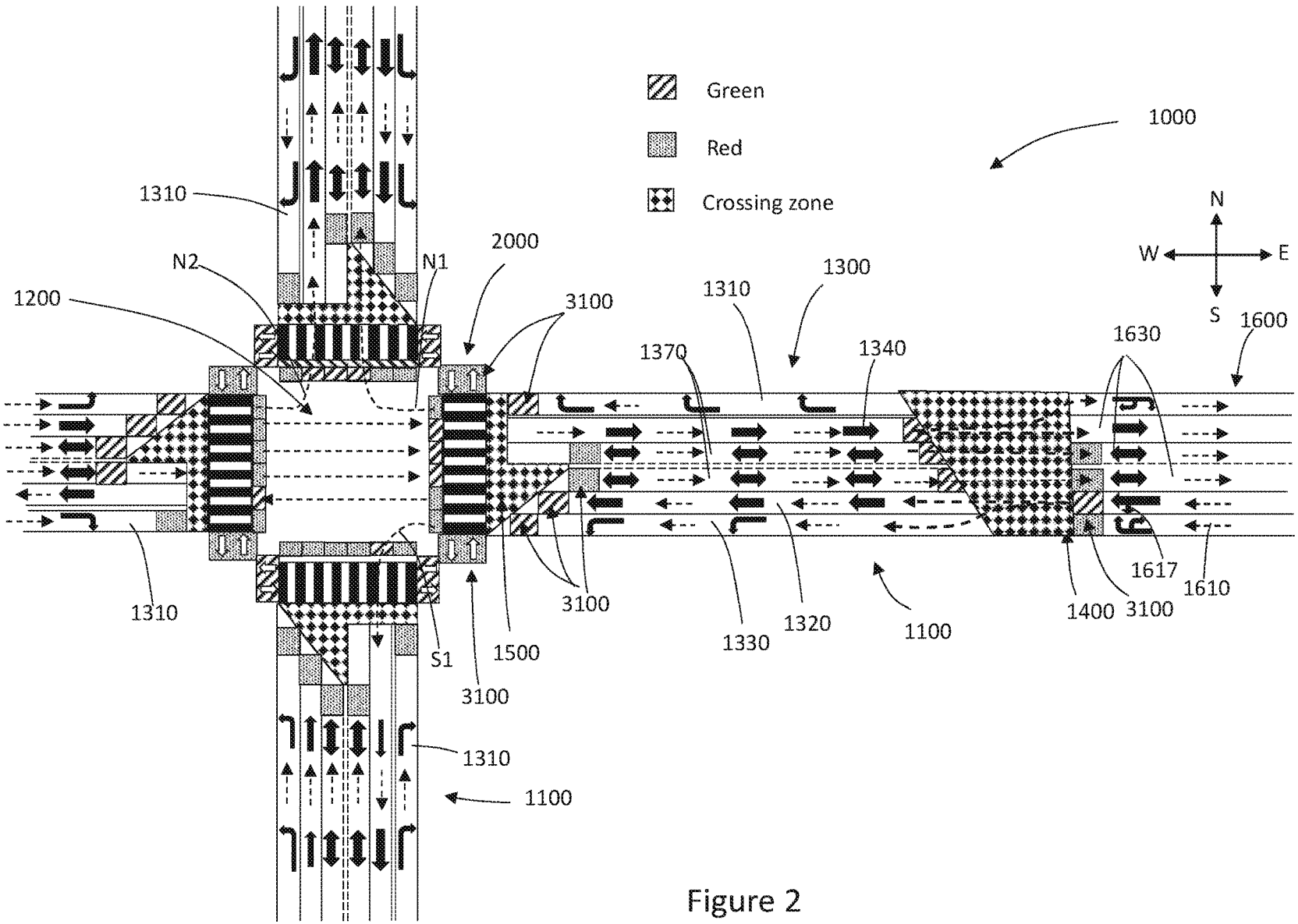
FIG. 2 shows a schematic view of the first embodiment of a traffic intersection of a six lane road crossing a six lane road, with vehicles moving in both directions on each road with the visual signalling devices being in a second phase.

A second main phase of the visual signalling devices for the same intersection is shown in FIG. 2. The configuration of the visual signalling devices will be substantially opposite of the first phase described above, with all of the vehicles and pedestrians that have previously been signalled to stop, then being signalled to go, and vice versa.

In FIG. 2, vehicles travelling in an east-west direction on one of the intersecting roads are visually signalled by the visual signalling devices to go, while vehicles travelling straight in a North-South direction are signalled to stop. Again it can be seen that vehicles turning left and/or right into an intersecting road to travel northwards (shown as N1 and N2 on FIG. 2) are signalled simultaneously to turn, while those turning lanes for vehicles turning into an intersecting road to travel south (shown as S1 on FIG. 2) are signalled to move in an alternating sub-phase.

Figure 3:
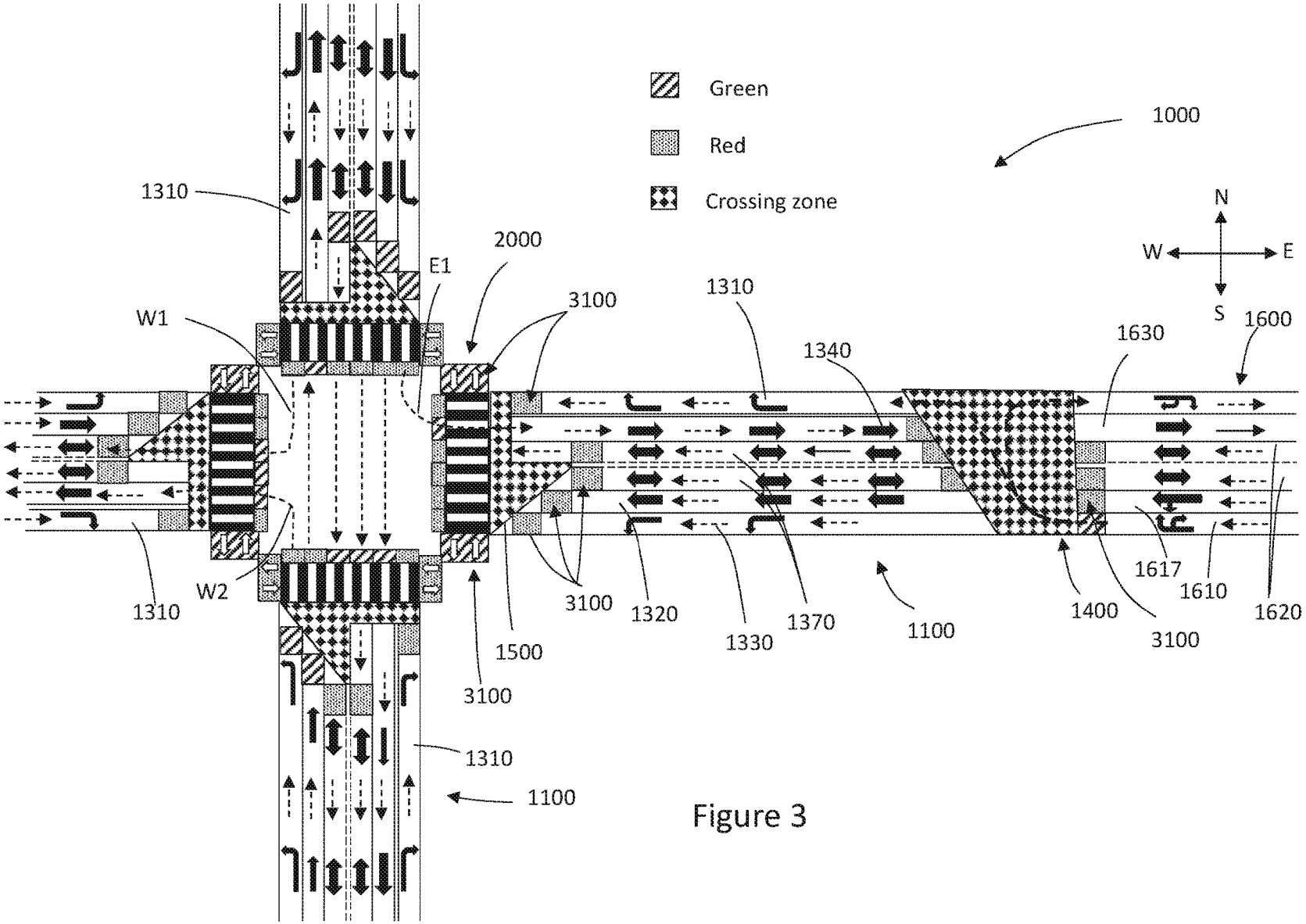
FIG. 3 shows a schematic view of the first embodiment of a traffic intersection of a six lane road crossing a six lane road, with the reconfigurable lanes in a second configuration, and with the visual signalling devices being in a first phase.

Another phase of the same intersection is shown in FIG. 3, whereby the reconfigurable lanes 1370 are configured to allow increased flow of vehicles towards the south and west on each of the intersecting roads. In this configuration, as there are an increased number of lanes that are capable of receiving vehicles turning from the north-south road into the road travelling west, the traffic guidance system allows for vehicles turning left and/or right into the lanes travelling west (shown as W1 and W2 on FIG. 3) to move simultaneously. However, vehicles turning into the intersecting road to travel east only have a single receiving lane 1344 receiving turning vehicles. Accordingly, vehicles turning left are first signalled to move into the receiving lane travelling east in a first sub-phase (shown as E1 on FIG. 3), while in a second sub-phase (not shown), vehicles turning right to move into the receiving lane travelling east are signalled to move.

Figure 4:
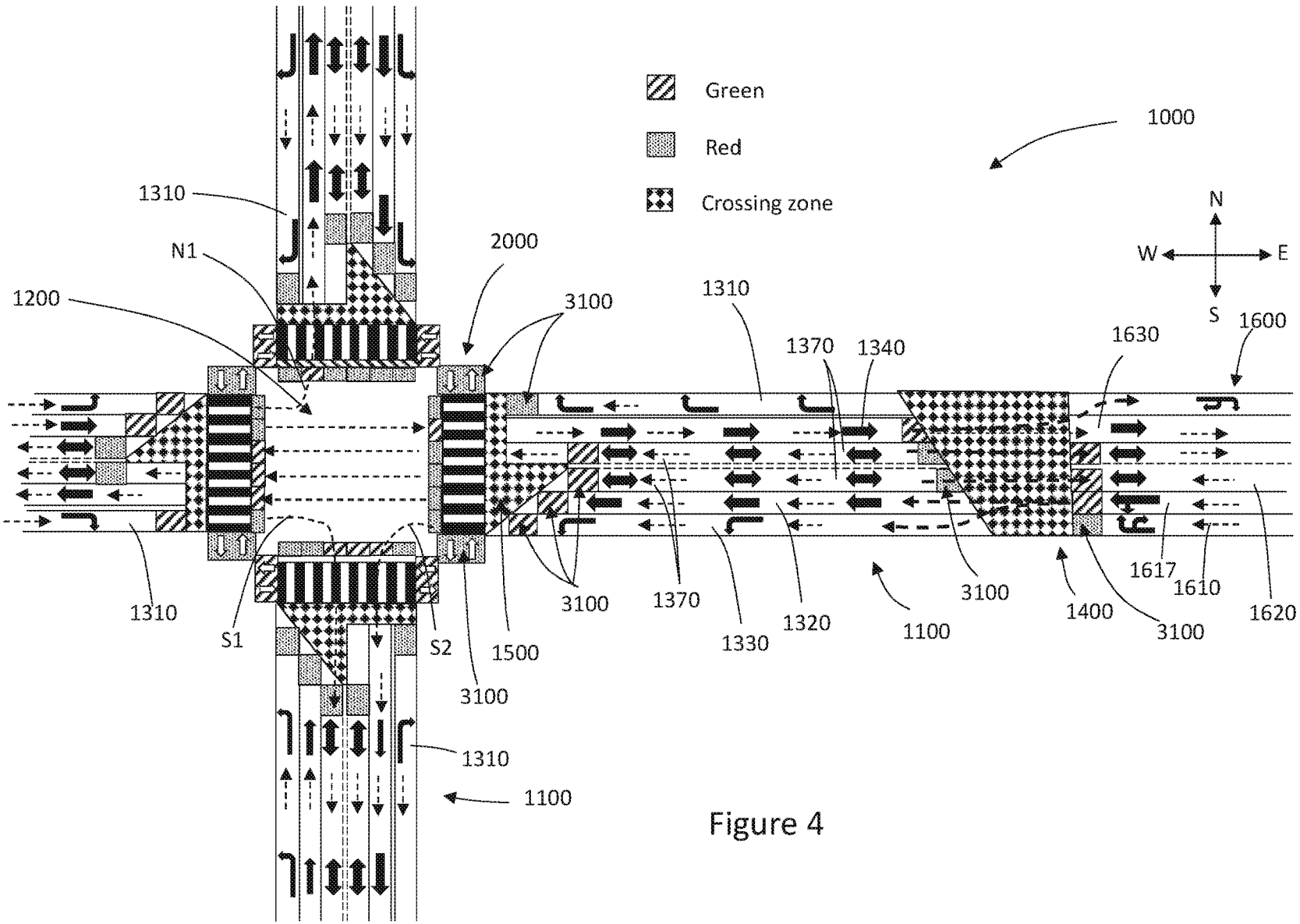
FIG. 4 shows a schematic view of the first embodiment of a traffic intersection of a six lane road crossing a six lane road, with the reconfigurable lanes in a second configuration, and with the visual signalling devices being in a second phase.

The same intersection is shown in FIG. 4, with the reconfigurable lanes still allowing for increased traffic direction in a westerly and southerly direction but showing the traffic lights configured in a second phase where vehicles moving straight over the intersection in an East-West direction are signalled to move, while vehicles moving straight over the intersection in a north-south direction are signalled to stop. As sufficient lanes are available for receiving vehicles turning left and/or right into a road travelling south (shown as S1 and S2 on FIG. 4), the vehicles are signalled to turn simultaneously. It is further preferable that vehicles turning left and a right simultaneously to travel in the same direction have a lane spacing between them. Vehicles turning left and/or right into the road travelling north only have a single receiving lane and are accordingly signalled to move in alternating sub-phases (shown as N2 in FIG. 4).

Reference to a first phase and second phase of the visual signalling devices on the timescale of individual traffic light phases takes into account the predetermined direction of the reconfigurable lanes 1370, as if they were constant, with reconfiguration of reconfigurable lanes 1370 occurring on a larger timescale during the day as described above.

A visual signalling device 3100 is provided for signalling to at least one distal turning right lane 1310 distally of the distal crossover zone, for guiding vehicles to cross the distal crossover zone to move into the turning right lane 1310 proximally of the distal crossover zone 1400. Further, a visual signalling devices are provided for signalling to all of the other transit lanes crossing the distal crossover zone in either direction.

Additionally, visual signalling devices are preferably provided for each of the transit lanes for guiding vehicles to cross the intersection region 1200.

It is envisaged that visual signalling devices will be provided to signal to vehicles whether they can start crossing the intersection region 1200. In addition, visual signalling devices can be provided for indicating whether a transit lane may be entered from the intersection region. This is especially useful for vehicles that are turning into an intersecting road, where the vehicle driver may not be certain of the direction in which the reconfigurable lanes are configured.

Figure 5:
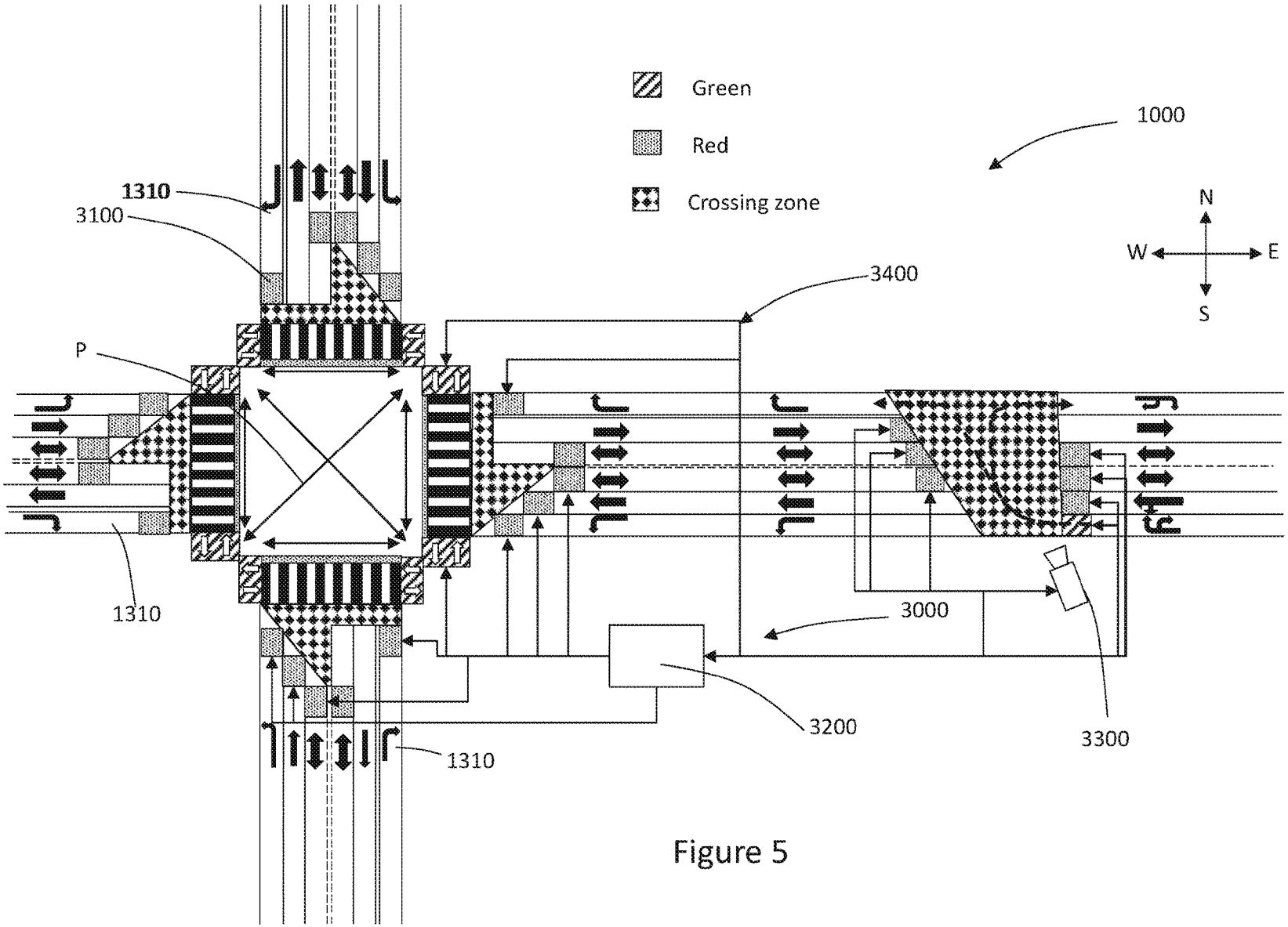
FIG. 5 shows a schematic view of a first embodiment of a traffic intersection of a six lane road crossing a six lane road, showing a control system operating the visual signalling devices in a third phase in which vehicles are prevented from crossing the intersection region while pedestrians cross, with vehicles in the distal turning right lane being signalled to cross the distal crossover zone into the proximal turning right lane and/or carry out a U-turn.
Figure 6:
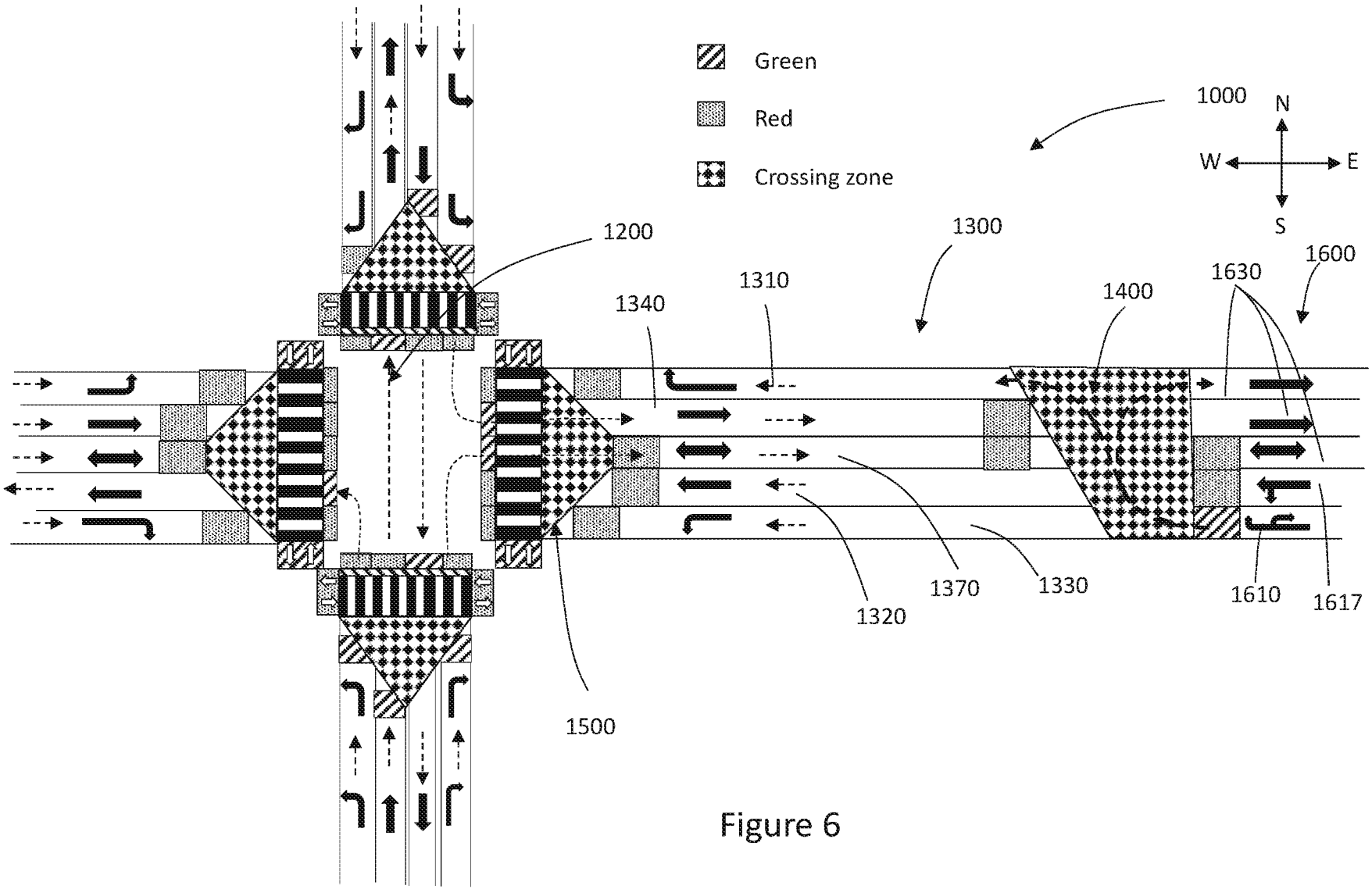
FIG. 6 shows a schematic view of a second embodiment of a traffic intersection of a five lane road crossing a four lane road, with the central lane of the five lane road being a reconfigurable lane.

An example of another phase or configuration (which may be applicable to any of the embodiments) is shown in FIG. 5 in which the visual signalling devices will signal to all of the vehicles in both of the intersecting roads to stop moving over the intersection region 1200, while the pedestrian crossings 2000 on both of the intersecting roads will be signalled to go. It is envisaged that during this phase, vehicles that are approaching the distal crossover zone in the turning right lane distally of the distal crossover zone, will be guided to traverse the distal crossover zone to move into the proximal turning right lane. Vehicles approaching the distal crossover zone from either side in the other transit lanes will be guided to stop.

For use in the traffic intersection 1000 described above, the visual signalling device 3100 for guiding vehicles in the turning right lane 1310 will preferably be distanced from the visual signalling device 3100 signalling to the going straight lane 1320 by at least two vehicle spacings, as the turning right lane 1310 will be spaced from the going straight lane 1320 by at least one lane of the receiving lane 1340.

As previously mentioned, it is anticipated that a combination going straight and turning left lane can be provided. Accordingly, the relevant visual signalling device 3100 can be configured to signal to vehicles to turn left onto the intersecting road 1100 as well as go straight across the intersection region 1200.

In a preferred embodiment, the controller is configured for controlling operation of the visual signalling devices 3100 in three configurations to switch between a red or stop condition, green or go condition and amber or slow condition. However, the controller will also be configured to control all of the visual signalling devices together to operate in a plurality of phases as described.

The controller preferably comprises a processor (not shown) configured for receiving instructions from digital storage medium, as well as digital storage media configured for storing digital instructions (not shown). The controller could be configured for receiving instructions over a local area network (LAN) or wide area network (WAN) such as the Internet or similar. The controller (not shown) is preferably connected or connectable to the visual signalling devices 3100 by means of a network 3400. The network 3400 can be a wireless network or a hardwired network.

In an alternative embodiment, it is envisaged that the controller can be remotely located and be connected to the visual signalling devices 3100 by means of a long-distance or wide area network. The wide area network can be the Internet, although this is not preferred.

The digital instructions preferably in the form of software that is stored on one or more digital storage mediums (not shown), such as a hard disc, a server centre, or a cloud-based storage server.

It is further envisaged that a centralised controller can control the visual signalling devices 3100 at a plurality of traffic intersections 1000, to thereby allow traffic to flow at more optimal levels through a plurality of traffic intersections 1000. This would include controlling of the visual signalling devices to allow for the reversal of direction of traffic in the reconfigurable lanes 1370 to account for increased traffic in any particular direction at different times of the day.

In this way, traffic congestion caused by vehicles turning across the flow of traffic (for example in turning right lanes) is dissipated by moving area in which vehicles cross each other's paths to a distance away from the intersection region 1200.

While each visual signalling device 3100 may be operable in two, or possibly three configurations (i.e. red, green and amber), for each given setting for the reconfigurable lanes, it is envisaged that the plurality of visual signalling devices 3100 at each traffic intersection 1000 will be controlled by the controller to be operable together in a number of phases equal to the number of intersecting roads (or parts thereof where a road terminate at the intersection), plus one. For example, where two intersecting roads are shown in FIGS. 1, 2 and 5, the plurality of visual signalling devices 3100 will be operable in a first phase as shown in FIG. 1, a second phase shown in FIG. 2, and a third phase, allowing for the crossing of pedestrians, as shown in FIG. 5. The number of overall phases are significantly less than the phases that would be required for commonly known prior art traffic intersections.

It is further envisaged that in an alternative embodiment, the turning left lanes and turning right lanes on opposite sides on a first road, that would be turning into the same second road to move away from the intersection in the same direction, need not be directed to turn into that road at the same time. Instead, vehicles in the turning left lanes and turning right on opposite sides can turn during separate sub-phases, during the main phase while vehicles in the going straight lanes are moving through the intersection. These are regarded as separate "sub phases" of the main phase while vehicles moving straight through the intersection on the first road are moving. In this way, turning vehicles that are vehicles turning into the same receiving lane, or into adjacent receiving lane, have less chance of collision.

As an example, and as shown in FIGS. 14 and 15, it is envisaged that the time during which vehicles are moving straight are regarded as the "main phase". In the embodiment shown in FIGS. 14 and 15, during the main phase, while vehicles passing straight through the intersection are given the green light to move for 40 seconds, the vehicles turning left (shown as arrow L in FIG. 14) from the turning left lane will be given the green light to turn left into receiving lane 1340 for 20 seconds, and then vehicles turning right (shown as arrow R in FIG. 15) from the turning right lane will be given the green light to turn right into receiving lane 1340 for 20 seconds.

Further, in a preferred embodiment, it is envisaged that, where reconfigurable lanes 1370 are provided, the controller 3200 will ensure that the reconfigurable lanes are always controlled so that one lane is provided for receiving vehicles turning left, one lane is provided for vehicles turning right, and preferably that another lane is provided between these. Alternately, where not enough lanes are available for providing a lane for receiving each of the vehicles in the turning left and turning right lanes, the controller will ensure that the turning left and turning right lanes are received into the receiving lane 1340 in separate sub phases.

Figure 12:
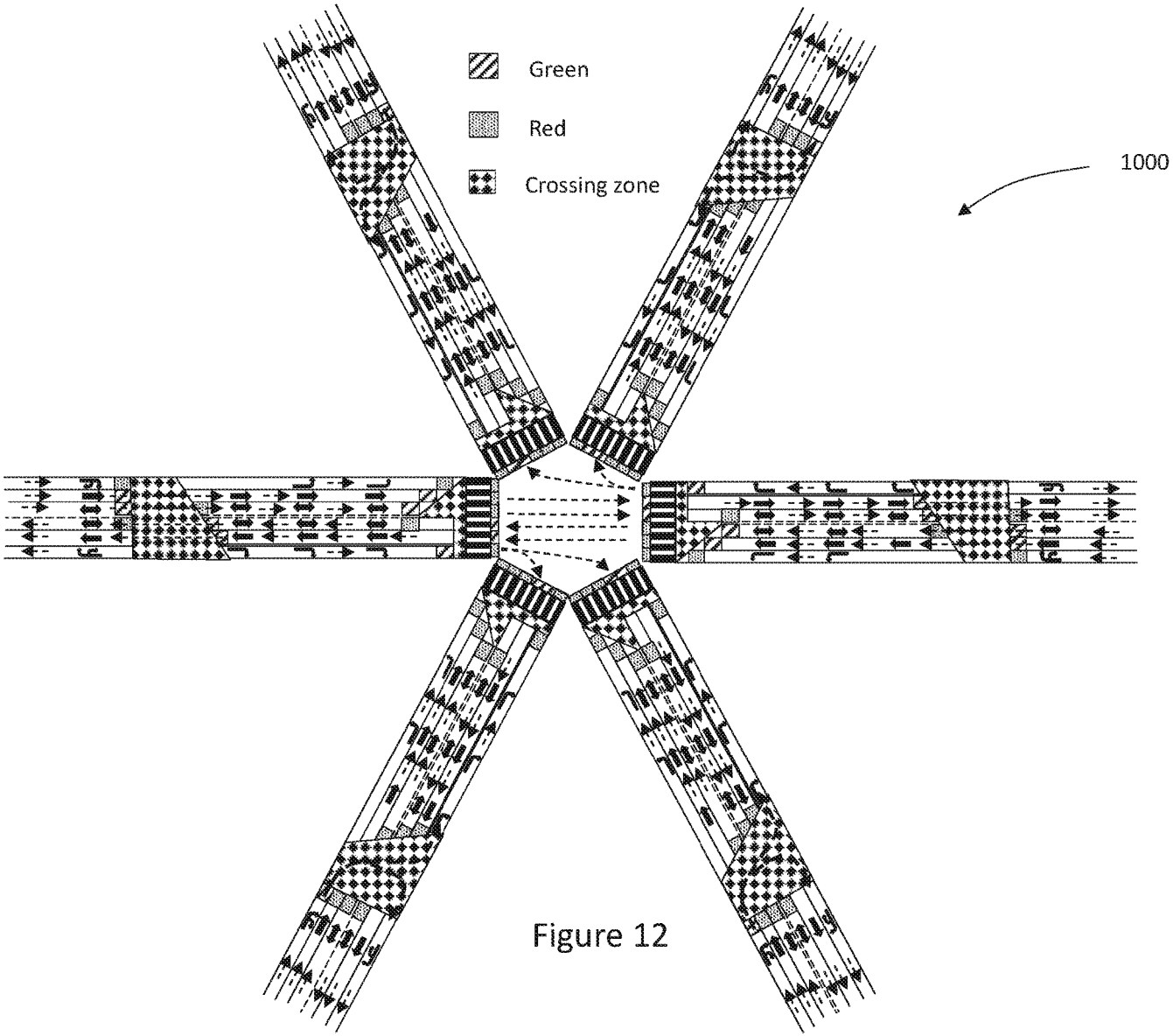
FIG. 12 shows a schematic view of a fifth embodiment of a traffic intersection including six intersecting roads showing a first phase and a first sub-phase of the traffic guidance system.
Figure 13:
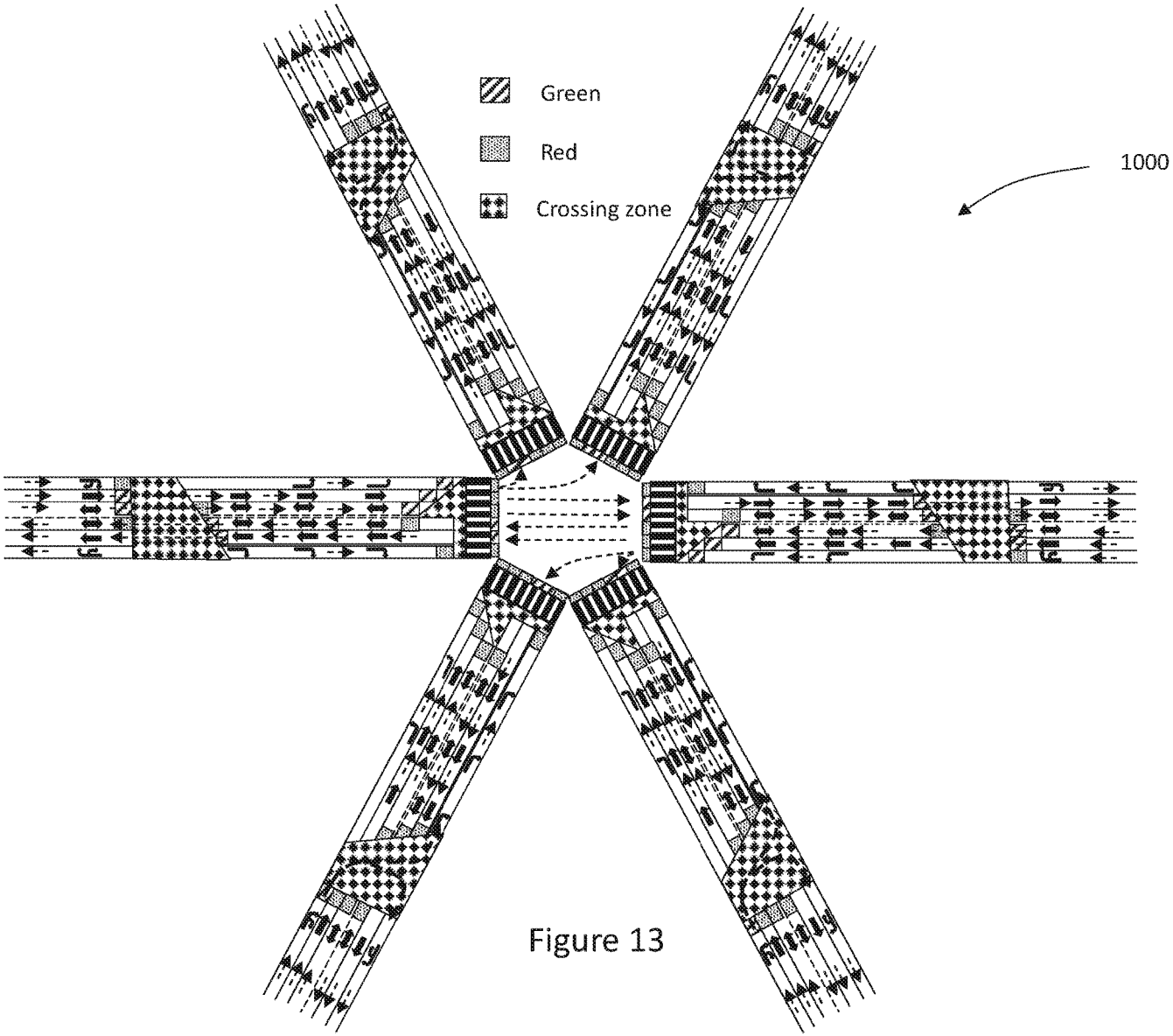
FIG. 13 shows a schematic view of the fifth embodiment of a traffic intersection in a first phase, and a second sub phase of the traffic guidance system.

A traffic intersection according to the present invention is further well-suited for increasing the throughput of traffic through intersections where more than two intersecting roads meet. For example, three aligned intersecting roads are shown in FIGS. 12 and 13, one phase would be required for each pair of roads leading to the intersection, plus an optional further phase for pedestrians. In another embodiment (not shown), where five roads approach the intersection, the number of phases required would be three (i.e. one phase for each pair of roads, or part of a pair), plus an optional phase for pedestrians. FIG. 12 shows the traffic guidance system in a first phase, with the turning left and turning right lanes in a first sub-phase, allowing vehicles from one of the roads approaching the intersection to turn left and/or right. FIG. 13 shows the traffic guidance system in the same first phase, with the turning left and turning right lanes in a second sub-phase, allying vehicles from the opposed road approaching the intersection to turn left and/or right.

Figure 45:
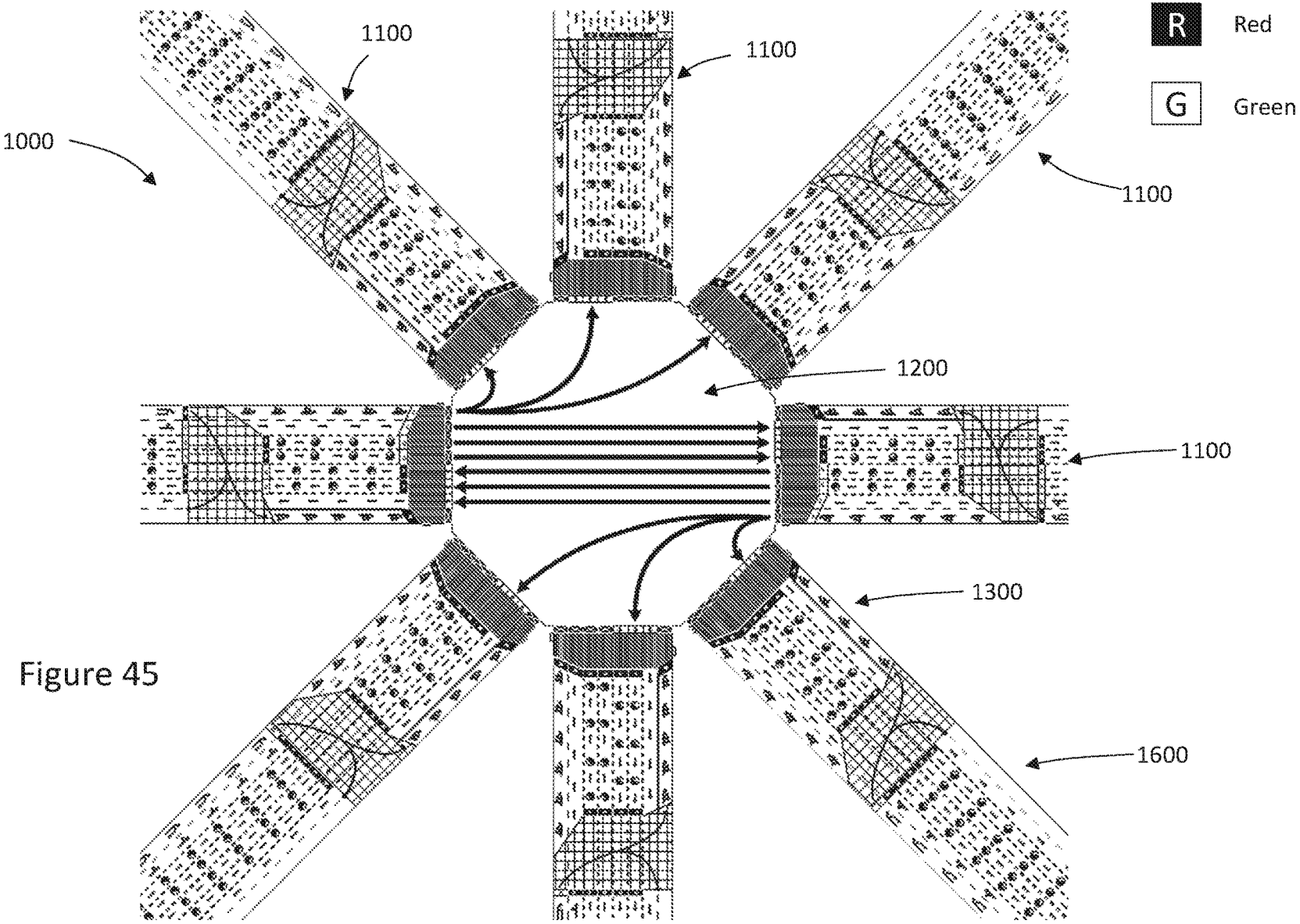
FIG. 45 shows a fifteenth embodiment of a traffic intersection of eight legs, showing four intersecting eight lane roads in a first phase.
Figure 46:
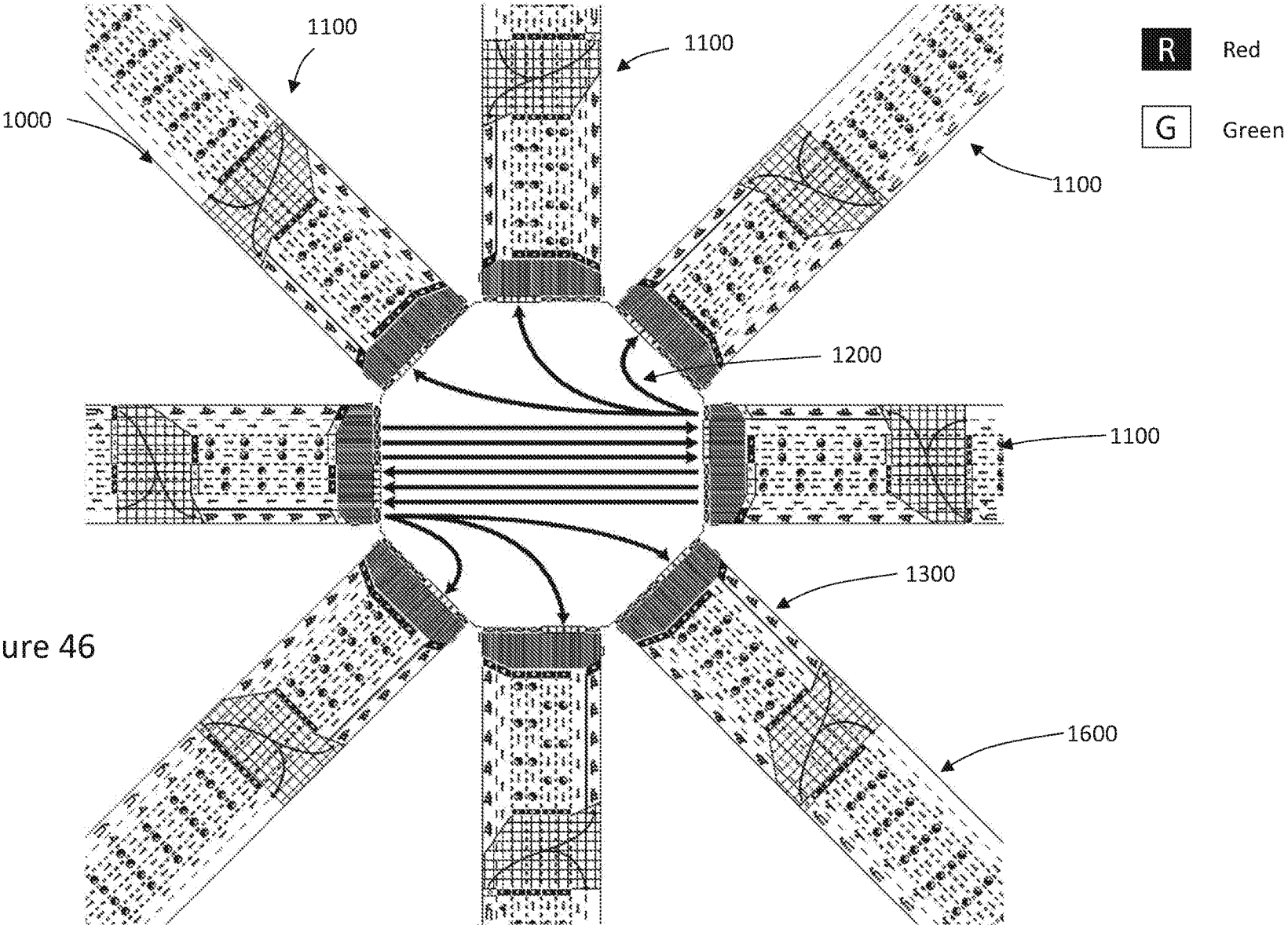
FIG. 46 shows the traffic intersection of FIG. 45 in a second phase.
Figure 47:
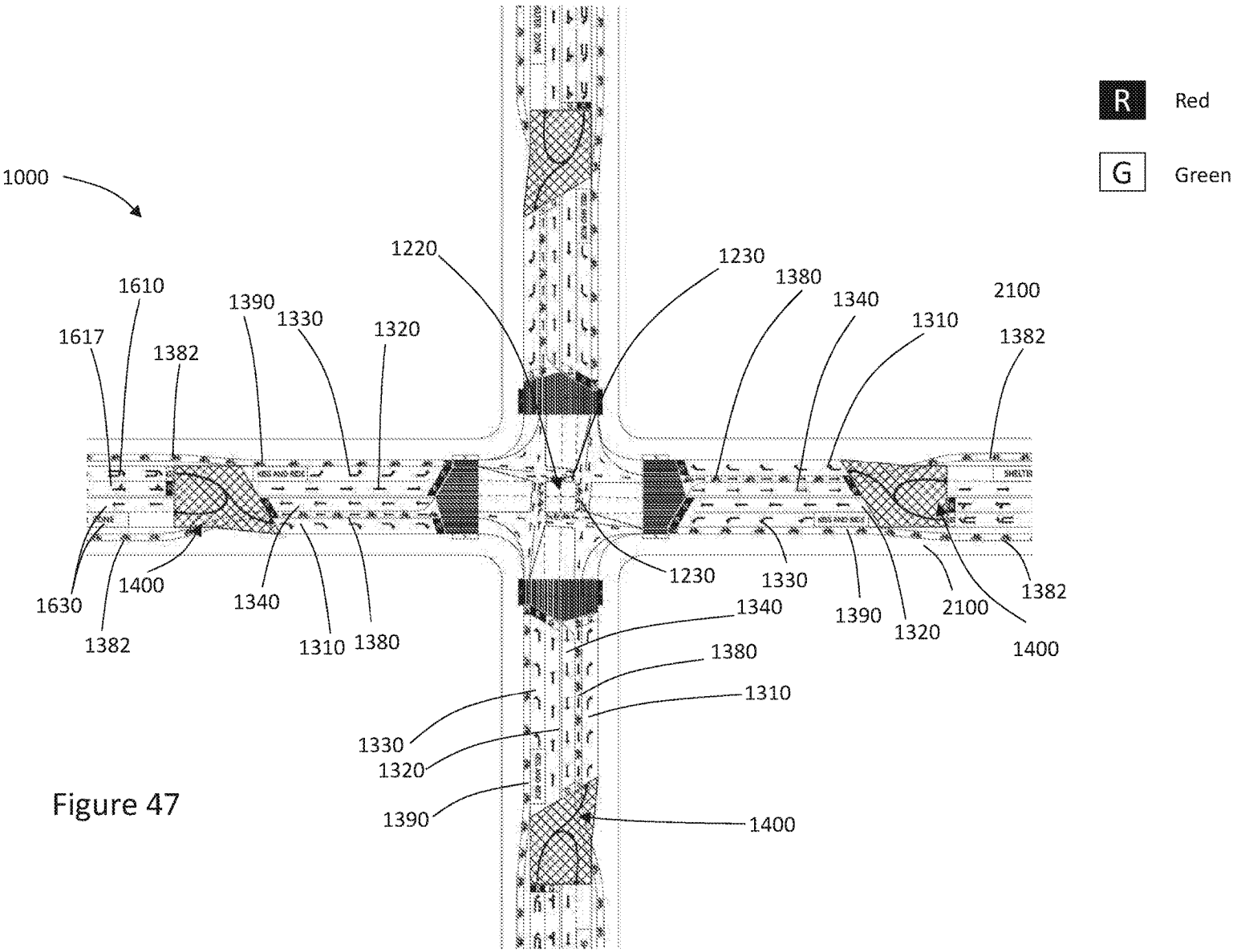
FIG. 47 shows a schematic view of a sixteenth embodiment of a traffic intersection, showing a four-lane road intersecting a four-lane road, including a pedestrian walkway bicycle lane.
Figure 48:
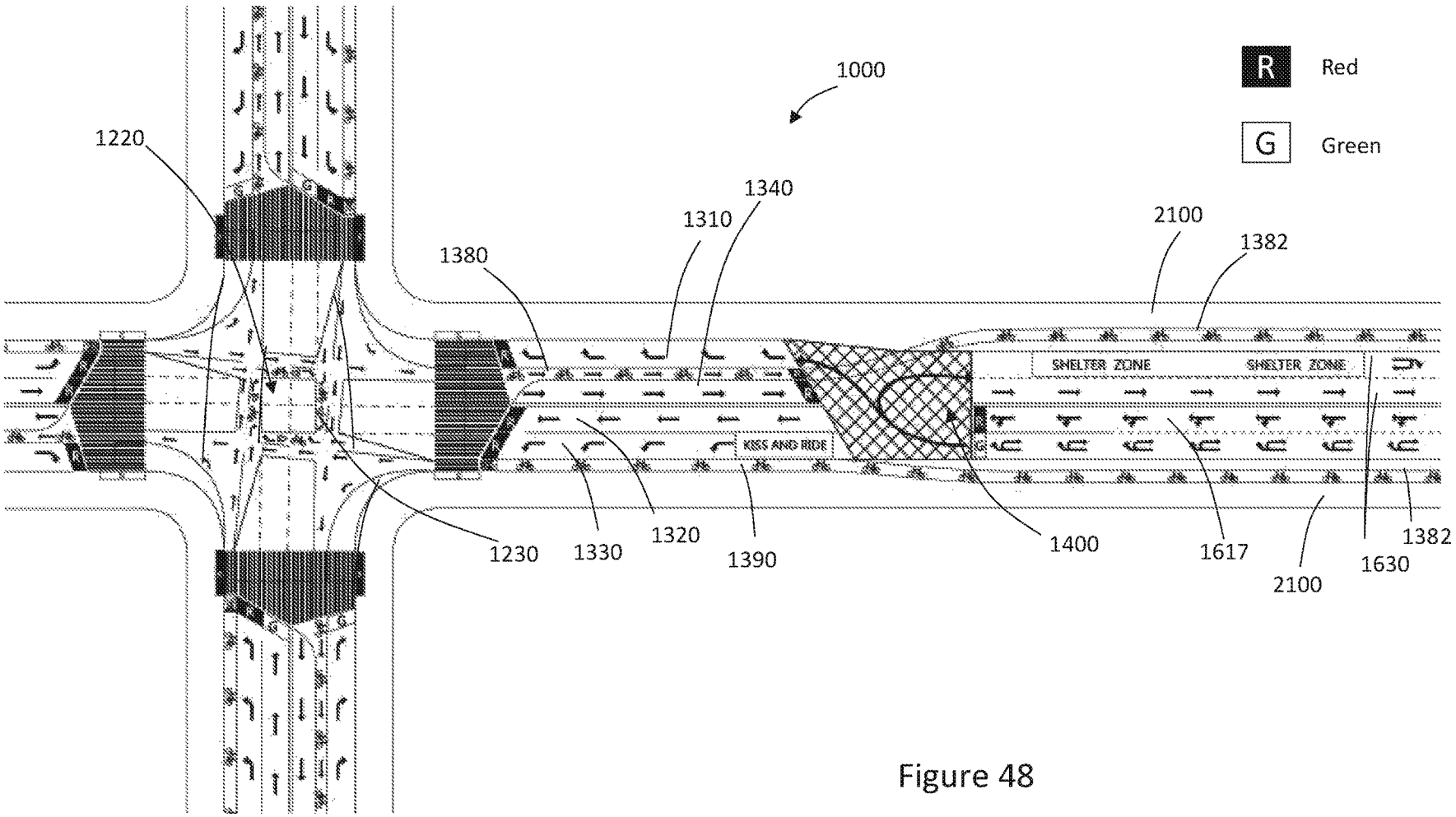
FIG. 48 shows a close-up view of FIG. 47.
Figure 49:
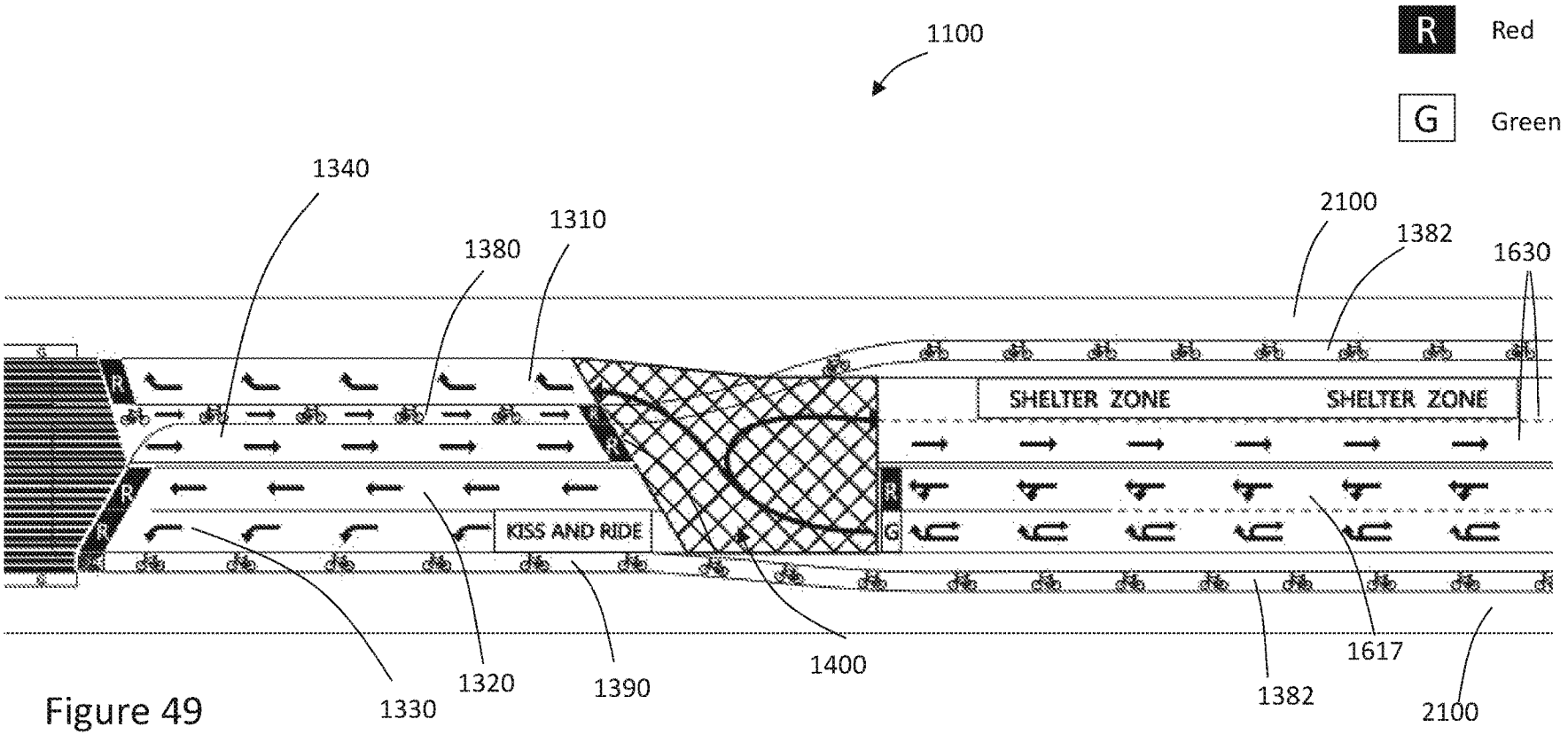
FIG. 49 shows a close-up view of the four-lane road of FIG. 47.
Figure 50:
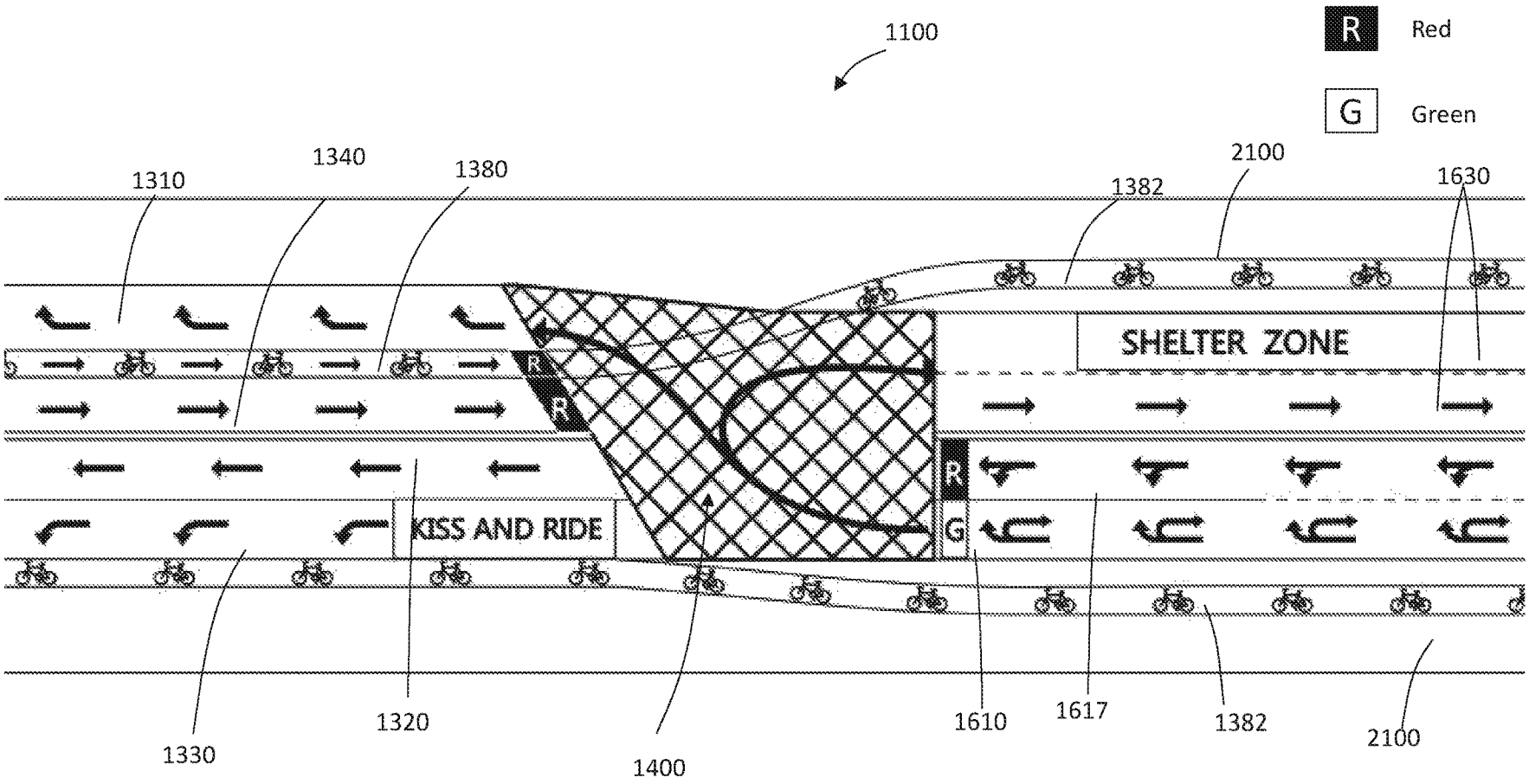
FIG. 50 shows a close-up view of the four-lane road of FIG. 47.
Figure 51:
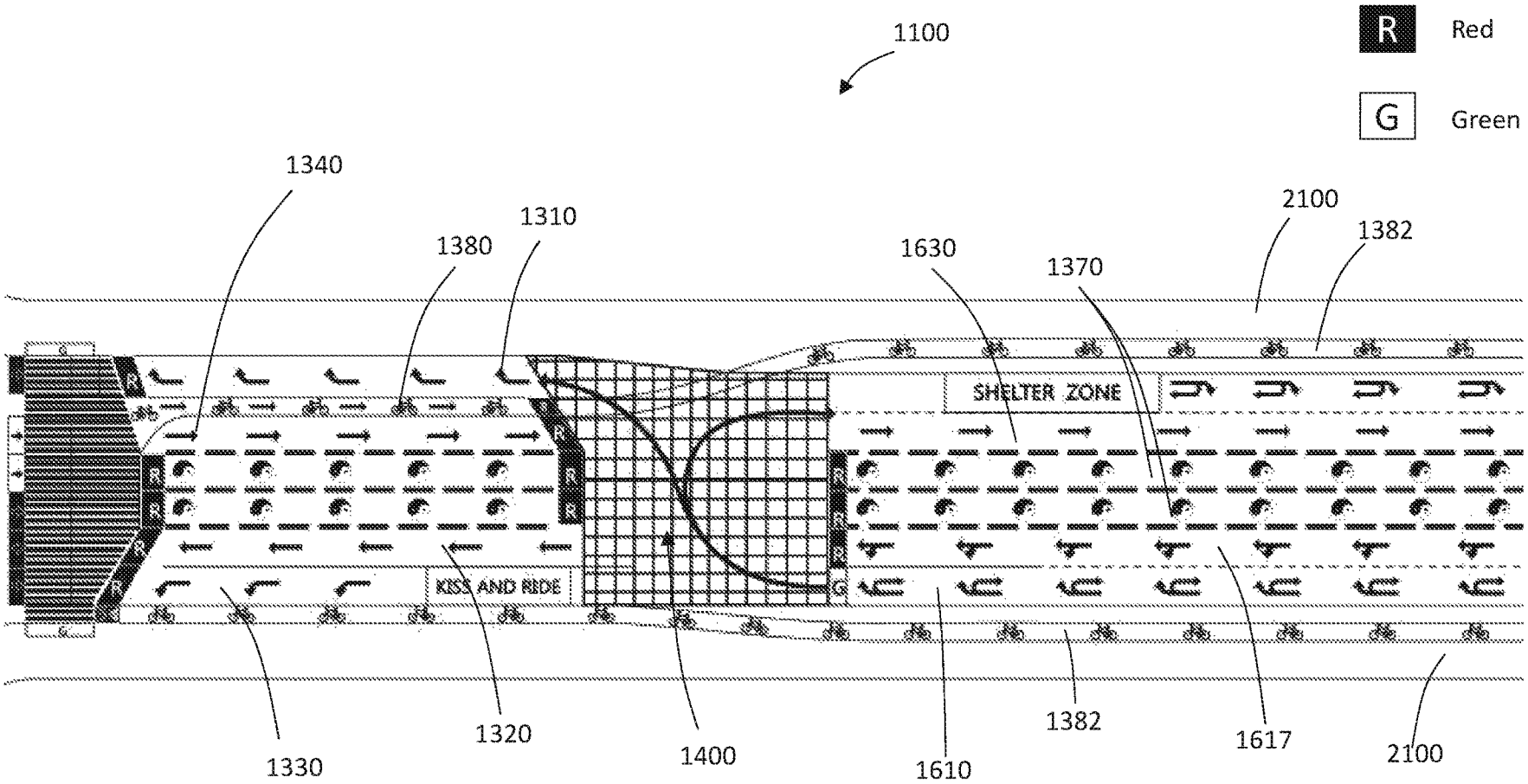
FIG. 51 shows a schematic view of a six lane road including a pedestrian walkway bicycle lane.

A set of four intersecting roads, each road being eight lanes wide, is shown in FIGS. 45 and 46. A separate phase is shown in each figure. It will be appreciated that by using a traffic intersection according to the invention, even a complex intersection such as this one can be controlled to move in only four phases.

Figure 16:
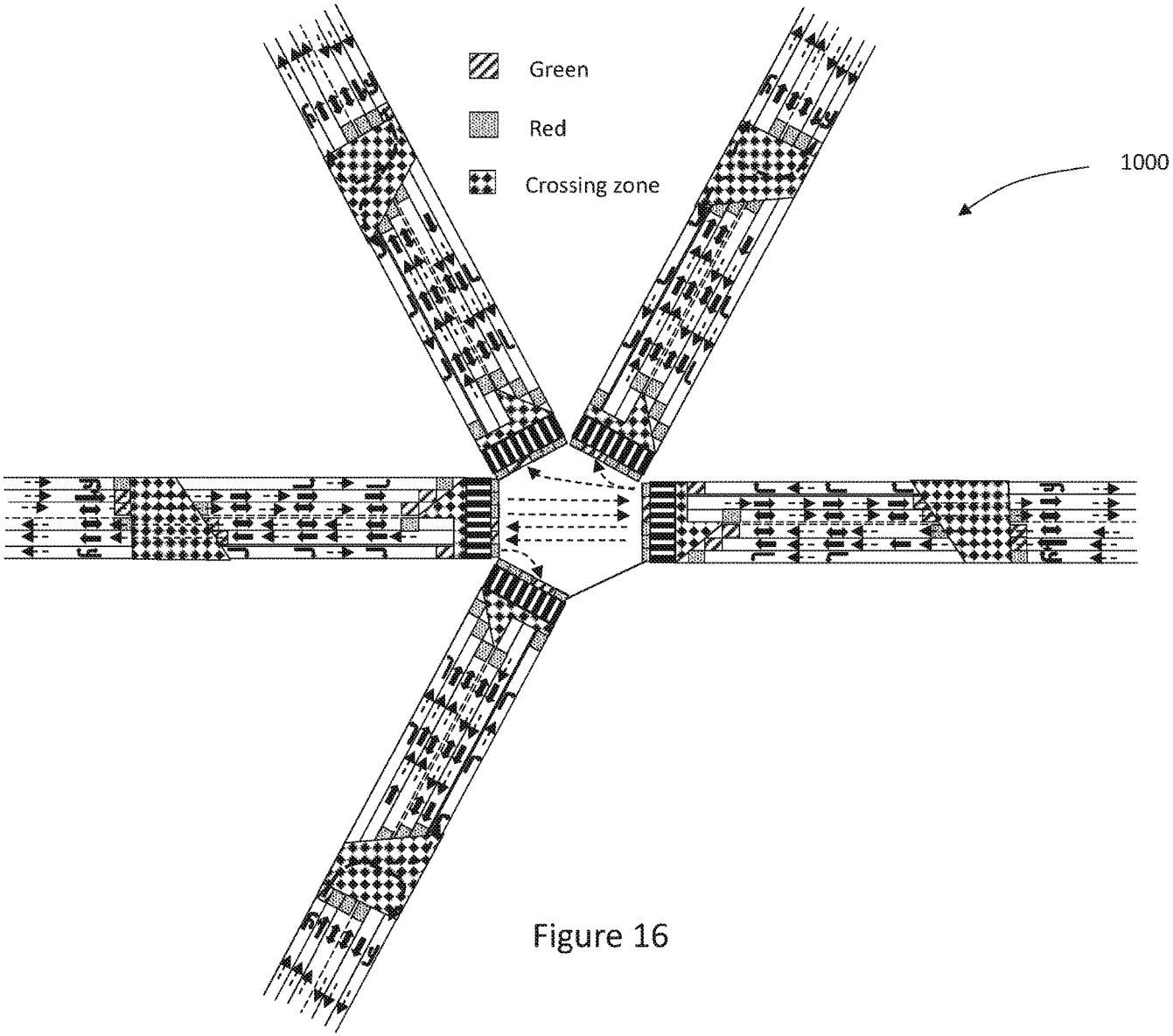
FIG. 16 shows a schematic view of a seventh embodiment of a traffic intersection, including two intersecting six lane roads, and an additional six lane road that terminates at the intersection, in a first phase and a first sub phase.
Figure 17:
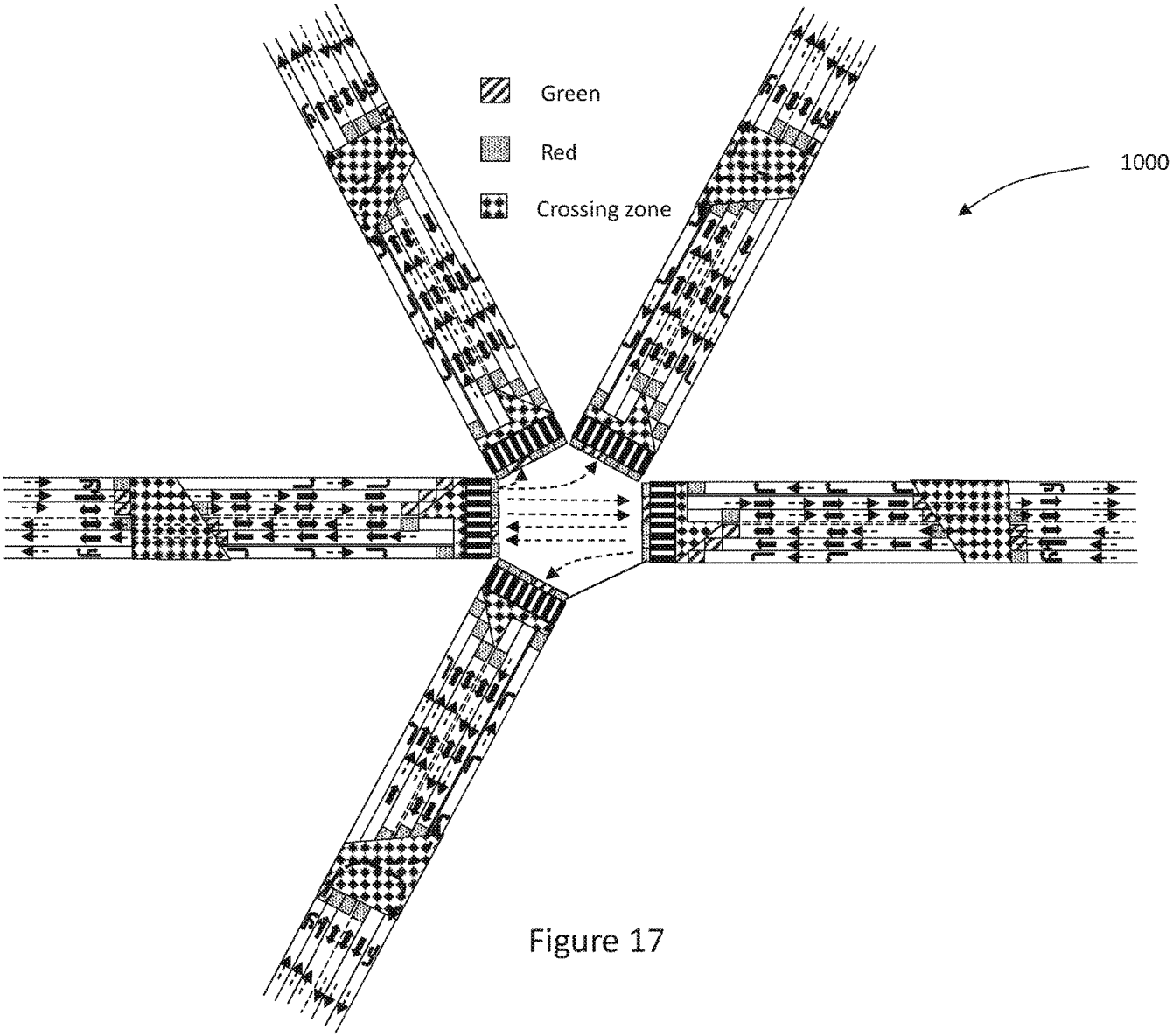
FIG. 17 shows the traffic intersection of FIG. 16 in a first phase and second sub phase.
Figure 18:
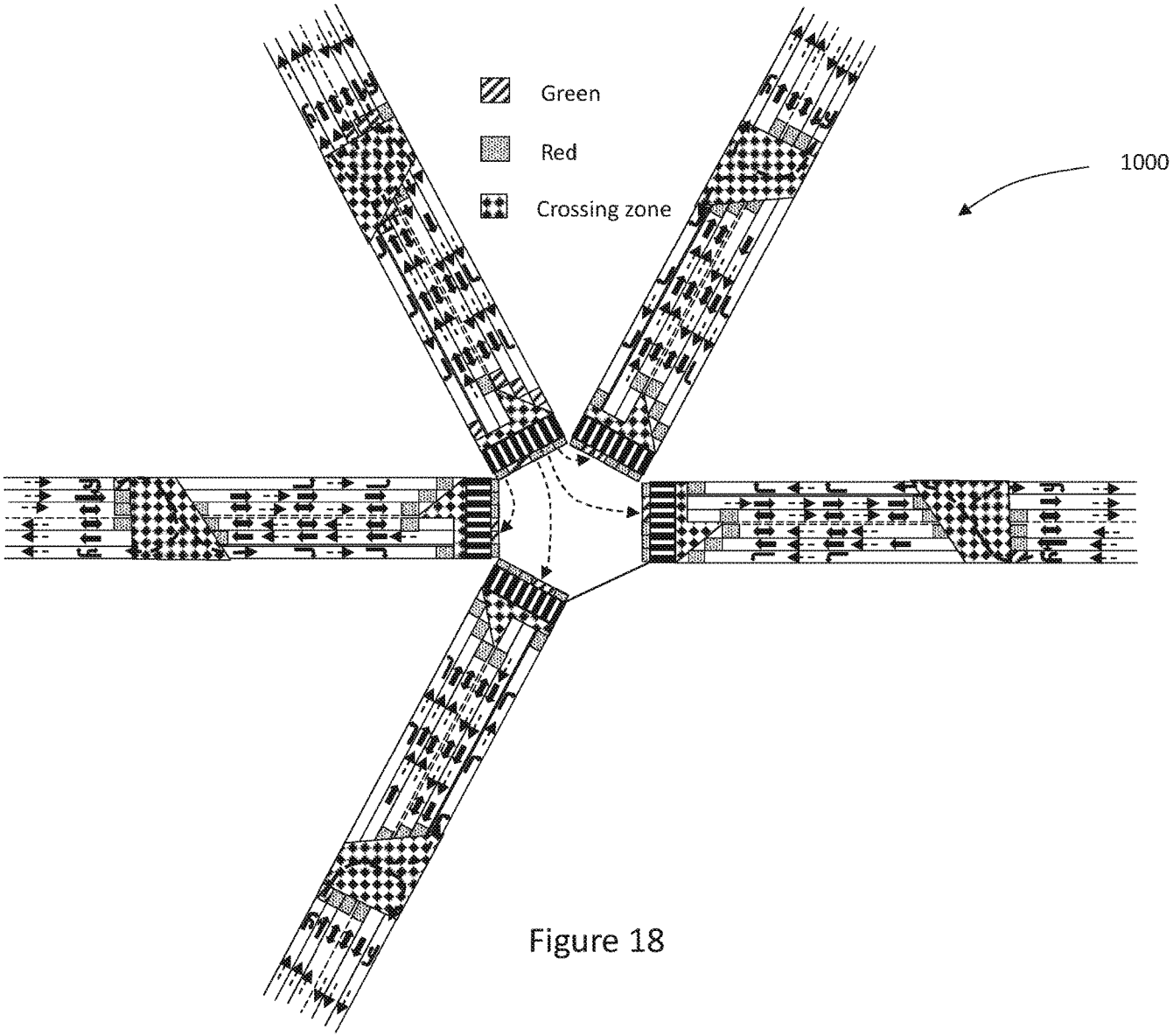
FIG. 18 shows the traffic intersection FIG. 16 in a second phase.

In a further embodiment shown in FIGS. 16-18, two intersecting roads 1100 and a further road 1100 that terminates at the intersection are shown, allowing traffic to flow in three phases. Each of the three phases are shown in the separate figures. As shown in FIG. 18, the road that terminates at the intersection is treated the same as a road that extends through the intersection, however roads that would be used for going straight across the intersection are instead directed to turn left or right. In this way, three phases can be used at a relatively complex intersection, where ordinarily in excess of eight phases would be used by prior art intersections. It is always envisaged that in addition to the phases during which vehicle traffic can flow, a separate optional phase can be provided during which vehicle flow over the intersection region 1200 is stopped, and pedestrians and/or bicycles are signalled to go.

Figure 19:
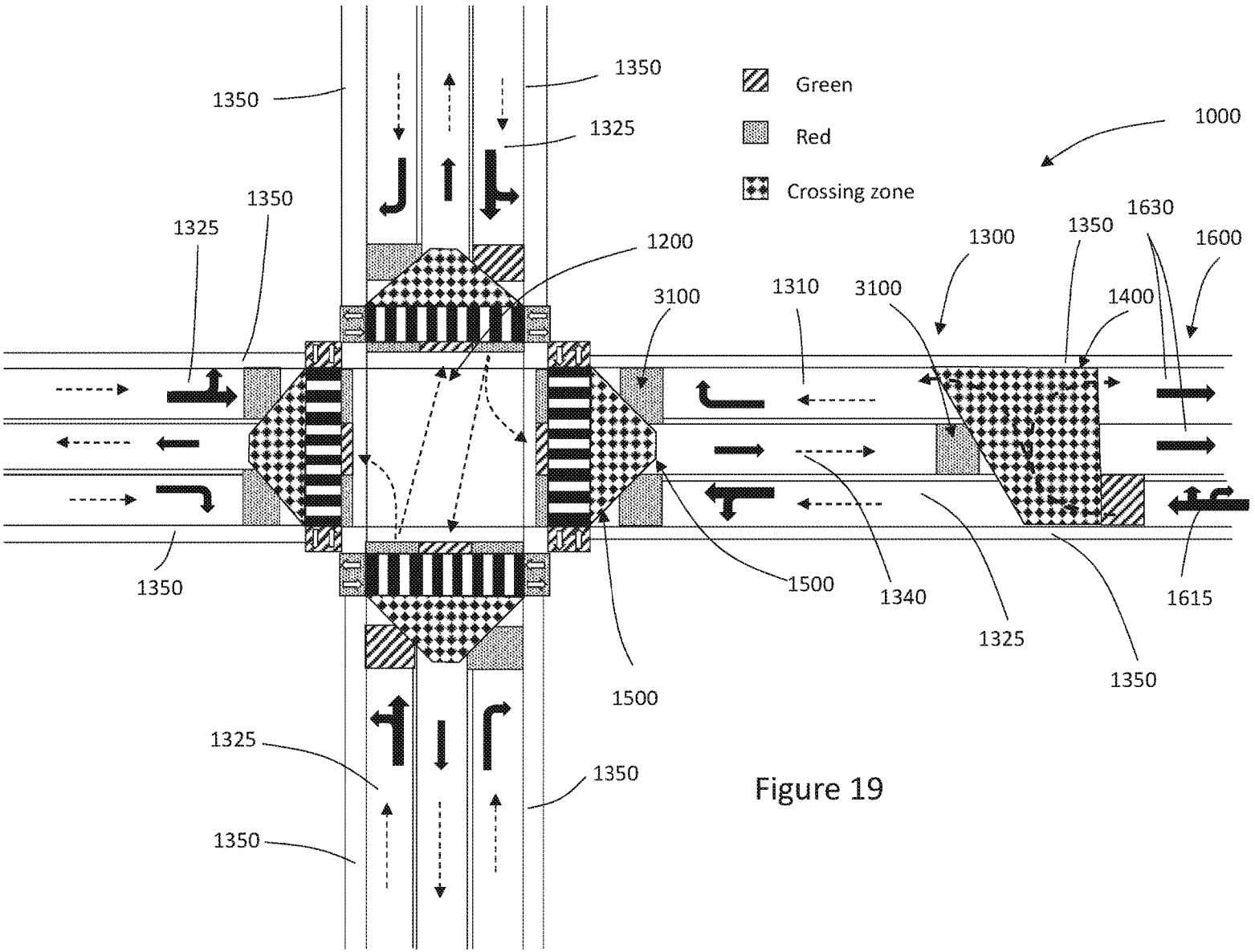
FIG. 19 shows an eighth embodiment of a traffic intersection, including two intersecting three lane roads, in a first phase.
Figure 20:
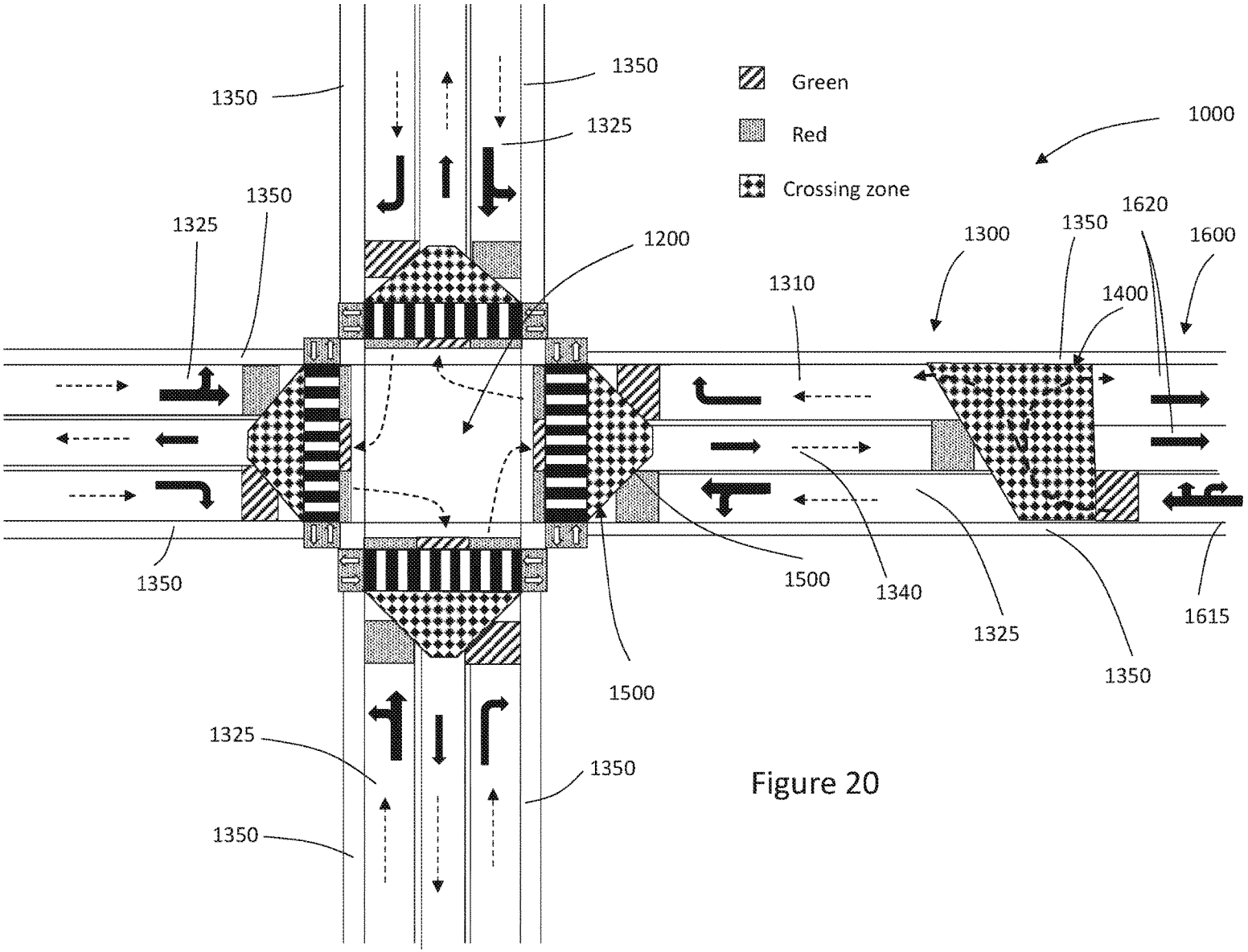
FIG. 20 shows the traffic intersection of FIG. 19 in a second phase.
Figure 21:
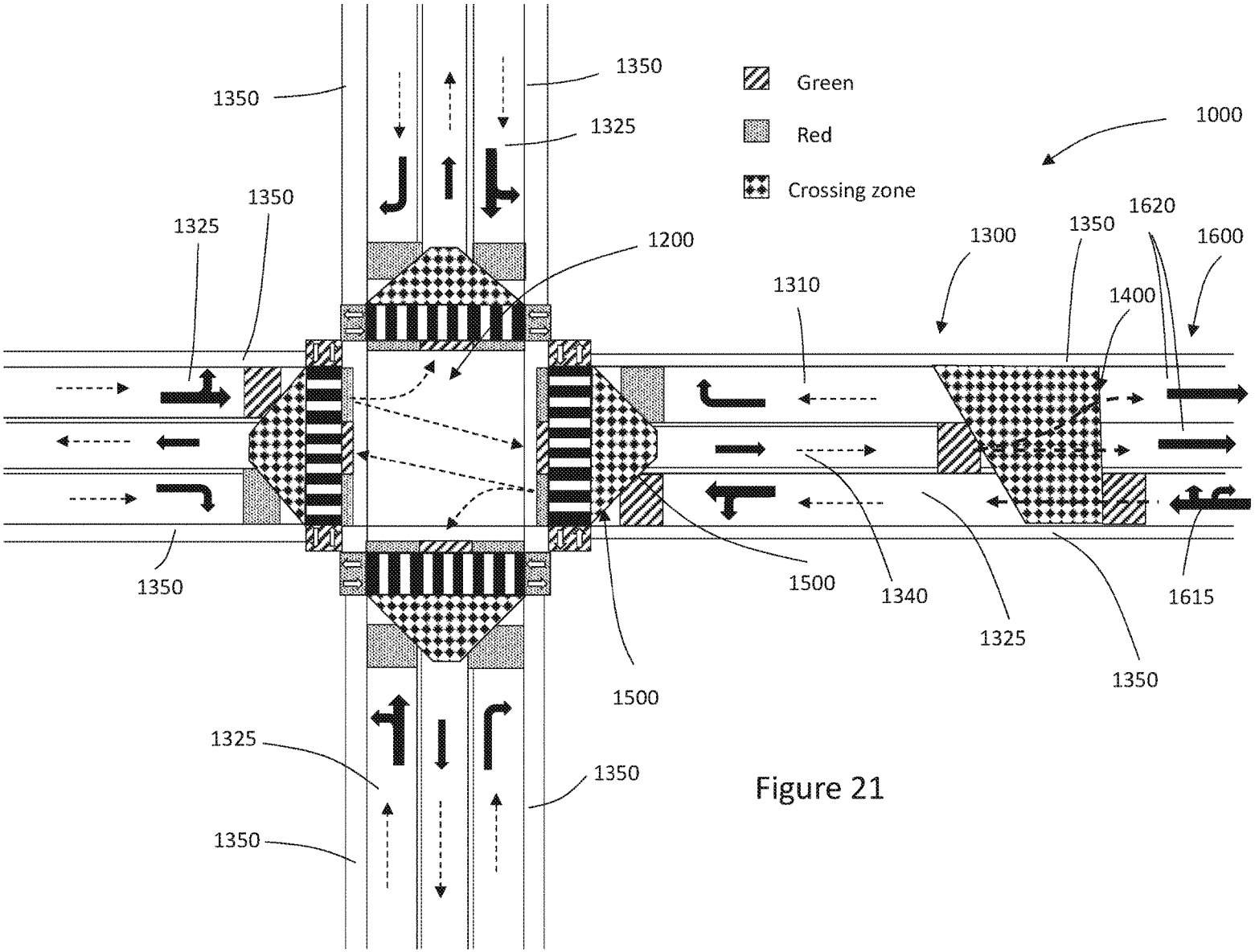
FIG. 21 shows the traffic intersection of FIG. 19 in a third phase.

In the embodiment shown in FIGS. 19-23, where in intersection of 3 lane roads is provided, it is envisaged that a different set of signalling phases can be used by the traffic guidance system 3000. Three separate phases are shown in FIGS. 19-21. In a first main phase shown in FIG. 19, vehicles moving straight across the intersection in a north-south direction and turning right from the road aligned in a north-south direction are signalled to move. In a second main phase shown in FIG. 20, vehicles in any of the turning right lanes at the intersection are signalled to move. In a third main phase shown in FIG. 21, vehicles moving straight across the intersection in an east-west direction and turning right from the road aligned in an east-west direction are signalled to move. In addition, a pedestrian only phase can be provided optionally as shown in FIG. 23, together with the other phases.

An alternative embodiment is shown in FIG. 24, showing two intersecting roads of three lanes each. In this embodiment, a combination going straight and turning left lane 1325 is provided from which vehicles can travel across the intersection on the same road or turn left onto an intersecting road. The centre lane of each of the three lane roads are receiving lanes 1340 that guide vehicles away from the intersection region 1200.

Distally of the distal crossover zone 1400 a right turn approaching lane 1610 is provided, as well as a combination going straight and turning left approaching lane 1617. The combination going straight and turning left approaching lane 1617 guides vehicles into the combination going straight and turning left lane 1325 as they cross the distal crossover zone 1400. The receiving lane 1340 guides vehicles moving away from the intersection region 1200 into a leaving lane 1630. The leaving lane 1630 then splits into a right turn approaching lane 1610 and a combination going straight and turning left approaching lane 1617 as it approaches the distal crossover zone of the next intersection 1000.

In this way it is anticipated that time delays spent waiting for various turning configurations to be presented to guide vehicles turning across the flow of traffic will be reduced, allowing for increased time intervals (which means a lower proportion of time spent with vehicle standing at a halt or accelerating from a stop) and flow of traffic along the roads will be less congested.

In the embodiments as shown in the figures, the turning right lanes 1310 and the turning left lanes 1330 preferably guide the vehicles to be received into receiving lanes 1340 that also function as receiving lanes for vehicles going straight across the intersection on the other of the intersecting roads 1100 when the visual signalling devices 3100 are in a different configuration.

Further, the turning left lane 1330 is also configured for guiding vehicles to turn from the turning left lane of one of the intersecting road into a receiving lane 1340 on the other of the intersecting roads.

Preferably, the turning left lane 1330 and the going straight lanes 1320 are configured to terminate adjacent the intersection region 1200 in a staggered fashion, leaving space for a substantially triangularly shaped proximal crossover zone 1500 that is disposed adjacent the intersection region 1200. The proximal crossover zone is configured for allowing vehicles turning from a turning right lane 1310 or a turning left lane 1330 in the intersecting road into the receiving lanes 1340 of the other intersecting road, a variety of paths to path around pedestrians that are crossing the road that the proximal crossover zone 1500 is in.

In one preferred embodiment, a separate phase would be provided for pedestrians to cross over, however this is not necessarily required. For example, pedestrians could be guided to cross over a road by the relevant pedestrian visual signalling devices during a phase where the vehicles are not guided directly across the intersection into that road, and preferably when vehicles are guided to turn left or right into that road. This is because the expected flow of traffic into the road that pedestrians crossing would be lower.

In the embodiment shown in FIGS. 19-24, where a three lane road intersects with another road, then typically a combination going straight and turning left lane 1325 is provided as the leftmost lane approaching the intersection region 1200.

Where, for example, a traffic accident or other emergency has happened at or close to the intersection region 1200, it is envisaged that the traffic intersection 1000 will still allow for vehicles to turn right or left, thereby preventing a complete halt in traffic. Where an emergency situation or similar has caused traffic flow to come to a halt completely in the intersection region 1200, or proximal region proximal to the distal crossover zone 1400, it is envisaged that the distal crossover zone 1400 will allow vehicles to carry out U-turns to allow traffic to turn around and move away from the intersection 1000. Such traffic flow could, for example be used by emergency services to allow emergency services vehicles to get closer to the congested traffic intersection, and also allow the traffic intersection to be cleared faster.

Control of the operation of the traffic intersection is 1000 shown in FIGS. 25-44 will now be described, specifically with reference to control of bicycles in bicycle lanes in addition to the control of vehicles as described above.

Figure 25:
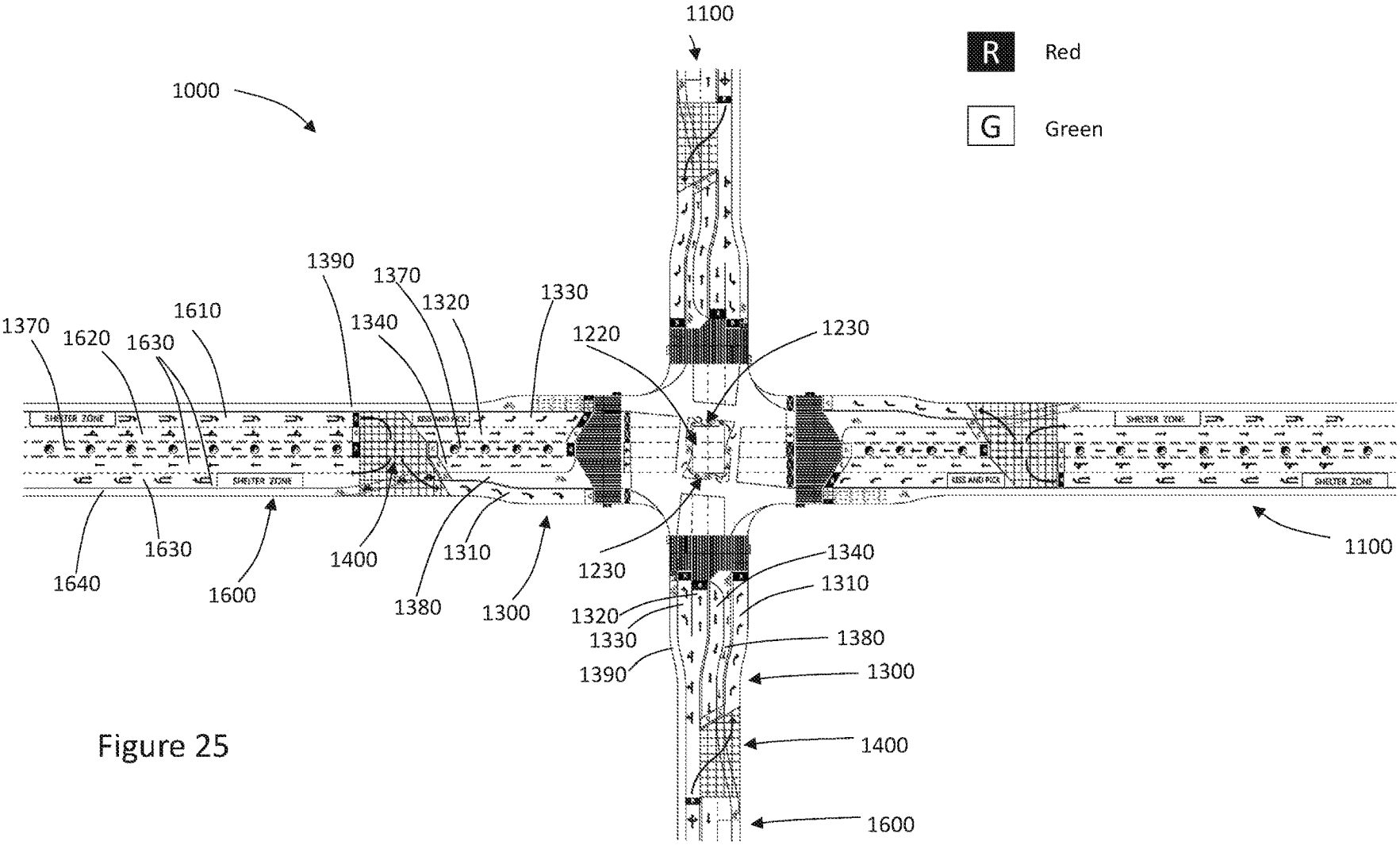
FIG. 25 shows a tenth embodiment of a traffic intersection, including a four lane road intersecting a six lane road in a first sub phase of a first phase.
Figure 26:
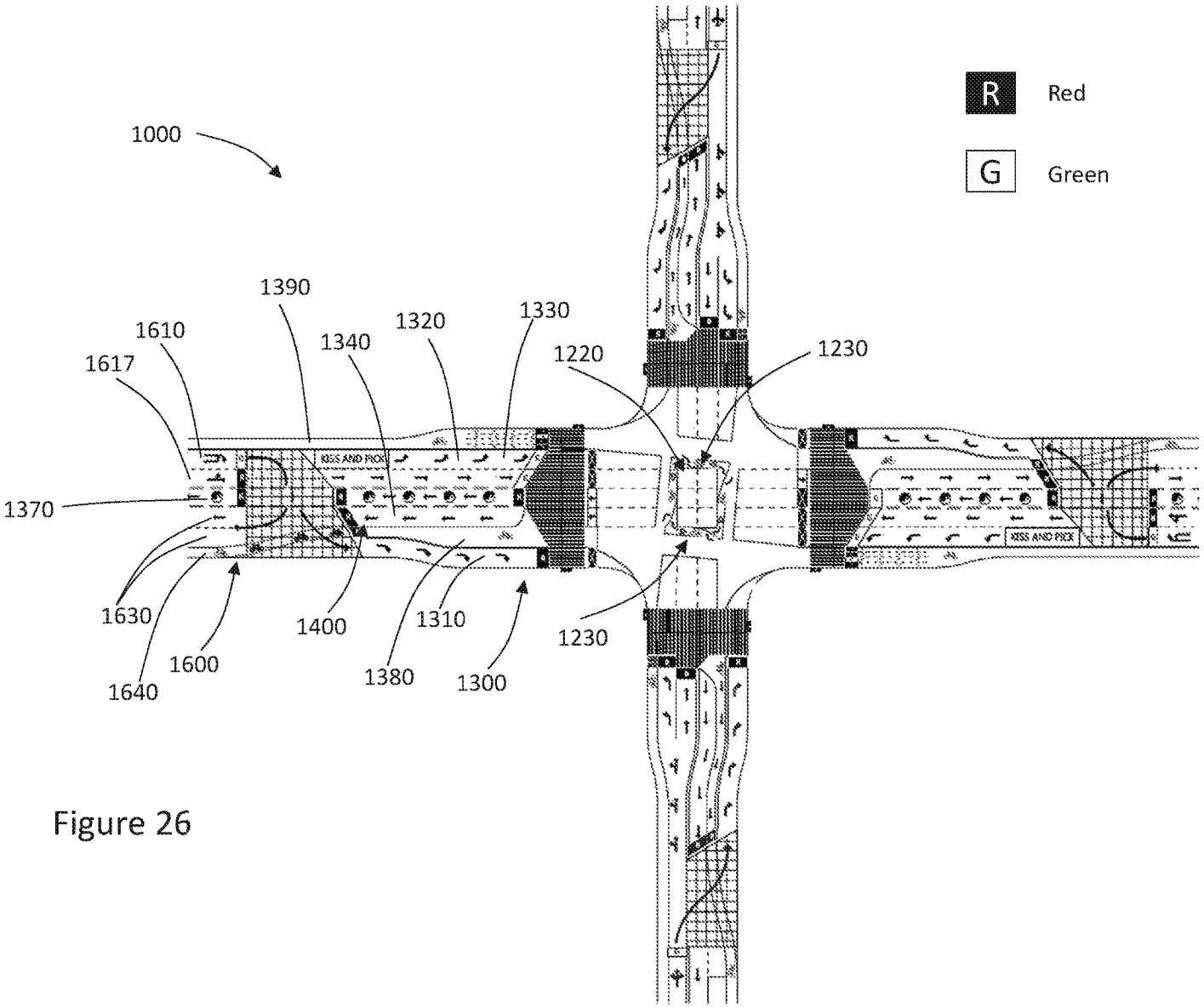
FIG. 26 shows the traffic intersection of FIG. 25, in a second sub phase of a first phase.
Figure 27:
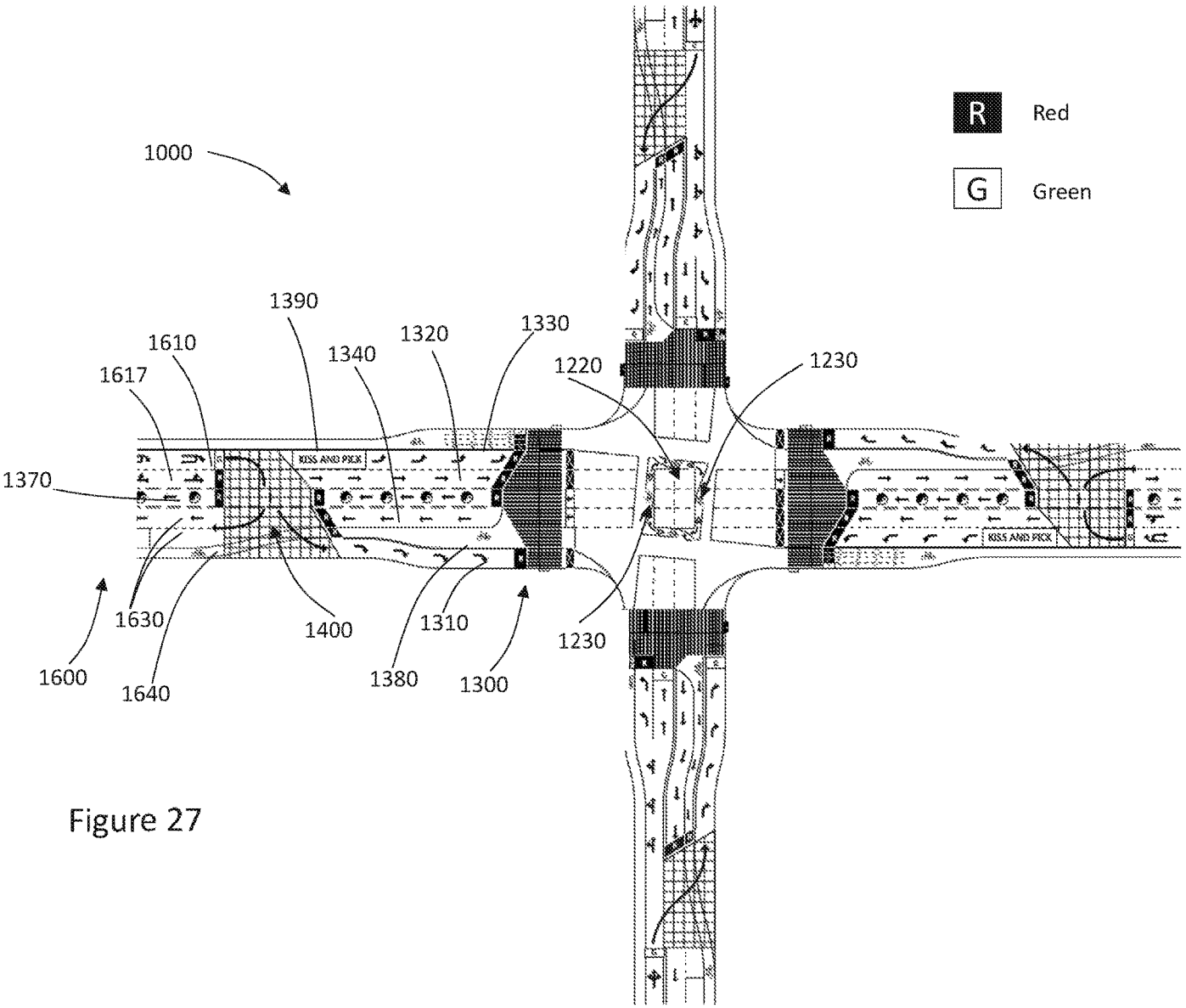
FIG. 27 shows the traffic intersection of FIG. 25, in a first sub-phase of a second phase.
Figure 28:
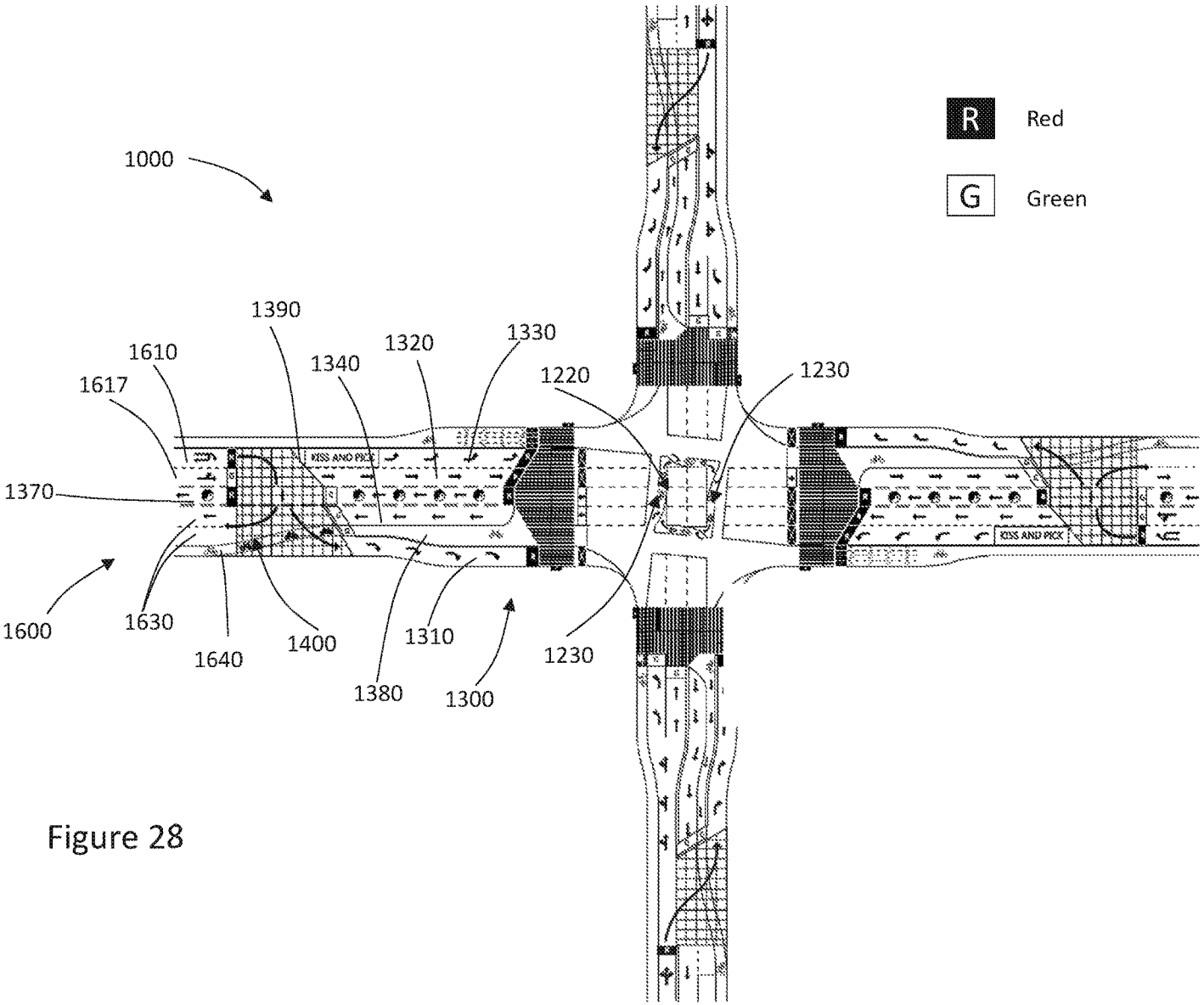
FIG. 28 shows the traffic intersection of FIG. 25, and a second sub phase of a second phase.
Figure 29:
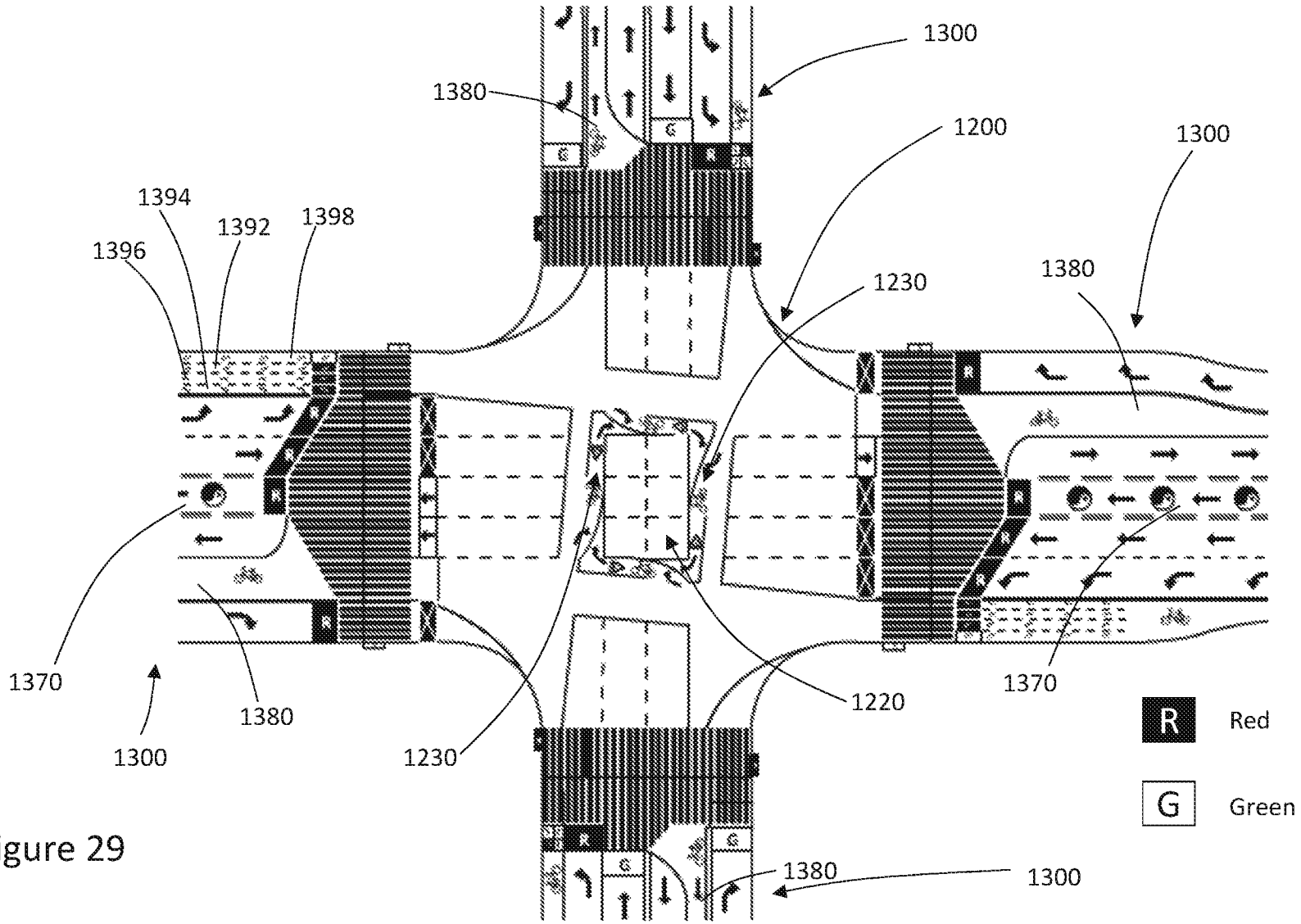
FIG. 29 shows a close-up view of FIG. 27.
Figure 30:
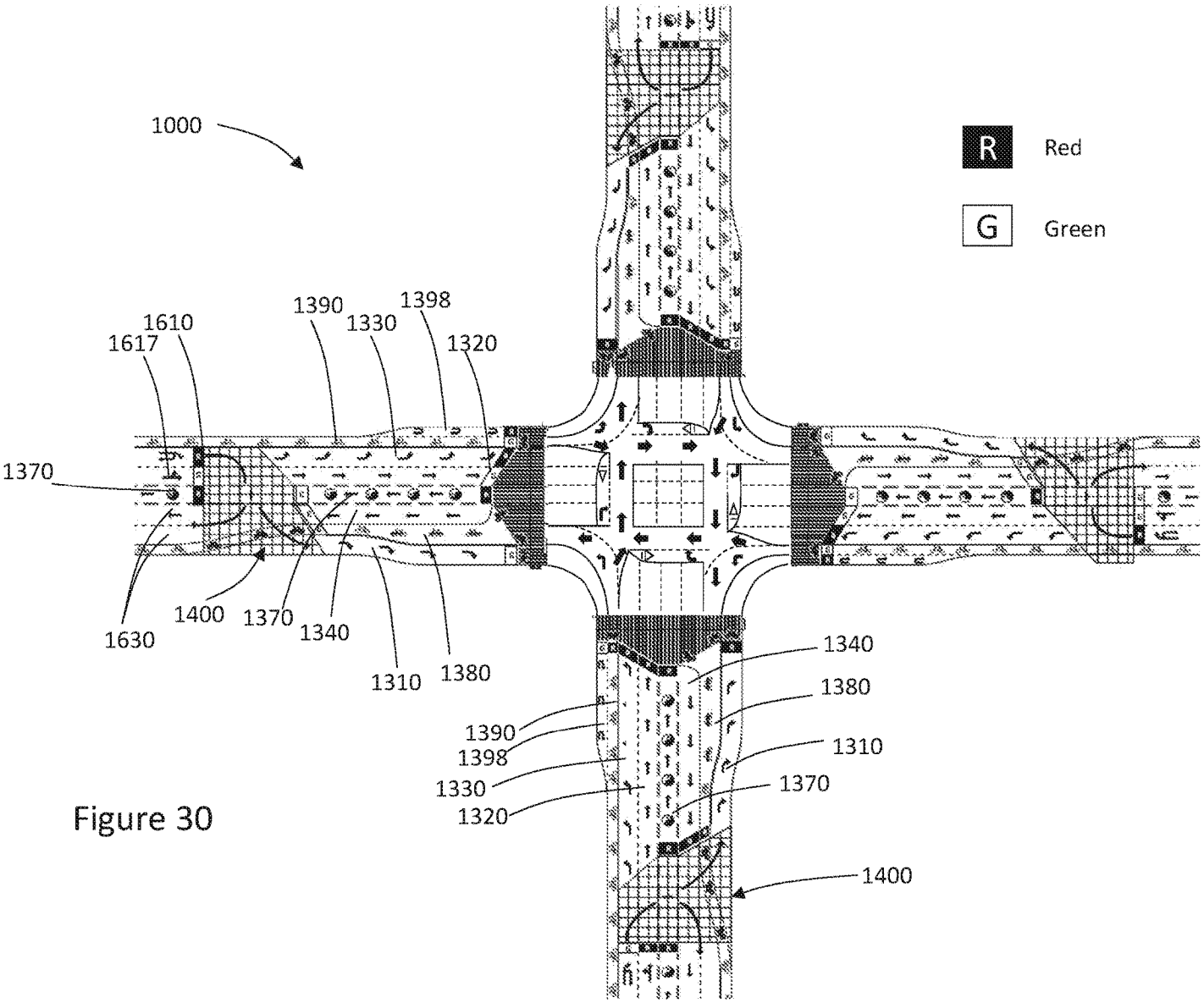
FIG. 30 shows an eleventh embodiment of a traffic intersection, showing a six lane road intersecting a six lane road in a first sub-phase of a first phase.
Figure 31:
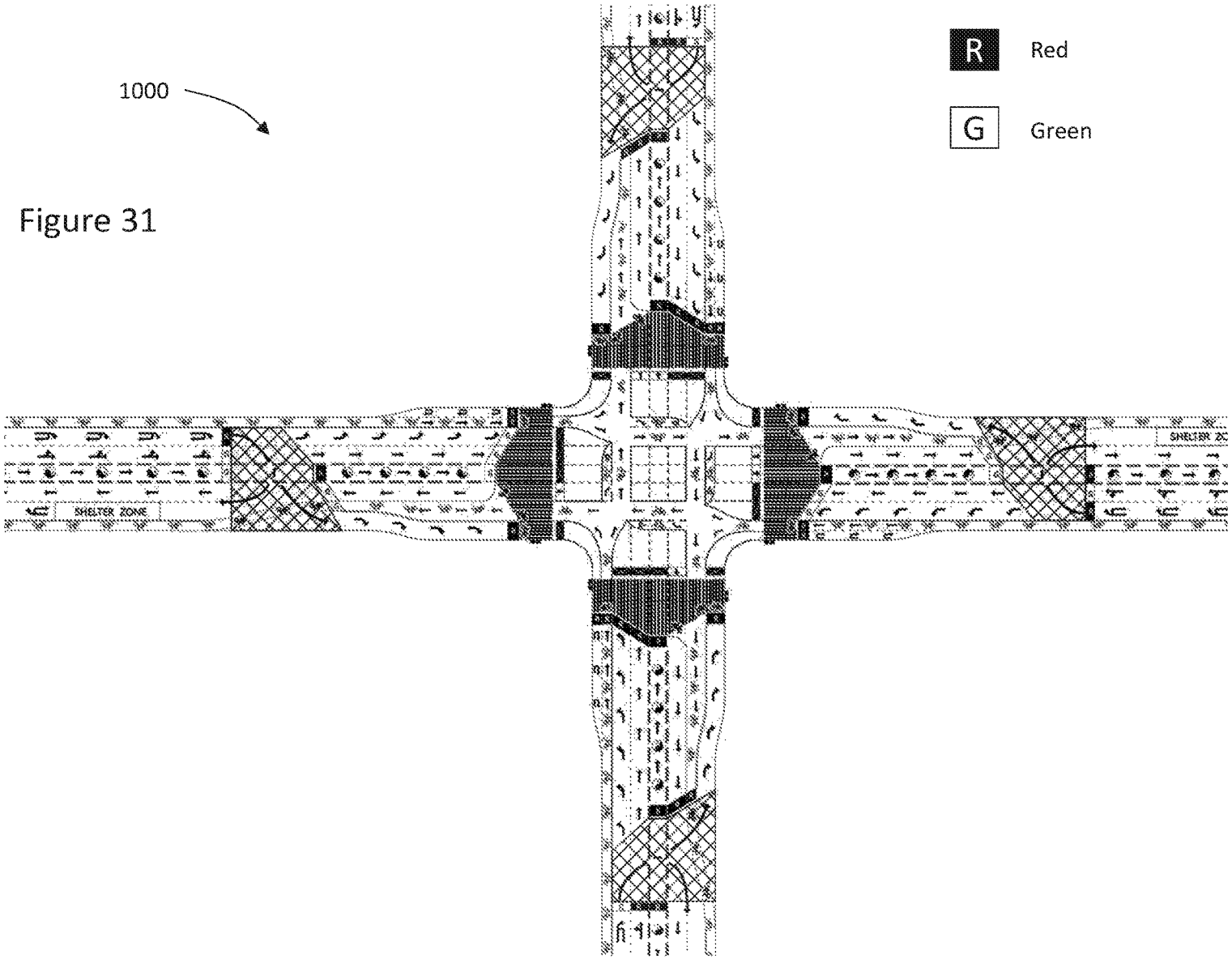
FIG. 31 shows the traffic intersection of FIG. 30, showing a second sub phase of a first phase, but with the reconfigurable lane moving in opposed direction.

A four lane by six lane intersection is shown in FIGS. 25-28 including bicycle lanes as described above, the number of lanes being calculated by counting the number of vehicle lanes distally of the distal crossover zone, and adding half a lane for each bicycle lane. Each of FIGS. 25-28 represents a separate sub phase, with FIGS. 25 and 26 being part of the first main phase and FIGS. 27 and 28 showing the second main phase. In the embodiment shown in FIGS. 25-28, a central island 1220 is provided in the intersection region 1200, with four bicycle waiting zones 1230 being provided around the periphery of the island. FIG. 29 shows a close-up view of FIG. 27.

During the first sub phase of the first main phase shown in FIG. 25, vehicles travelling in the going straight lanes 1320 and reconfigurable lanes 1370 moving directly over the intersection in an east-west direction are signalled to proceed, while vehicles in the going straight lanes 1320 and reconfigurable lanes 1370 moving travelling directly over the intersection in a north-south direction are signalled to stop. Simultaneously, vehicles in the turning right lanes 1310 that are turning right from the east-west aligned road will be signalled to proceed, while vehicles in the turning left lane 1330 that are turning left from the east-west aligned road will be signalled to stop. Bicycles in the turning left bicycle lane 1392, turning right bicycle lane 1394 and moving straight bicycle lane 1396 of the east-west aligned roads will be signalled to proceed, the bicycles in the turning right bicycle lane proceeding to the associated bicycle waiting zone 1230. Bicycles in the U-turn bicycle lane 1398 of the east-west aligned roads will be signalled to stop.

Simultaneously, vehicles in the right turn approaching lane 1610 of the east-west aligned road will be signalled to stop at the distal crossover zone and vehicles in the receiving lanes 1340 will be signalled to proceed across the distal crossover zone 1400. Bicycles in the bicycle receiving lane 1380 are signalled to proceed over the distal crossover zone 1400.

Vehicles that are received into the receiving lanes 1340 of the north-south aligned road 1100 are signalled to proceed over the distal crossover zone, while vehicles in the right turn approaching lane 1610 of the north-south aligned road are signalled to stop before the distal crossover zone.

Bicycles in the bicycle receiving lane 1380 of the north-west aligned road will be signalled to proceed over the distal crossover zone.

Bicycles in the turning left bicycle lane 1392, turning right bicycle lane 1394 and moving straight bicycle lane 1396 of the north-south aligned roads will be signalled to stop, while bicycles in the U-turn bicycle lane of that road will be signalled to proceed.

The second sub phase of the first main phase is shown in FIG. 26, where vehicles in the going straight lanes 1320 and reconfigurable lanes 1370 moving traversing directly over the intersection in an east-west direction are still signalled to proceed, while vehicles in the going straight lanes 1320 and reconfigurable lanes 1370 in a north-south direction are still signalled to stop. However, the bicycles in the turning moving straight bicycle lane 1396 and turning right bicycle lane 1394 are signalled to stop, while vehicles in the turning left lane 1330 that are turning from the east-west aligned road will be signalled to proceed, together with bicycles in the turning left bicycle lane 1392. Vehicles in the turning right lane 1310 that are turning right from the east-west aligned road will be signalled to stop, in order to avoid collisions with the vehicles turning left.

Further, vehicles in the receiving lanes 1340 and bicycles in the bicycle receiving lane 1380 of the north-south aligned road 1100 are signalled to stop before the distal crossover zone, while vehicles in the right turn approaching lane 1610 of the north-south aligned road are signalled to proceed over the distal crossover zone in preparation for the second main phase.

The first sub phase of the second main phase is shown in FIG. 27, where vehicles in the going straight lanes 1320 and reconfigurable lanes 1370 for moving directly over the intersection in an east-west direction are signalled to stop, while vehicles in the going straight lanes 1320 and reconfigurable lanes 1370 for moving directly over the intersection in a north-south direction are signalled to proceed. The configurations of the vehicle and bicycle signalling devices will merely be the reverse of the first and second sub phase of the first main phase described above, with the signalling for each of the north south road and east-west road being reversed. In this respect, the first sub phase of the second main phase will be same as the second sub phase of the first main phase, with the road directions reversed (i.e. changing east-west for north-south), while the second sub phase of the second phase will be the same as the first sub phase of the first main phase, but with the road directions reversed.

The second sub phase of the second main phase is shown in FIG. 27. This corresponds to the second sub phase of the first main phase as shown in FIG. 25, but with the signalling of the north-east aligned roads and east-west aligned roads reversed.

Figure 32:
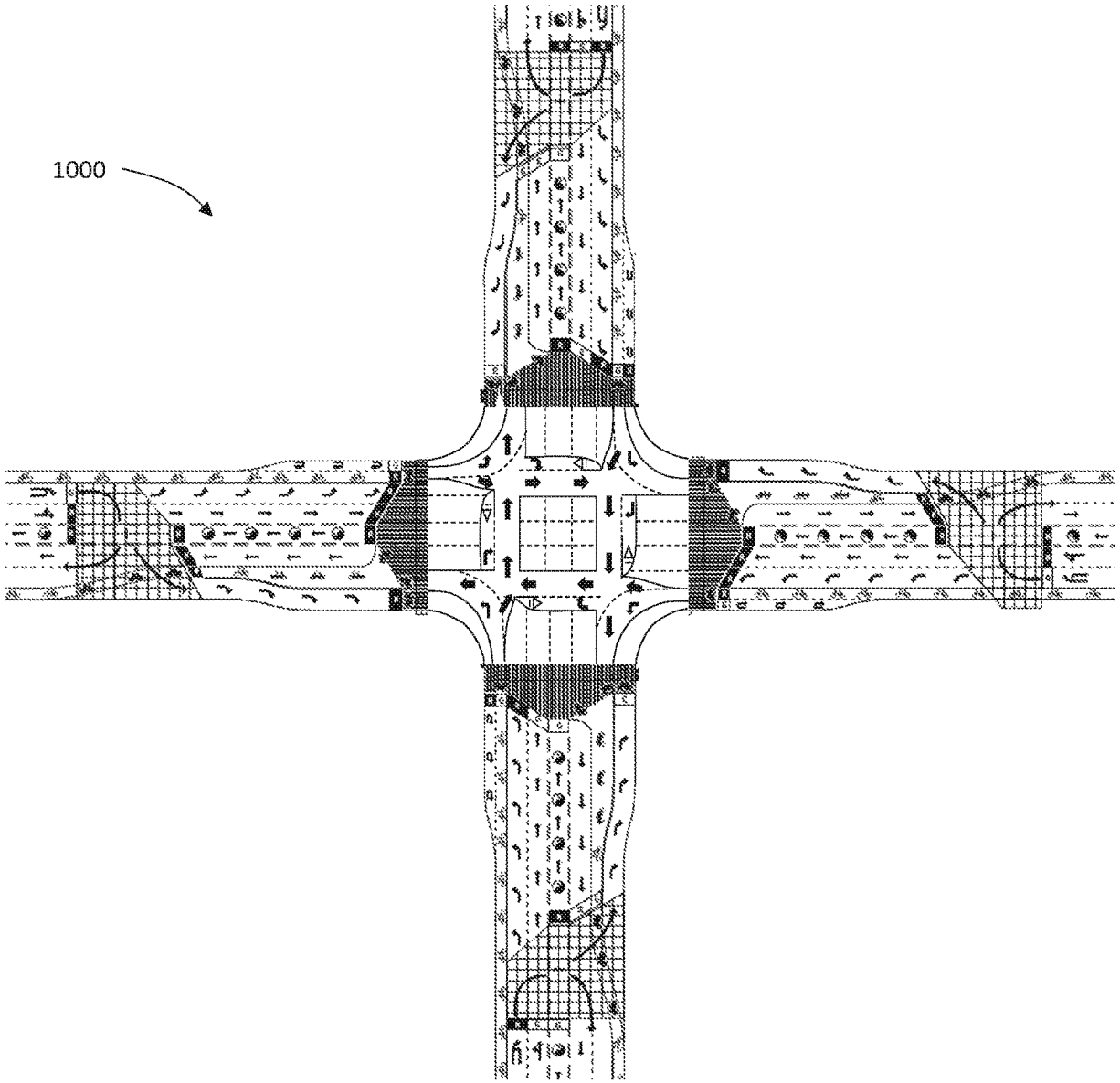
FIG. 32 shows the traffic intersection of FIG. 30, showing a first sub-phase of a second phase.
Figure 33:
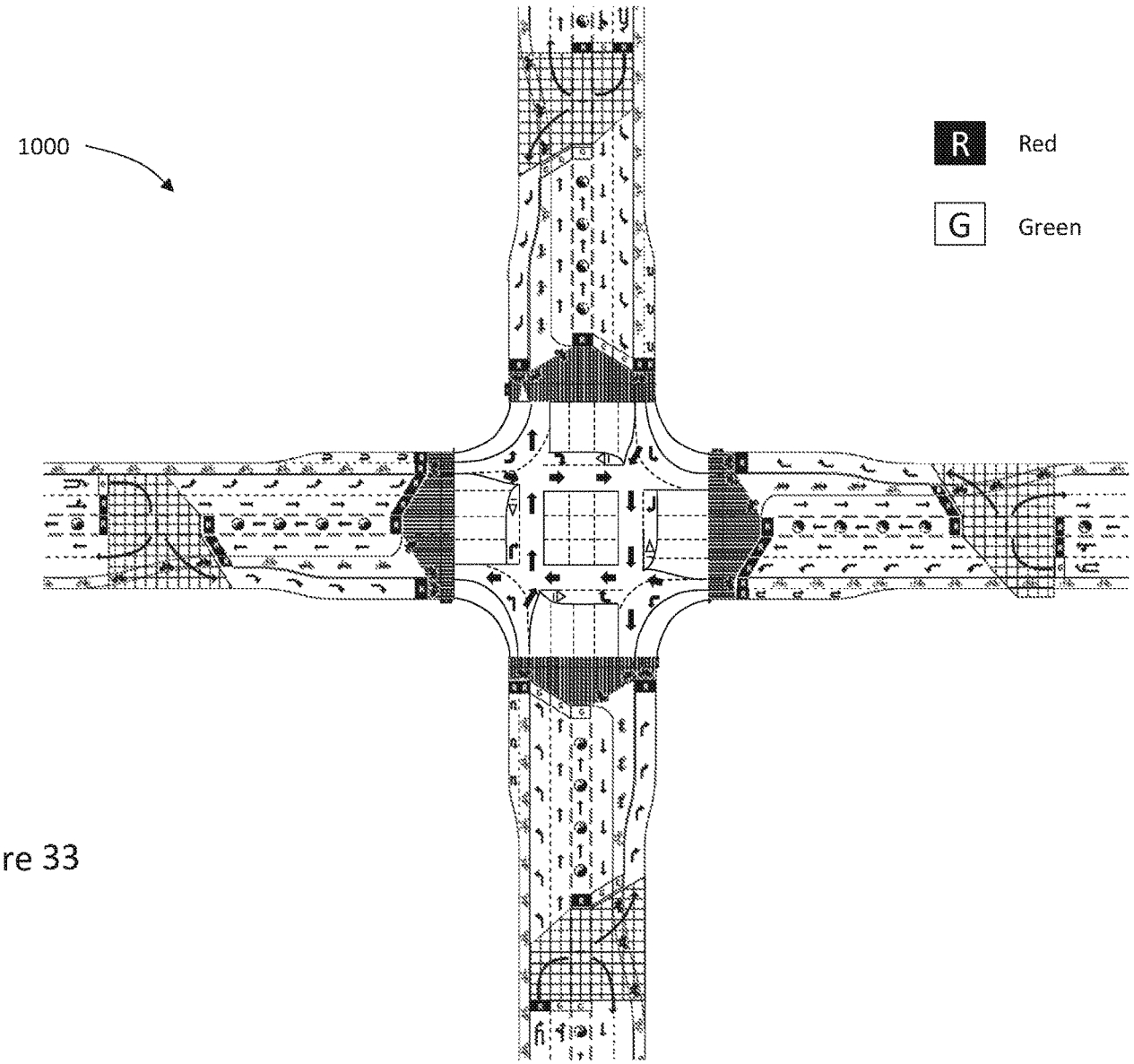
FIG. 33 shows the traffic intersection of FIG. 30, showing a second sub-phase of a second phase.
Figure 34:
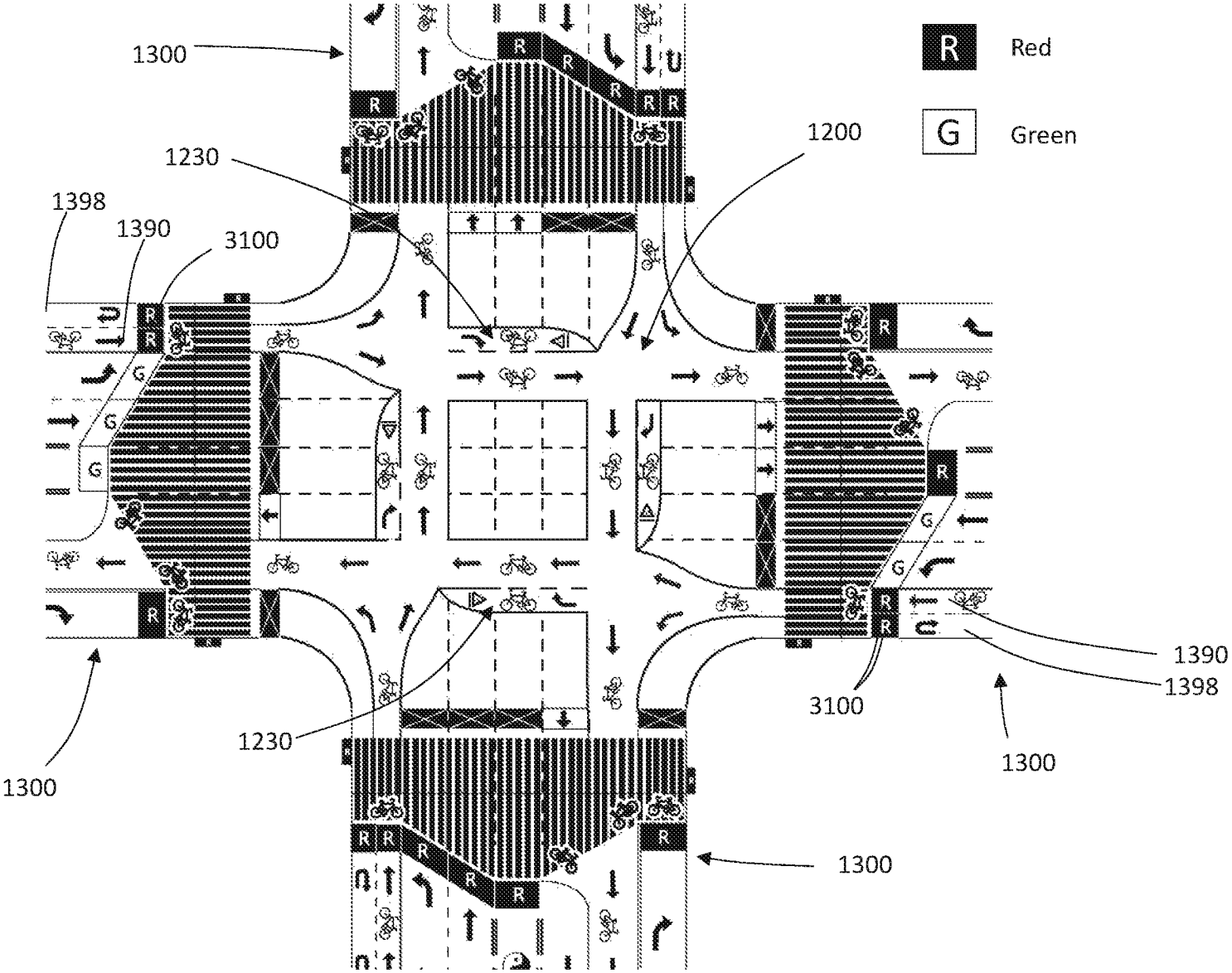
FIG. 34 shows a close up view of FIG. 31.
Figure 35:
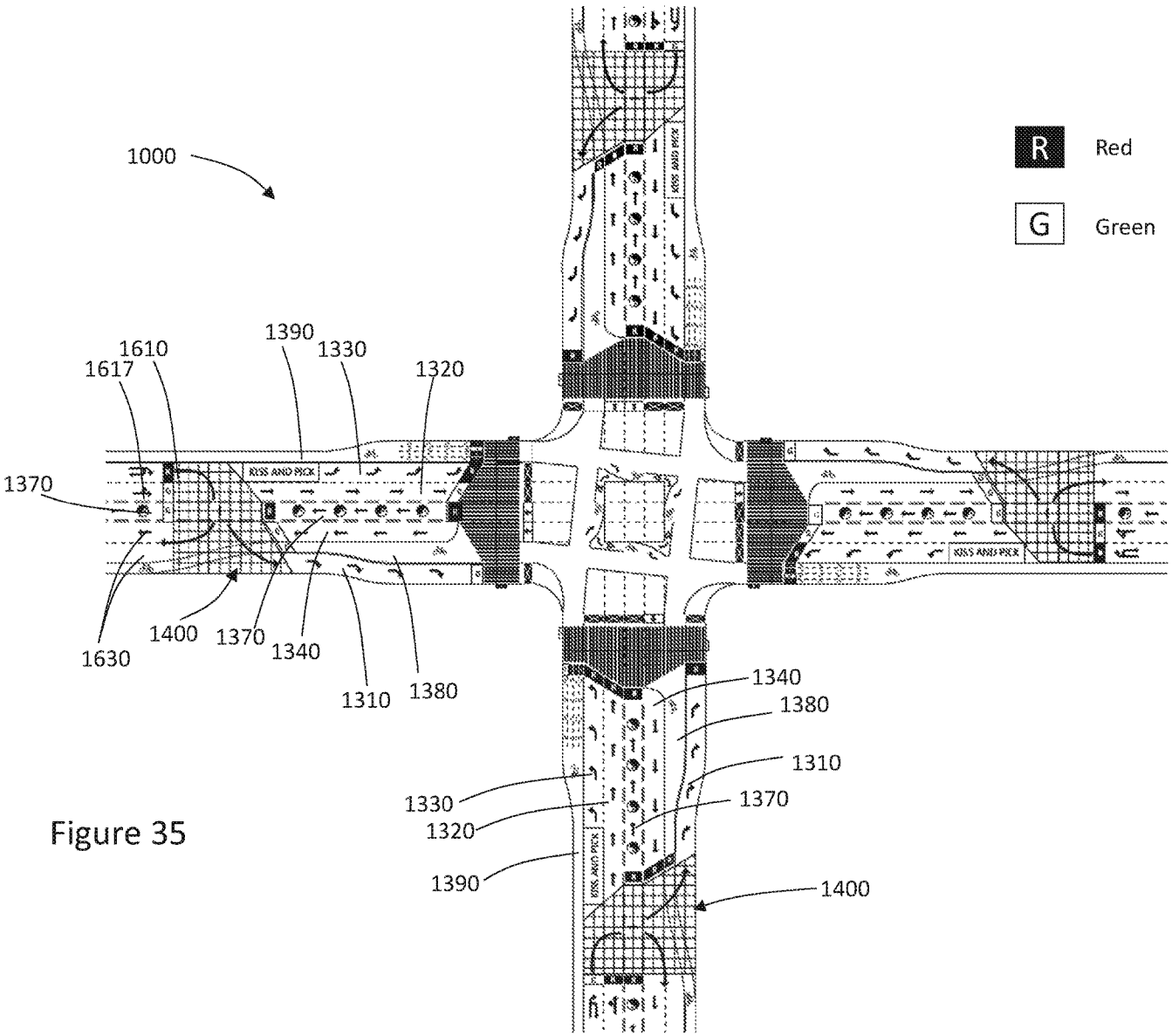
FIG. 35 shows a twelfth embodiment of a traffic intersection, showing a six lane road intersecting a six lane road in a first sub-phase of a first phase.
Figure 36:
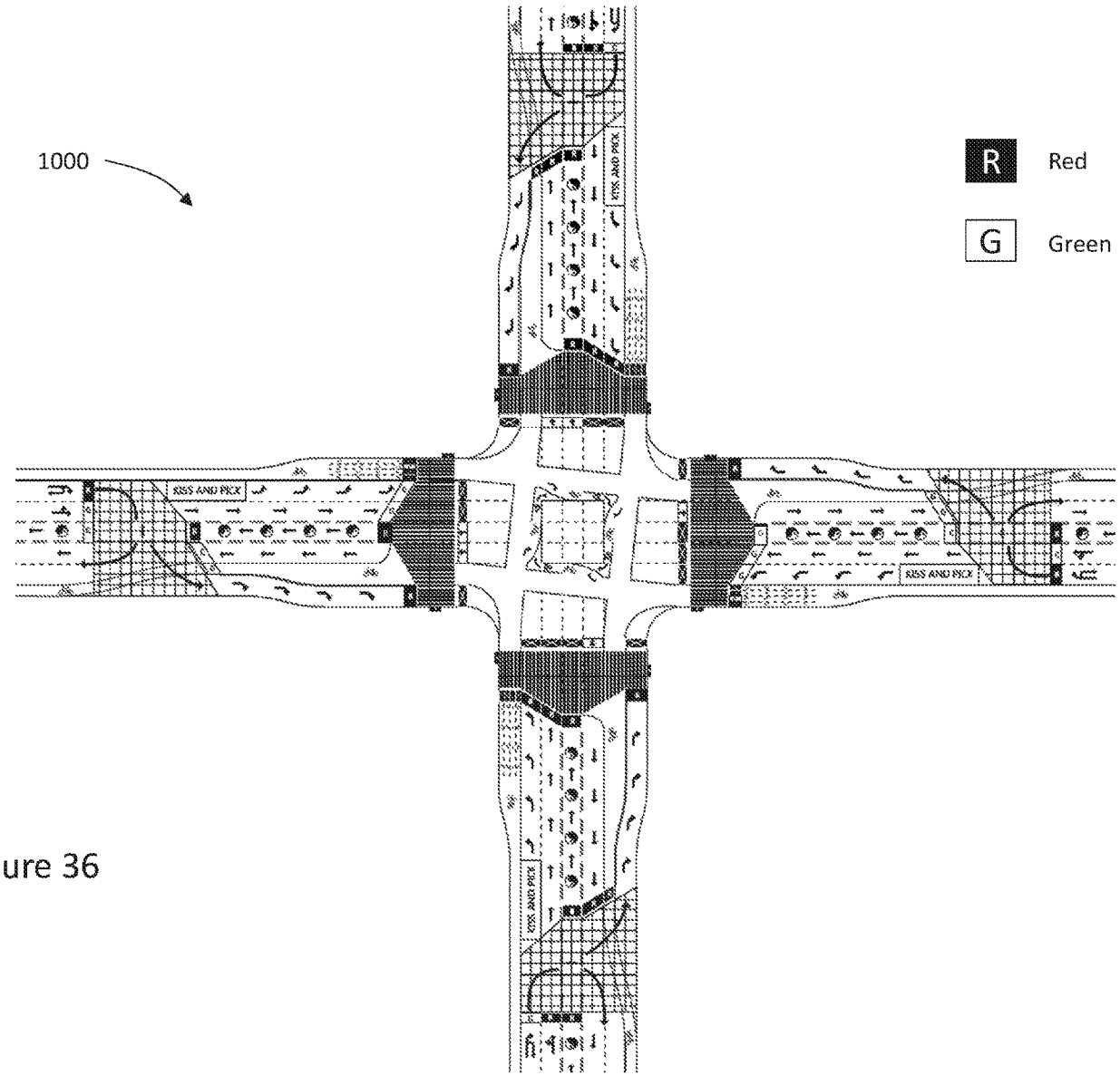
FIG. 36 shows the traffic intersection of FIG. 35, showing a second sub phase of a first phase.
Figure 37:
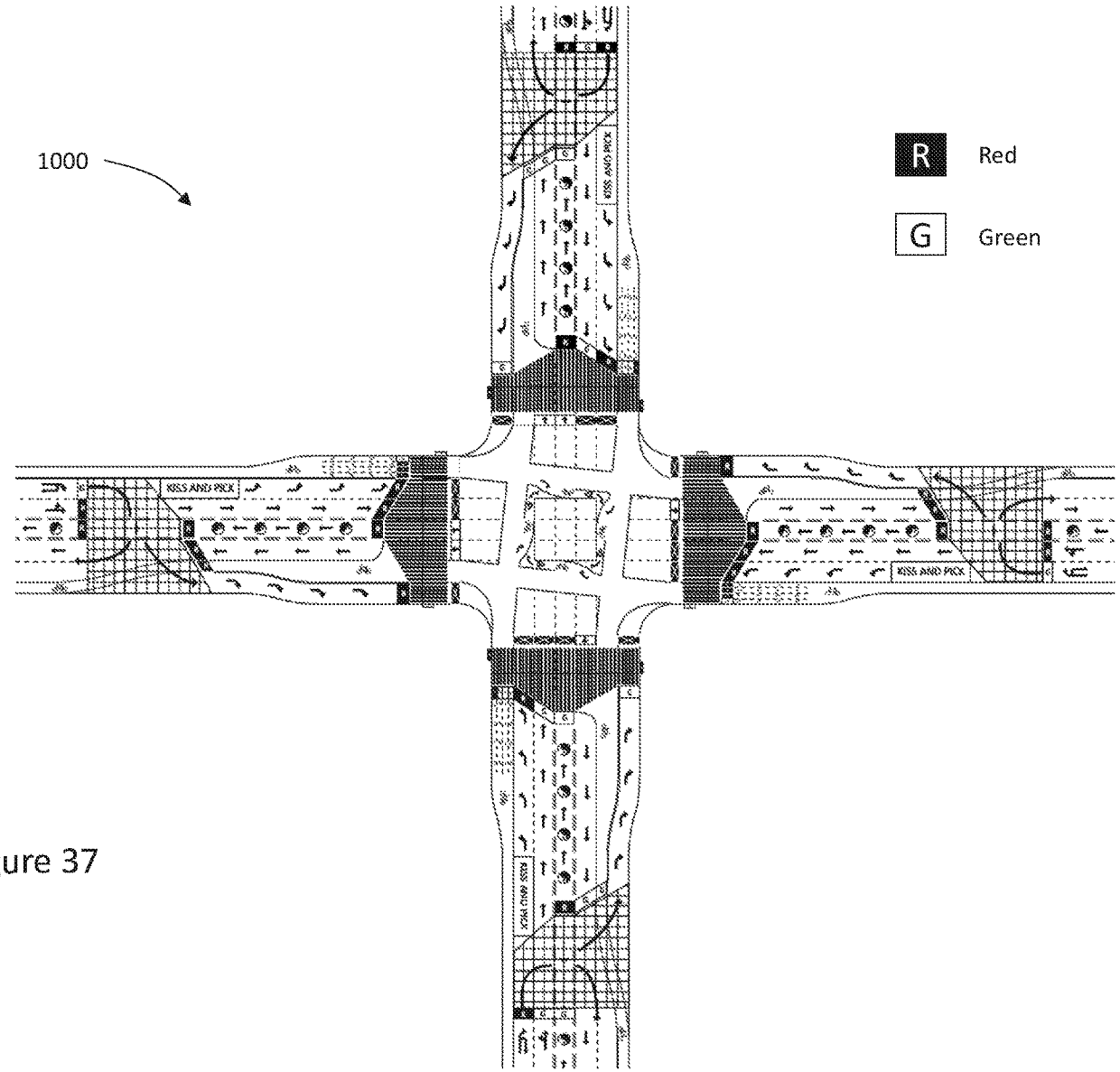
FIG. 37 shows the traffic intersection of FIG. 35, showing a first sub-phase of a second phase.
Figure 38:
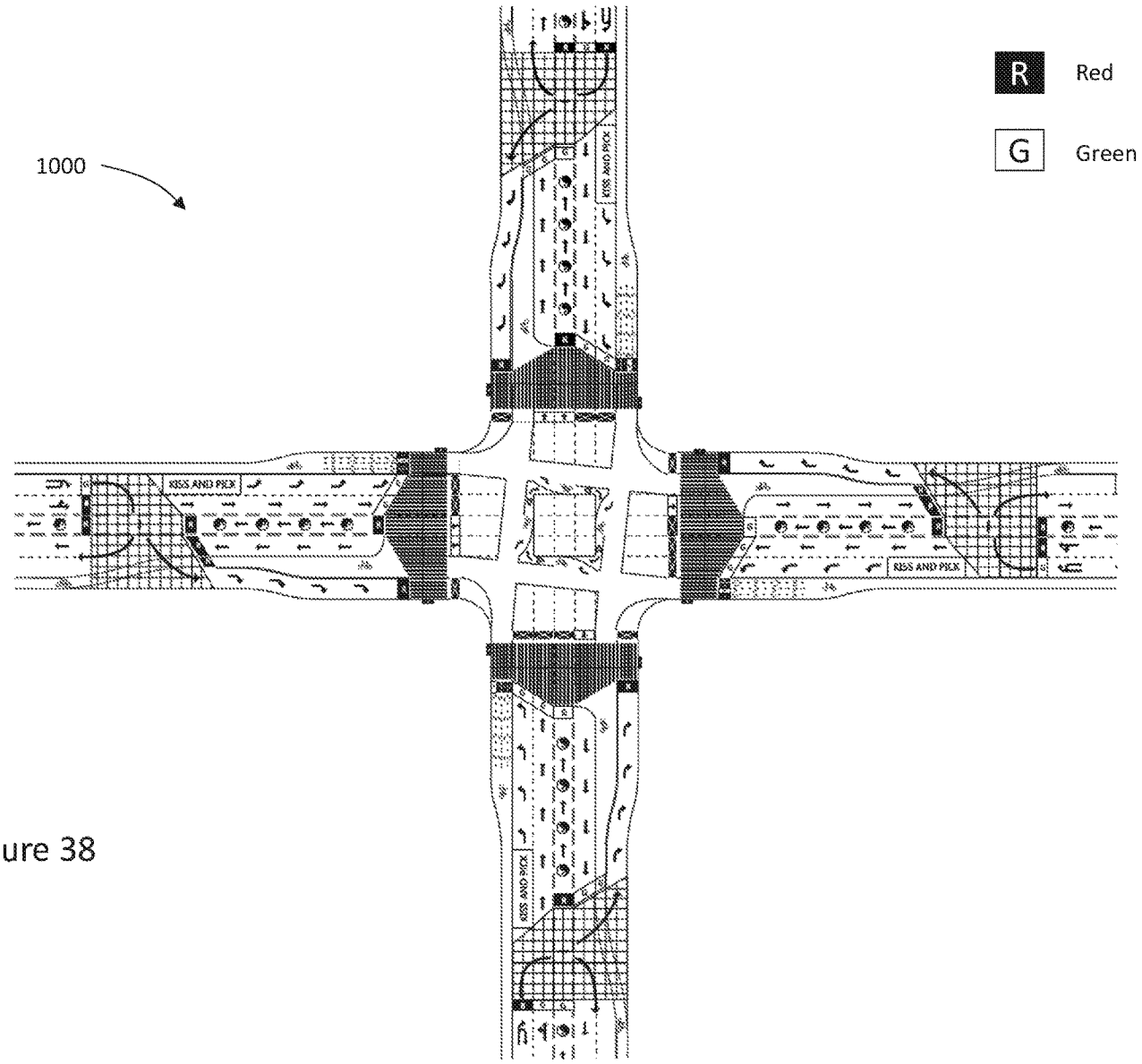
FIG. 38 shows the traffic intersection of FIG. 35, showing a second sub phase of a second phase.

A six lane by six lane intersection is shown in FIGS. 30-34 including bicycle lanes as described above, the number of lanes being calculated by counting the number of vehicle lanes distally of the distal crossover zone, and adding half a lane for each bicycle lane. Each of FIGS. 30-33 represents a separate sub phase corresponding to those as shown in FIG. 25-28, with FIGS. 30 and 31 being part of the first main phase and FIGS. 32 and 33 showing the second main phase. However, in the embodiment shown in FIGS. 30-34, bicycle waiting zones 1230 are provided around the periphery of the intersection region 1200, and outside of the going straight bicycle lanes. FIG. 34 shows a close-up view of FIG. 31.

Another six lane by six lane intersection is shown in FIGS. 35-38, with each of FIGS. 35-38 representing a separate sub phase corresponding to those shown in FIGS. 25-28 and FIGS. 30-33. However, the traffic intersection of FIG. 35-38 is distinguished from the traffic intersection of FIGS. 30-34 by the provision of the central island with peripheral bicycle waiting zones.

In an alternative embodiment, it is envisaged that in addition to the sub phases described, a third sub phase may be provided, during which all turning of bicycles or cars into a road is stopped, while pedestrians are allowed to cross that road at the pedestrian crossing.

Figure 39:
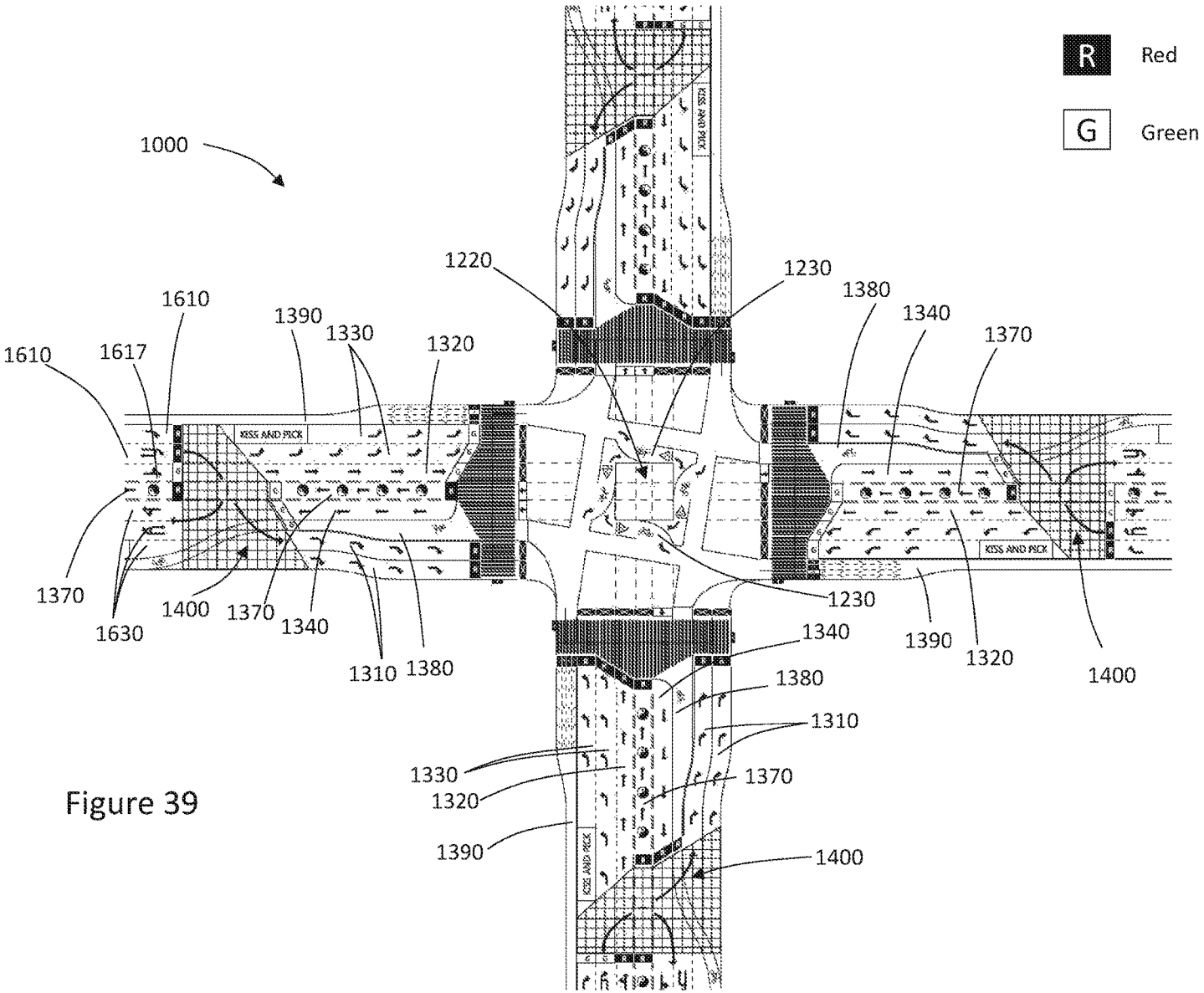
FIG. 39 shows a thirteenth embodiment of a traffic intersection, showing an eight lane road intersecting an eight lane road.
Figure 40:
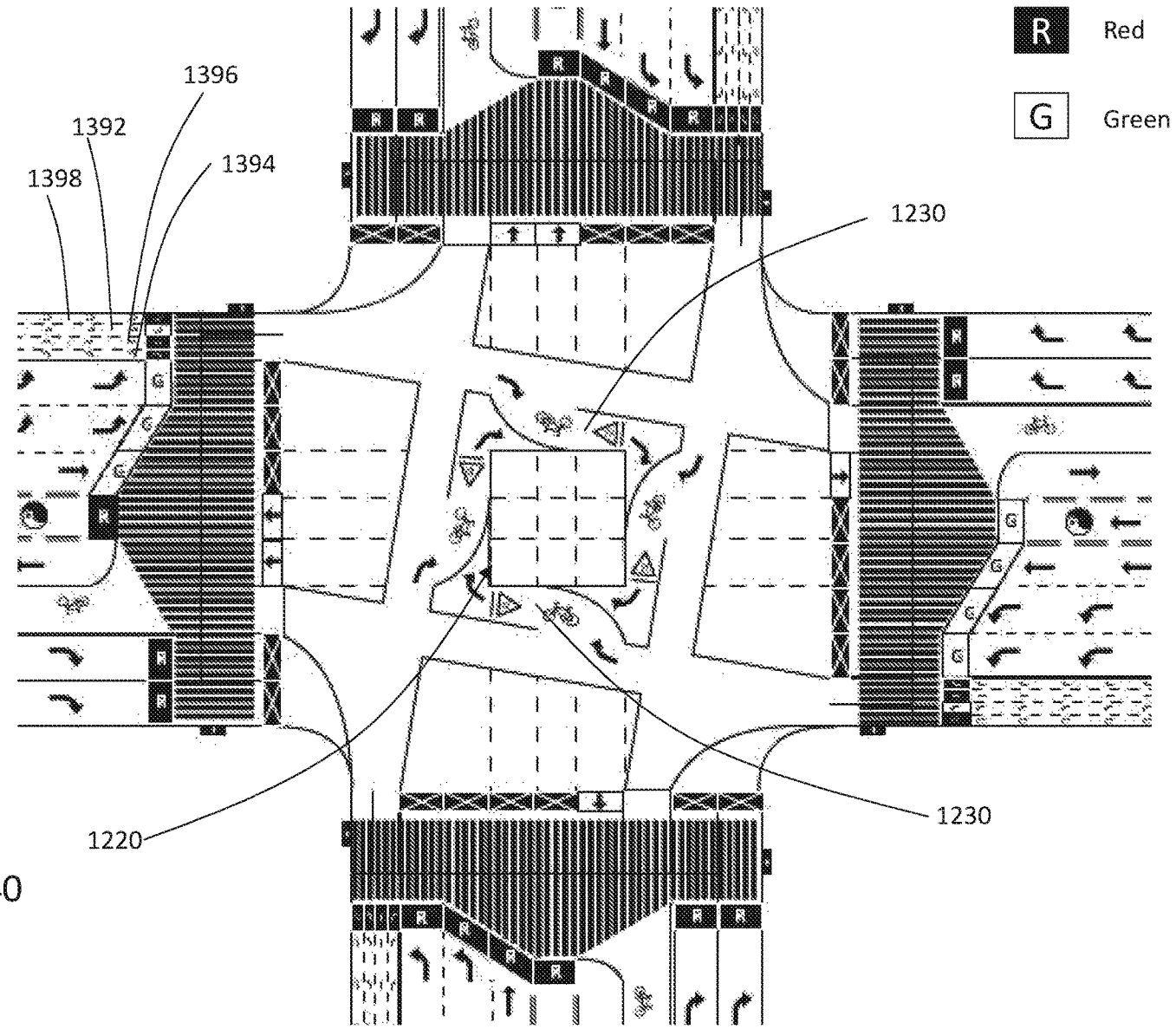
FIG. 40 shows a close-up view of the intersection of FIG. 39.

FIGS. 39 and 40 show an eight lane by eight lane traffic intersection 1000, in which more than one turning right lane 1310 and turning left lane 1330 is provided. FIG. 40 is a close up view of FIG. 39. As may be seen from FIG. 40, the bicycle receiving lane 1380 extends between the innermost turning right lane 1310 and the outermost receiving lane 1340.

Figure 41:
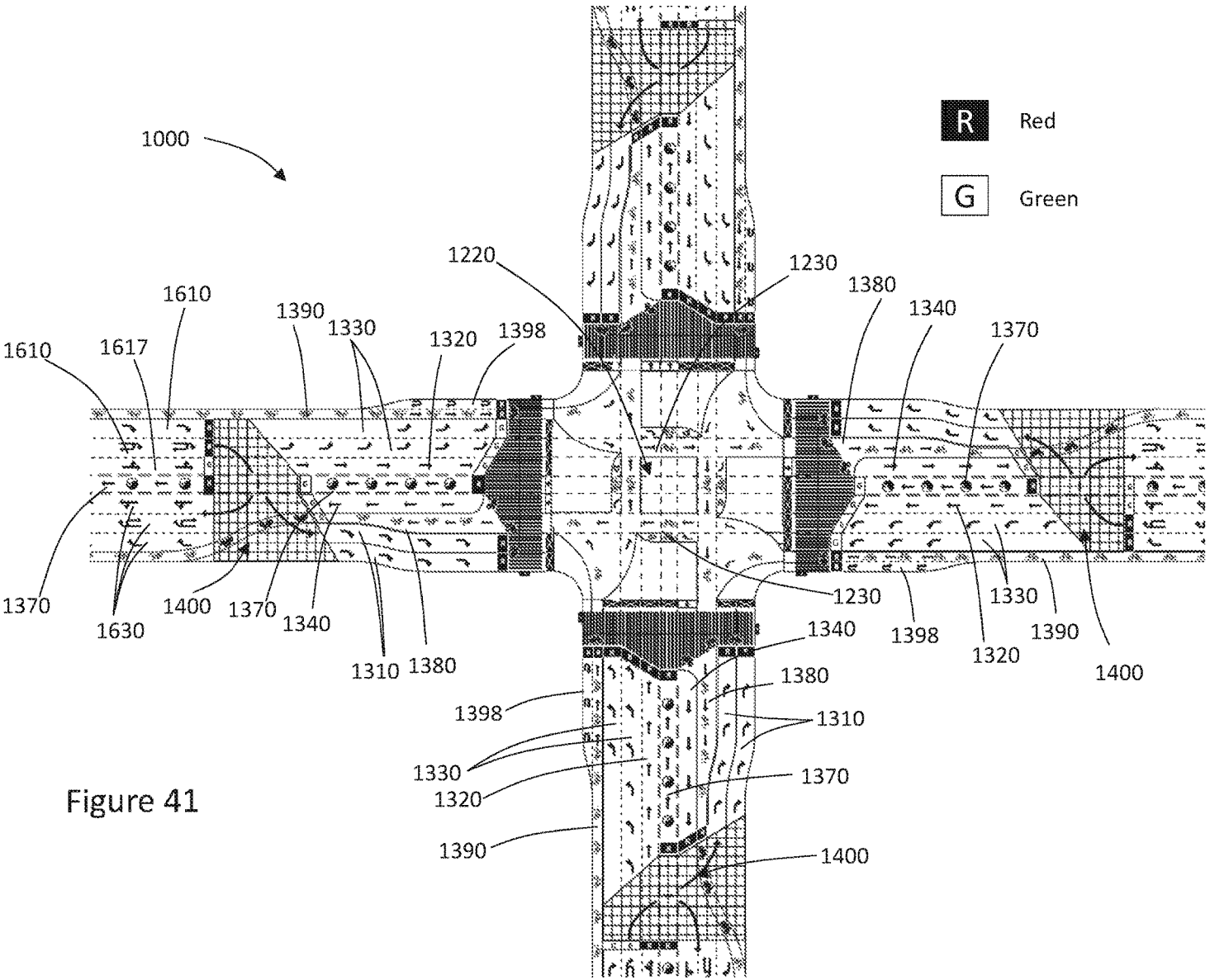
FIG. 41 shows a fourteenth embodiment of a traffic intersection, showing an eight lane road intersecting an eight lane road.

FIGS. 41 and 42 show another eight lane by a lane traffic intersection 1000 similar to that shown in FIGS. 39 and 40, but including bicycle waiting zones that are aligned around the periphery of the intersection region, and specifically outwardly of the lanes that vehicles in the going straight lanes would use to traverse the intersection.

FIGS. 43 and 44 each show an eight lane road extending from the intersection region to illustrate how outer lanes may be reconfigurable as parking spaces, similar to the embodiments shown in FIG. 9. As may be seen from FIGS. 43 and 44, where a pair of turning right lanes and/or turning left lanes are provided, one of the turning right lane and/or turning left lane can be reconfigured as a parking lane outside of peak traffic hours. It should be noted that the embodiment of FIG. 43 includes a turning left bicycle lane 1392, a turning right bicycle lane 1394, a moving straight bicycle lane 1396 and a U-turn bicycle lane 1398; while in contrast the embodiment shown in FIG. 44 only includes a U-turn bicycle lane 1398 and an approach bicycle lane 1390.

Figure 8:
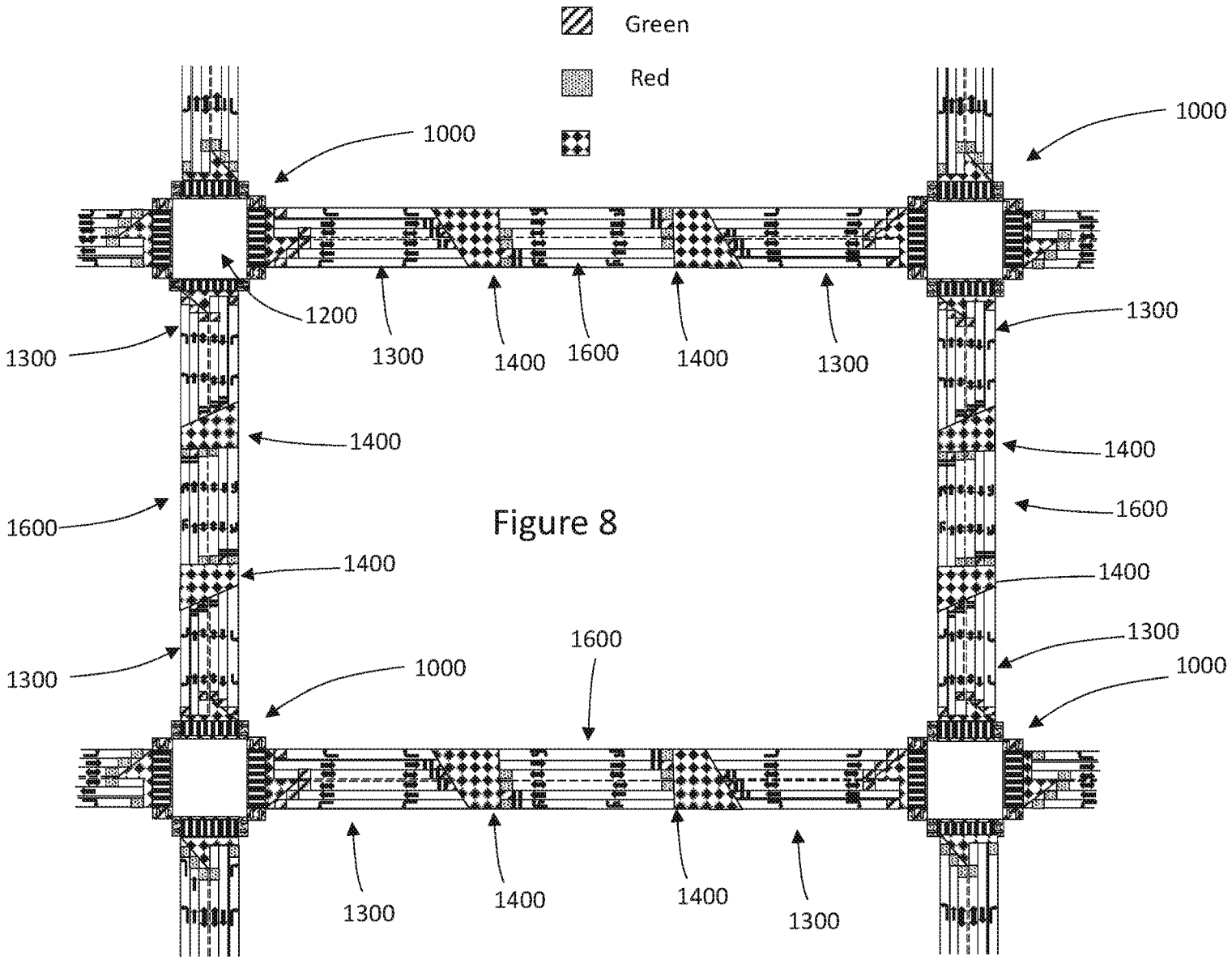
FIG. 8 shows a schematic view of a plurality of traffic intersections of six lane road crossing six lane roads, making up a city block.

In this way, and with reference to FIGS. 8 and 23, it will be appreciated by those skilled in the art that the distal crossover zones 1400 can be used in a larger grid of traffic intersections 1000 to divert traffic away from a fouled up intersection region 1200.

Figure 52:
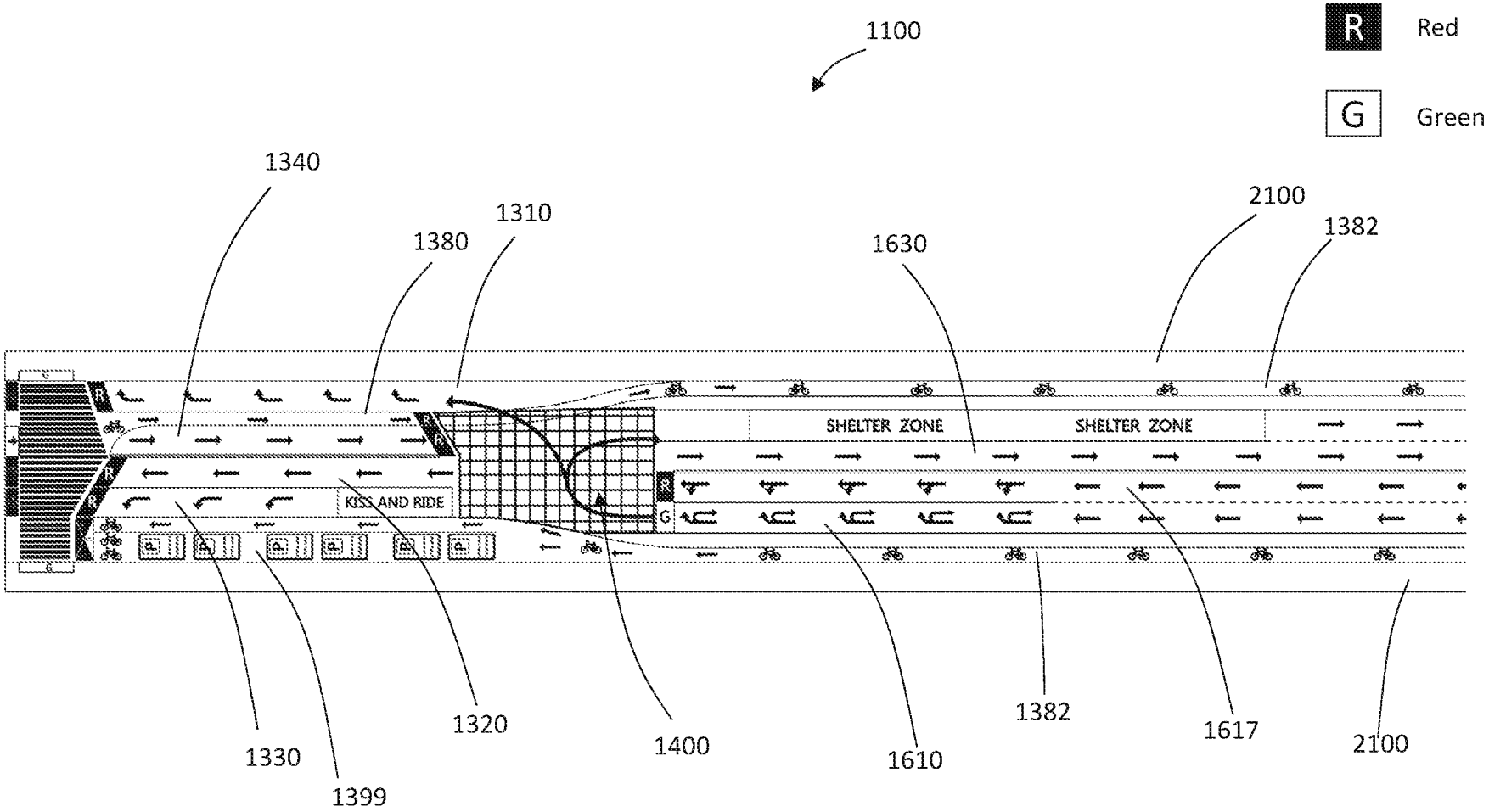
FIG. 52 shows a schematic view of a four-lane road including a reconfigurable bicycle parking lane.
Figure 53:
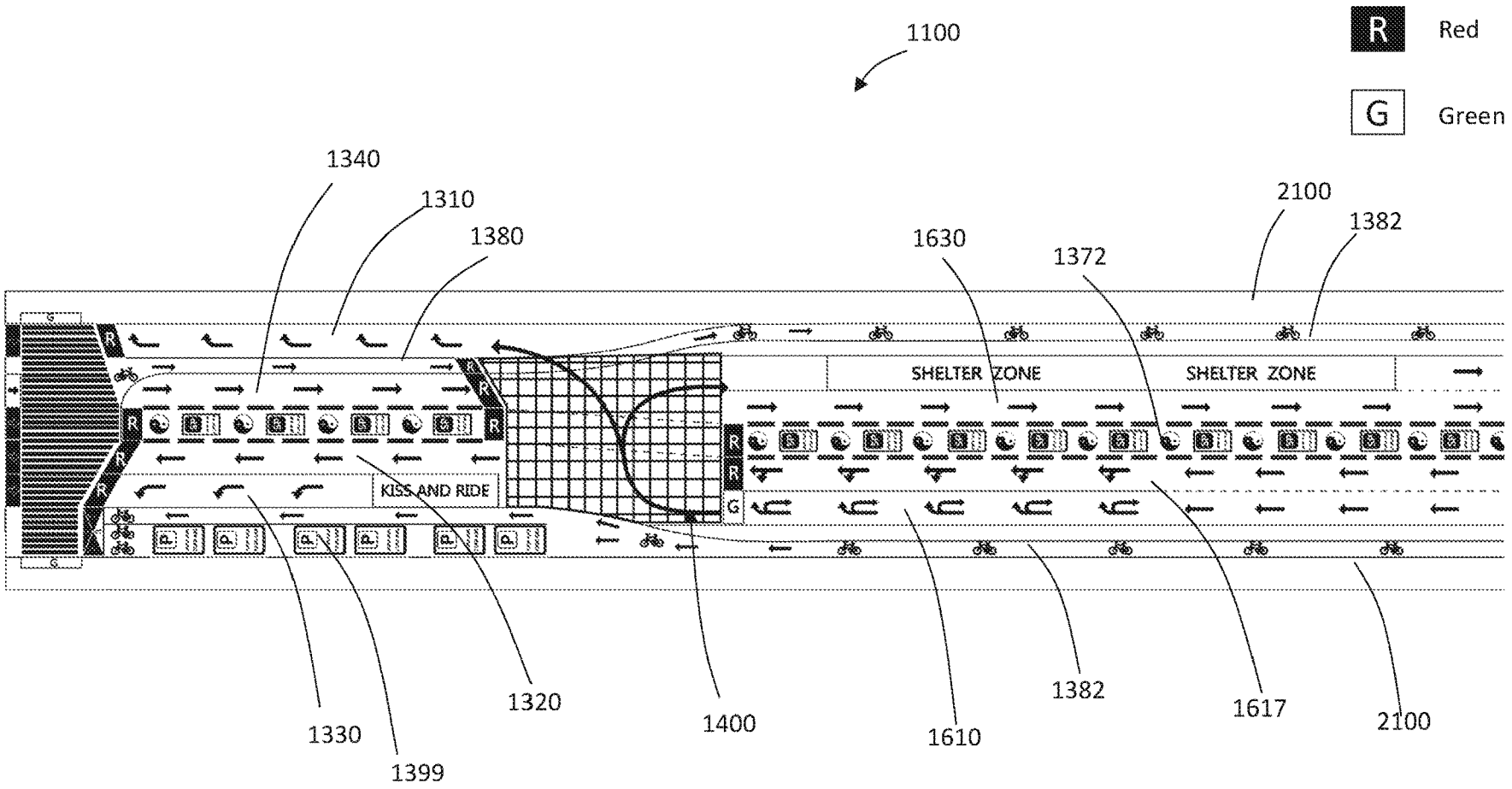
FIG. 53 shows a schematic view of a five lane road including a reconfigurable bicycle parking lane and reconfigurable lanes that are also reconfigurable parking lanes.
Figure 54:
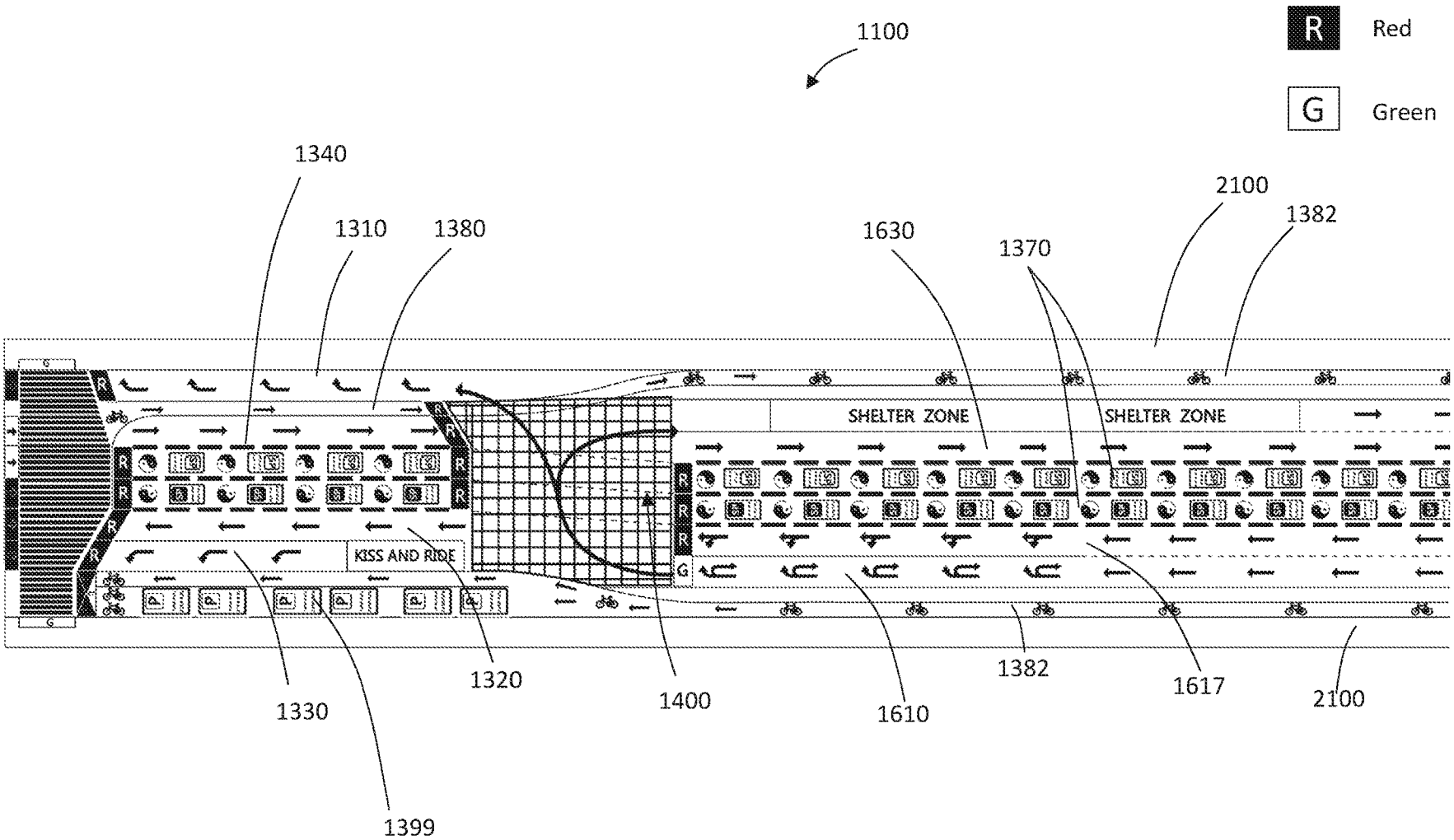
FIG. 54 shows a schematic view of a six lane road including a reconfigurable bicycle parking lane and reconfigurable lanes that are also reconfigurable parking lanes.
Figure 55:
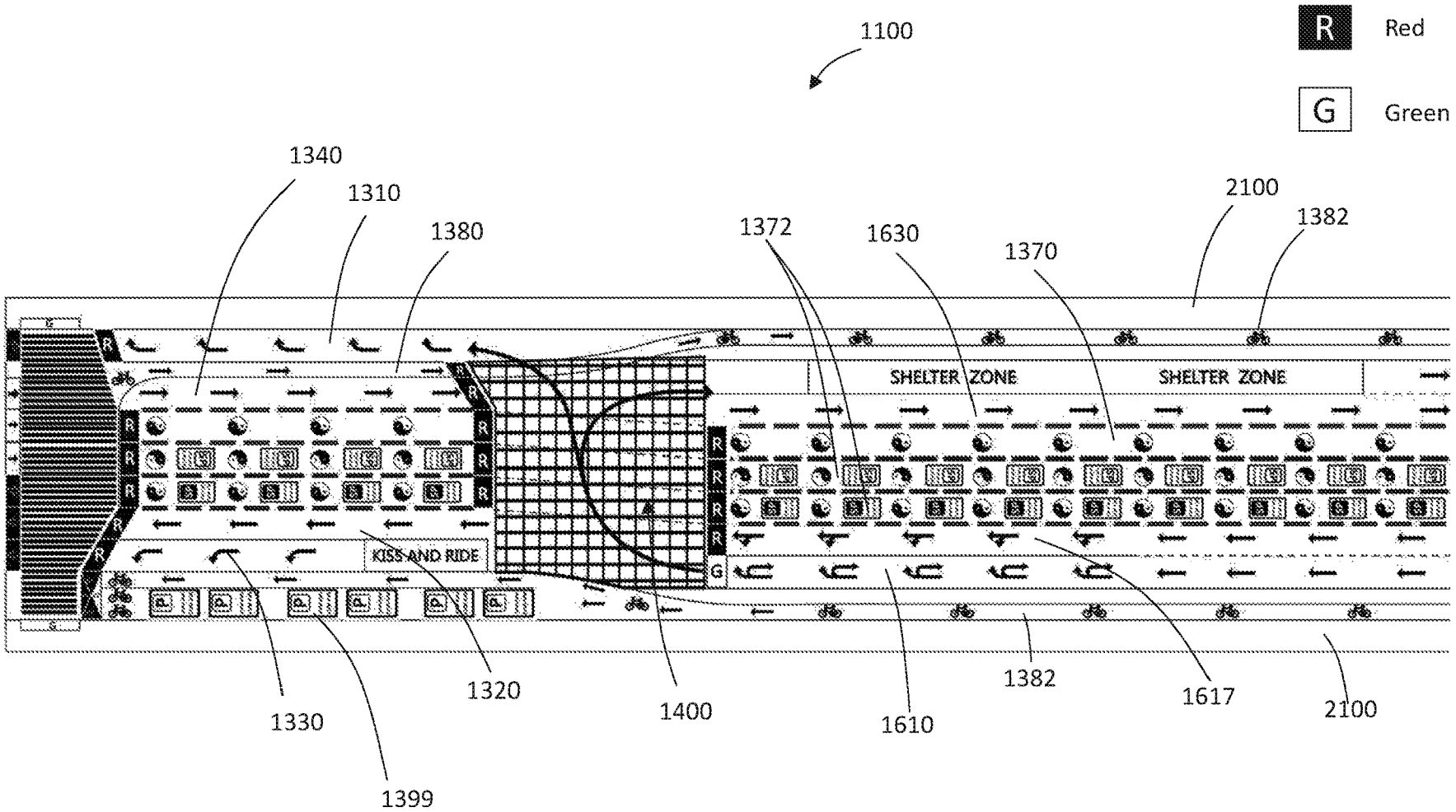
FIG. 55 shows a schematic view of a seven lane road including a reconfigurable bicycle parking lane and reconfigurable lanes that are also reconfigurable parking lanes.
Figure 56:
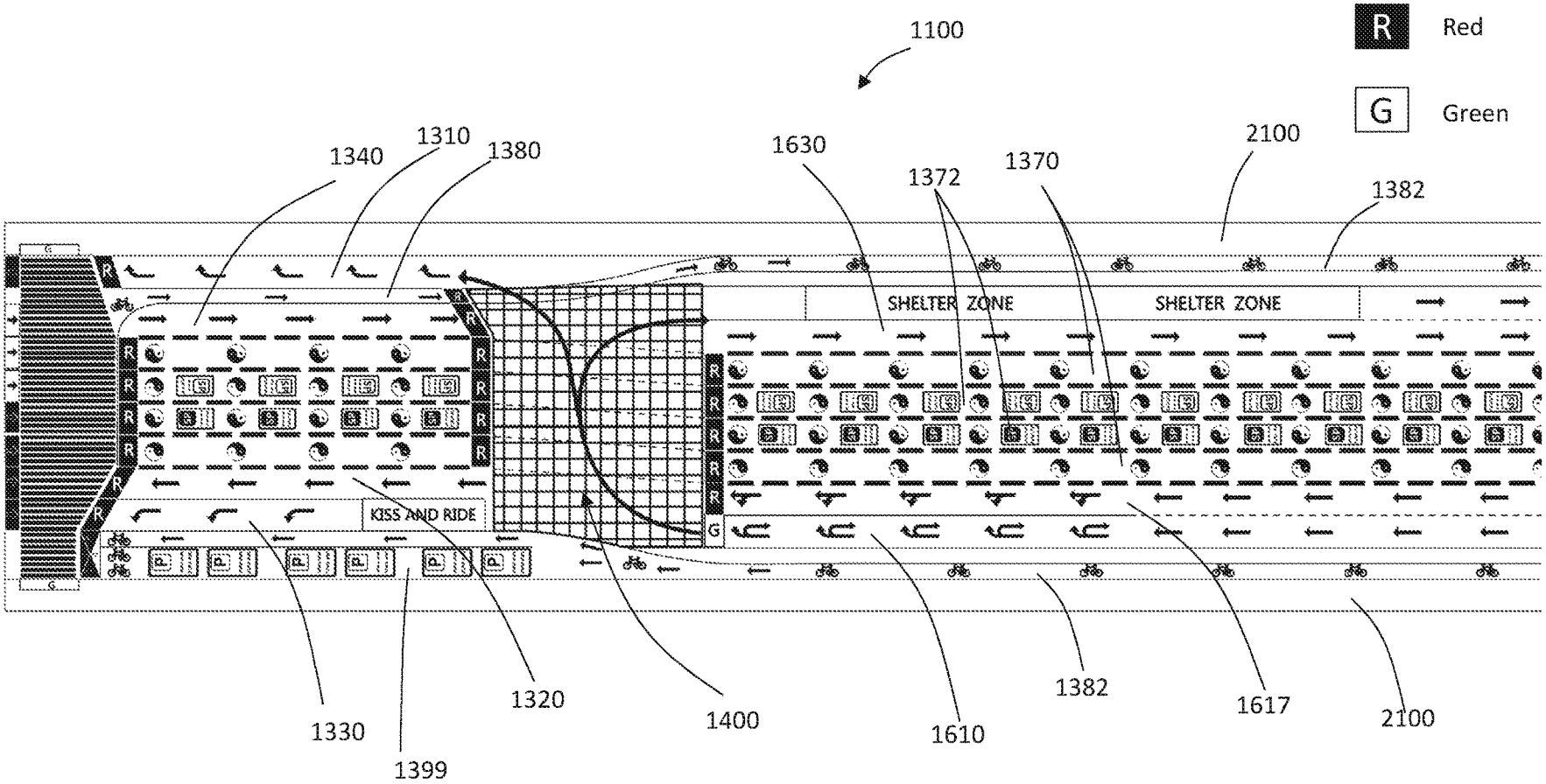
FIG. 56 shows a schematic view of an eight lane road including a reconfigurable bicycle parking lane and reconfigurable lanes that are also reconfigurable parking lanes.
Figure 57:
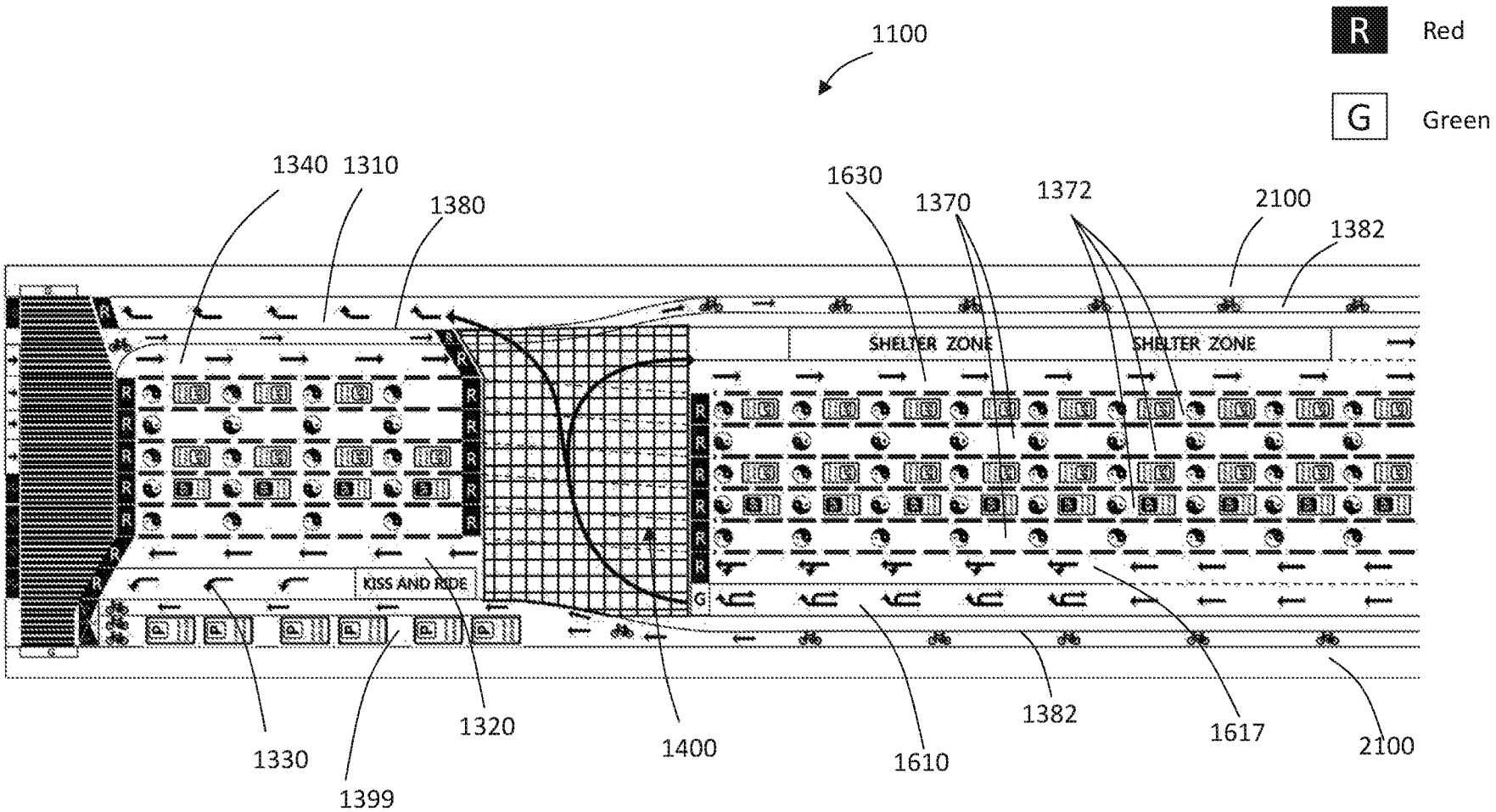
FIG. 57 shows a schematic view of a nine lane road including a reconfigurable bicycle parking lane and reconfigurable lanes that are also reconfigurable parking lanes.
Figure 58:
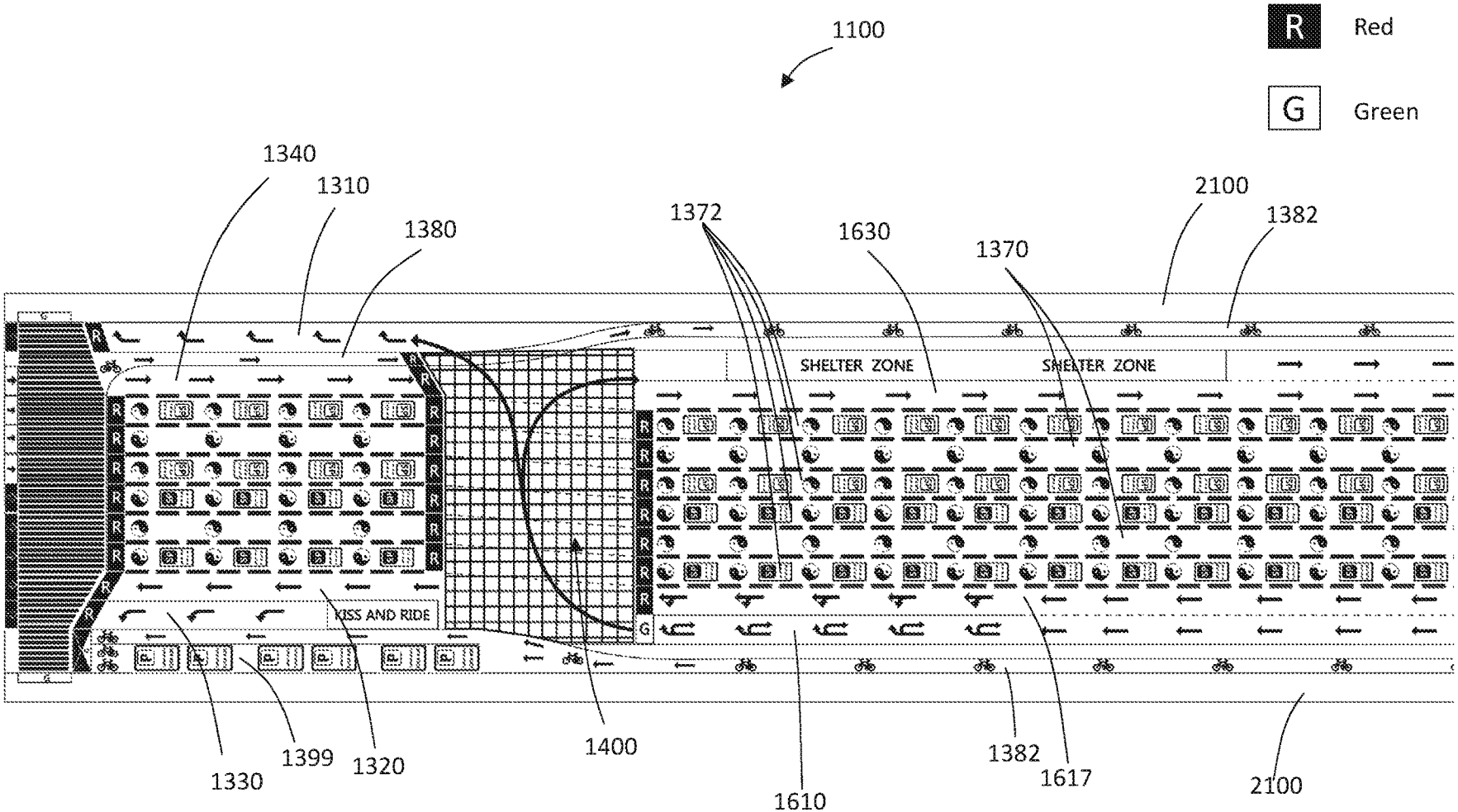
FIG. 58 shows a schematic view of a ten lane road including a reconfigurable bicycle parking lane and reconfigurable lanes that are also reconfigurable parking lanes.
Figure 59:
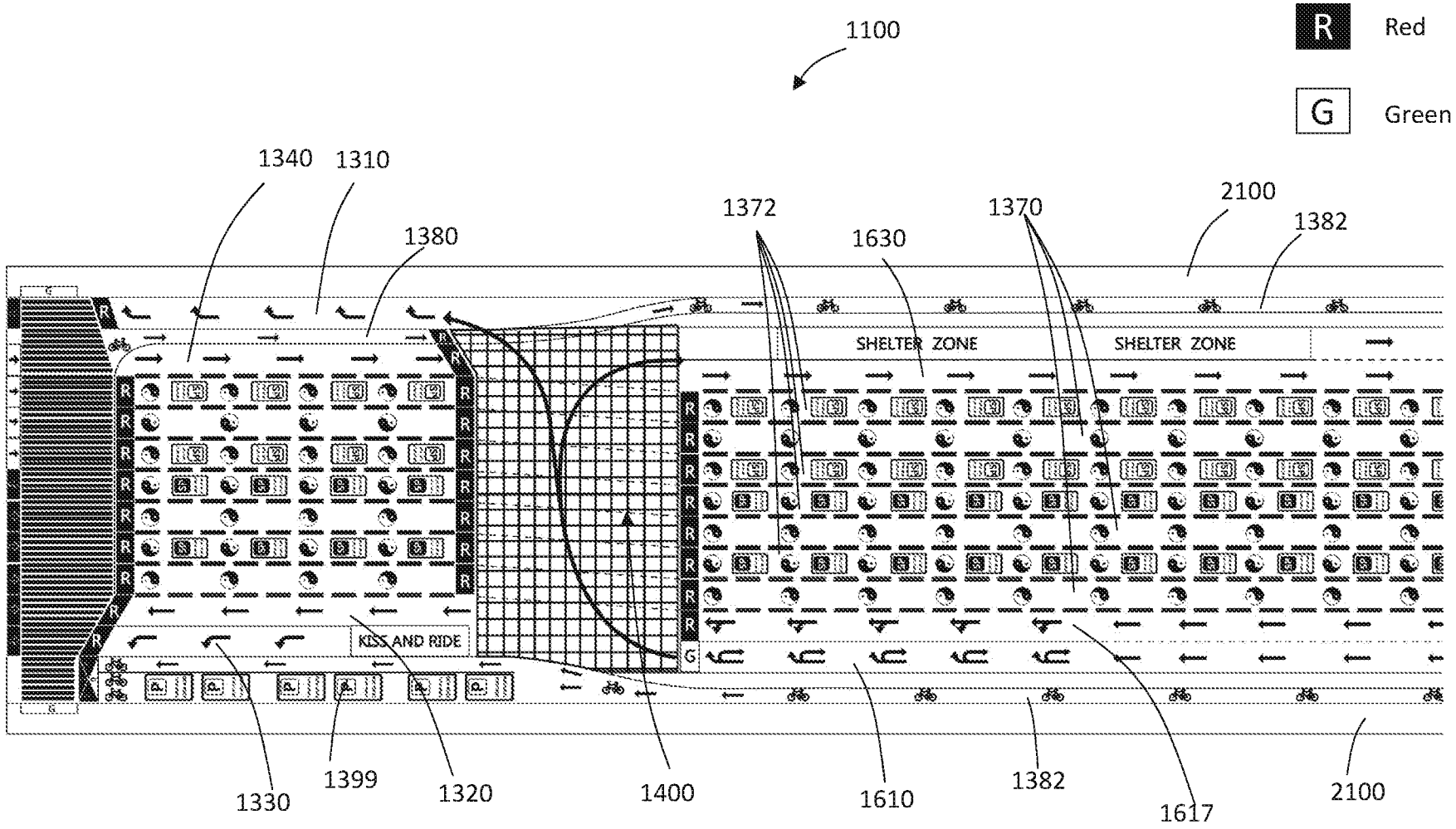
FIG. 59 shows a schematic view of an eleven lane road including a reconfigurable bicycle parking lane and reconfigurable lanes that are also reconfigurable parking lanes.
Figure 60:
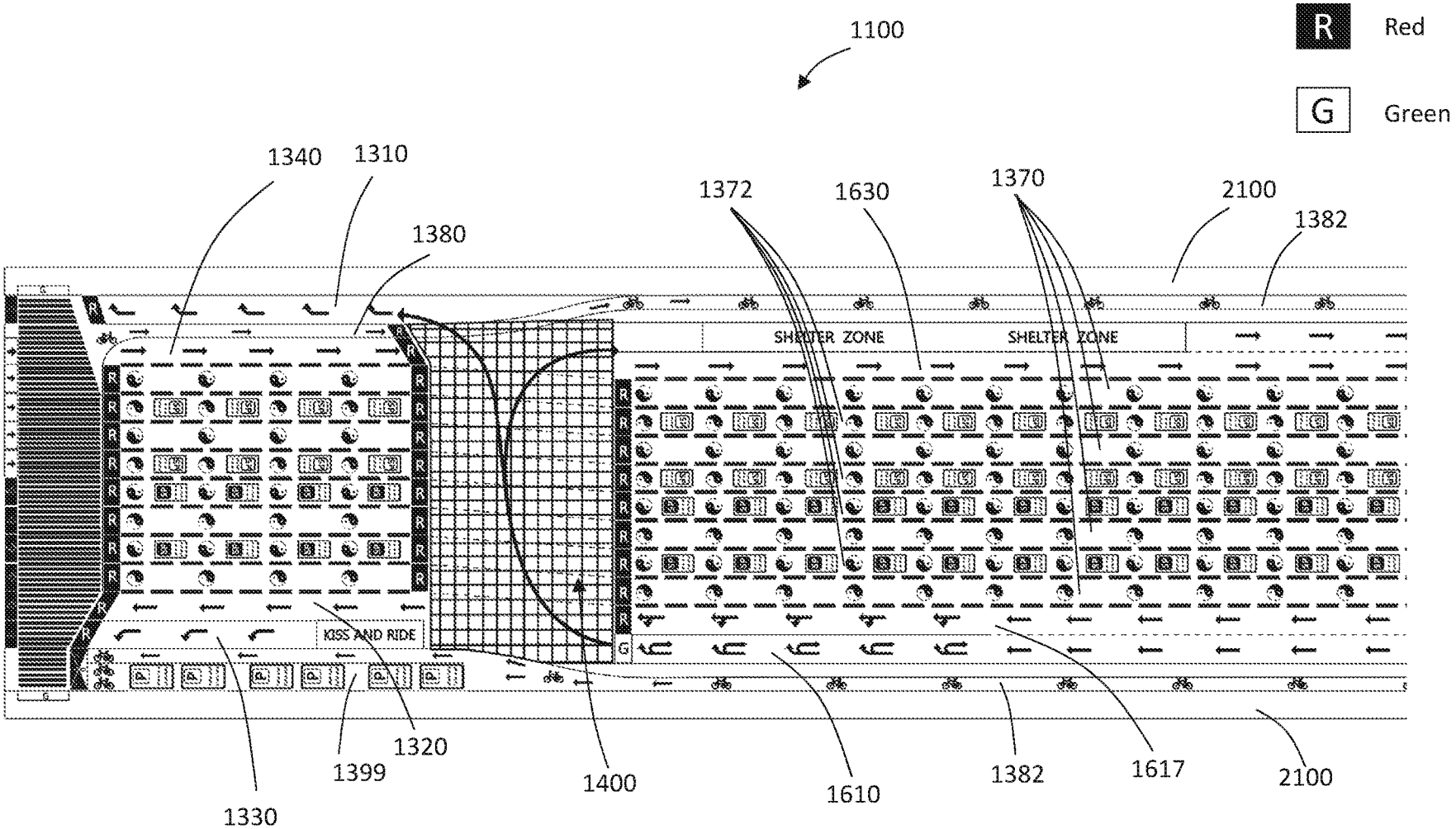
FIG. 60 shows a schematic view of a twelve lane road including a reconfigurable bicycle parking lane and reconfigurable lanes that are also reconfigurable parking lanes.
Figure 61:
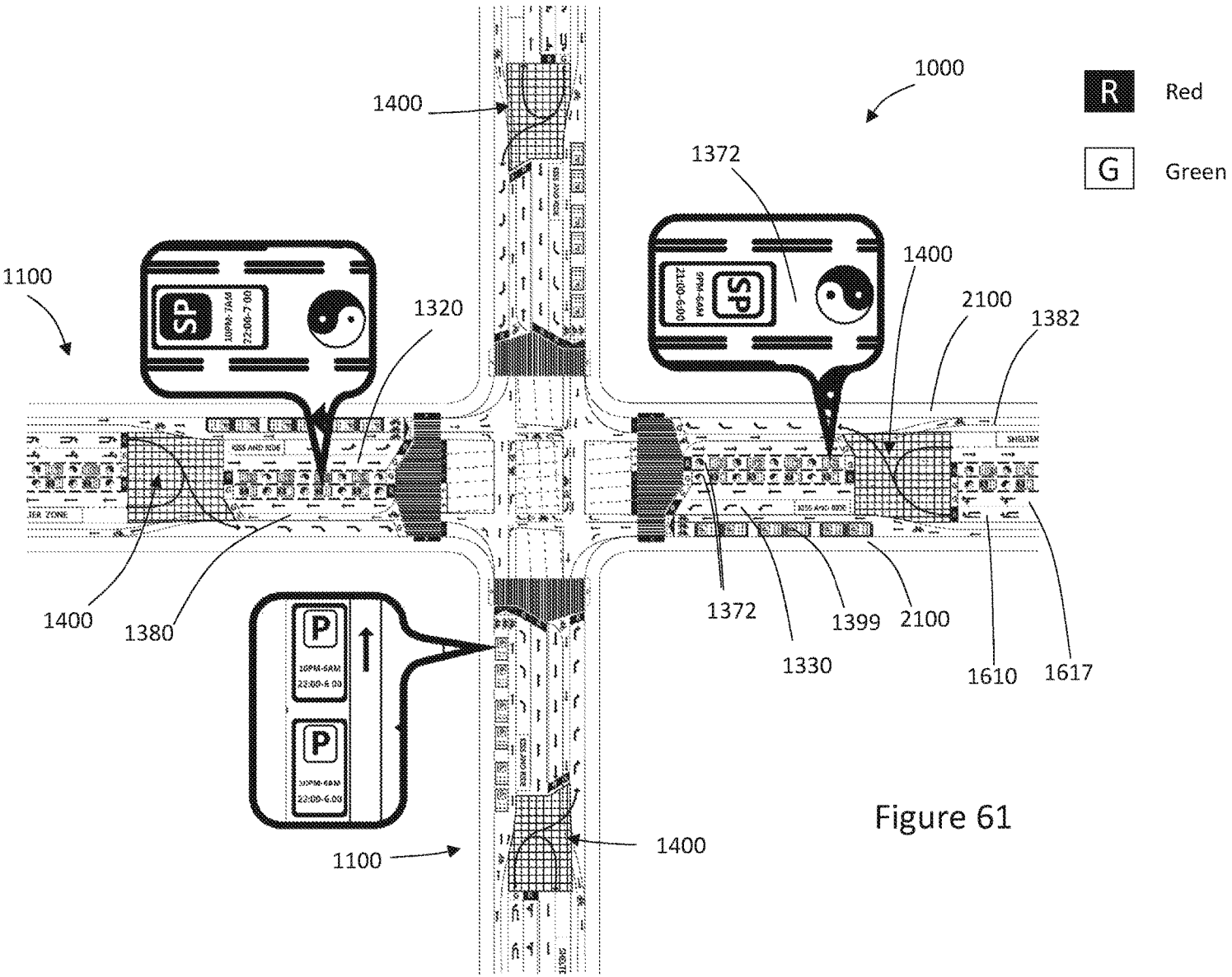
FIG. 61 shows a schematic view of a seventeenth embodiment of a traffic intersection, showing a six lane road intersecting a four-lane road.

In the embodiment shown in FIG. 52, and as explained above, the bicycle lanes can be reconfigurable as vehicle parking. In order to allow for this reconfiguration, it is envisaged that the traffic guidance system 3000 will control the visual signalling devices signalling to the turning left bicycle lane 1392 and the moving straight bicycle lane 1396 to operate in a red or stop condition, thereby stopping the movement of all bicycles in these lanes.

Similarly, in the embodiment shown in FIGS. 53-61, in order to allow some of the reconfigurable lanes to operate as reconfigurable parking lanes 1372 as described above, the traffic guidance system 3000 will control the visual signalling devices signalling to the reconfigurable lanes 1370 to operate in a red or stop condition, thereby stopping movement of all vehicles in these lanes in either direction.

It is envisaged that, using a traffic intersection 1000 and traffic guidance system 3000 as described above, vehicles can be safely guided by visual signalling devices through both the intersection region 1200 and the distal crossover zone 1400, without the drivers of vehicles having to rely on their judgement. In addition, by having the right turn lanes distal of the distal crossover zones on the far left lane of the road 1100, the central lanes can be reconfigurable lanes 1370, allowing for increased flexibility in the management of traffic.

Interpretation

In Accordance With:

As described herein, 'in accordance with' may also mean 'as a function of' and is not necessarily limited to the integers specified in relation thereto.

Database:

In the context of this document, the term database and its derivatives may be used to describe a single database, a set of databases, a system of databases or the like. The system of databases may comprise a set of databases wherein the set of databases may be stored on a single implementation or span across multiple implementations. The term database is also not limited to refer to a certain database format rather may refer to any database format. For example, database formats may include MySQL, MySQLi, XML or the like.

Wireless:

The invention may be embodied using devices conforming to other network standards and for other applications, including, for example other WLAN standards and other wireless standards. Applications that can be accommodated include IEEE 802.11 wireless LANs and links, and wireless Ethernet.

In the context of this document, the term wireless and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. In the context of this document, the term wired, and its derivatives may be used to describe circuits, devices, systems, methods, techniques, communications channels, etc., that may communicate data through the use of modulated electromagnetic radiation through a solid medium. The term does not imply that the associated devices are coupled by electrically conductive wires.

Processes:

Unless specifically stated otherwise, as apparent from the following discussions, it is appreciated that throughout the specification discussions utilizing terms such as processing, computing, calculating, determining, analysing or the like, refer to the action and/or processes of a computer or computing system, or similar electronic computing device, that manipulate and/or transform data represented as physical, such as electronic, quantities into other data similarly represented as physical quantities.

Processor:

In a similar manner, the term processor may refer to any device or portion of a device that processes electronic data, e.g., from registers and/or memory to transform that electronic data into other electronic data that, e.g., may be stored in registers and/or memory. A computer or a computing device or a computing machine or a computing platform may include one or more processors.

The methodologies described herein are, in one embodiment, performable by one or more processors that accept computer-readable (also called machine-readable) code containing a set of instructions that when executed by one or more of the processors carry out at least one of the methods described herein. Any processor capable of executing a set of instructions (sequential or otherwise) that specify actions to be taken are included. Thus, one example is a typical processing system that includes one or more processors. The processing system further may include a memory subsystem including main RAM and/or a static RAM, and/or ROM.

Computer-Readable Medium:

Furthermore, a computer-readable carrier medium may form, or be included in a computer program product. A computer program product can be stored on a computer usable carrier medium, the computer program product comprising a computer readable program means for causing a processor to perform a method as described herein.

Networked or Multiple Processors:

In alternative embodiments, the one or more processors operate as a standalone device or may be connected, e.g., networked to other processor(s), in a networked deployment, the one or more processors may operate in the capacity of a server or a client machine in server-client network environment, or as a peer machine in a peer-to-peer or distributed network environment. The one or more processors may form a web appliance, a network router, switch or bridge, or any machine capable of executing a set of instructions (sequential or otherwise) that specify actions to be taken by that machine.

Note that while some diagram(s) only show(s) a single processor and a single memory that carries the computer-readable code, those in the art will understand that many of the components described above are included, but not explicitly shown or described in order not to obscure the inventive aspect. For example, while only a single machine is illustrated, the term "machine" shall also be taken to include any collection of machines that individually or jointly execute a set (or multiple sets) of instructions to perform any one or more of the methodologies discussed herein.

Additional Embodiments:

Thus, one embodiment of each of the methods described herein is in the form of a computer-readable carrier medium carrying a set of instructions, e.g., a computer program that are for execution on one or more processors. Thus, as will be appreciated by those skilled in the art, embodiments of the present invention may be embodied as a method, an apparatus such as a special purpose apparatus, an apparatus such as a data processing system, or a computer-readable carrier medium. The computer-readable carrier medium carries computer readable code including a set of instructions that when executed on one or more processors cause a processor or processors to implement a method. Accordingly, aspects of the present invention may take the form of a method, an entirely hardware embodiment, an entirely software embodiment or an embodiment combining software and hardware aspects. Furthermore, the present invention may take the form of carrier medium (e.g., a computer program product on a computer-readable storage medium) carrying computer-readable program code embodied in the medium.

Carrier Medium:

The software may further be transmitted or received over a network via a network interface device. While the carrier medium is shown in an example embodiment to be a single medium, the term carrier medium should be taken to include a single medium or multiple media (e.g., a centralized or distributed database, and/or associated caches and servers) that store the one or more sets of instructions. The term "carrier medium" shall also be taken to include any medium that is capable of storing, encoding or carrying a set of instructions for execution by one or more of the processors and that cause the one or more processors to perform any one or more of the methodologies of the present invention. A carrier medium may take many forms, including but not limited to, non-volatile media, volatile media, and transmission media.

Implementation:

It will be understood that the steps of methods discussed are performed in one embodiment by an appropriate processor (or processors) of a processing (i.e., computer) system executing instructions (computer-readable code) stored in storage. It will also be understood that the invention is not limited to any particular implementation or programming technique and that the invention may be implemented using any appropriate techniques for implementing the functionality described herein. The invention is not limited to any particular programming language or operating system.

Means for Carrying Out a Method or Function

Furthermore, some of the embodiments are described herein as a method or combination of elements of a method that can be implemented by a processor of a processor device, computer system, or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

Connected

Similarly, it is to be noticed that the term connected, when used in the claims, should not be interpreted as being limitative to direct connections only. Thus, the scope of the expression a device A connected to a device B should not be limited to devices or systems wherein an output of device A is directly connected to an input of device B. It means that there exists a path between an output of A and an input of B which may be a path including other devices or means. Connected may mean that two or more elements are either in direct physical or electrical contact, or that two or more elements are not in direct contact with each other but yet still co-operate or interact with each other.

Embodiments:

Reference throughout this specification to one embodiment or an embodiment means that a particular feature, structure or characteristic described in connection with the embodiment is included in at least one embodiment of the present invention. Thus, appearances of the phrases in one embodiment or in an embodiment in various places throughout this specification are not necessarily all referring to the same embodiment but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some, but not other features included in other embodiments, combinations of features of different embodiments are meant to be within the scope of the invention, and form different embodiments, as would be understood by those in the art. For example, in the following claims, any of the claimed embodiments can be used in any combination.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as forward, rearward, radially, peripherally, upwardly, downwardly, and the like are used as words of convenience to provide reference points and are not to be construed as limiting terms.

Different Instances of Objects

As used herein, unless otherwise specified the use of the ordinal adjectives first, second, third, etc., to describe a common object, merely indicate that different instances of like objects are being referred to and are not intended to imply that the objects so described must be in a given sequence, either temporally, spatially, in ranking, or in any other manner.

Comprising and Including

In the claims which follow and in the preceding description of the invention, except where the context requires otherwise due to express language or necessary implication, the word comprise or variations such as comprises or comprising are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

Chronological Order

For the purpose of this specification, where method steps are described in sequence, the sequence does not necessarily mean that the steps are to be carried out in chronological order in that sequence, unless there is no other logical manner of interpreting the sequence.

Markush Groups

In addition, where features or aspects of the invention are described in terms of Markush groups, those skilled in the art will recognise that the invention is also thereby described in terms of any individual member or subgroup of members of the Markush group.

Industrial Applicability

It is apparent from the above, that the arrangements described are applicable to the traffic management industries.

The invention claimed is:

1. A traffic intersection comprising an intersection of at least two multilane roads, at least one of the roads including at least three or more traffic lanes spaced adjacent each other;

an intersection region wherein the intersecting roads overlap;

at least one of the intersecting roads comprising a proximate region in which the road approaching the intersection defines a plurality of proximal transit lanes, the proximal transit lanes including:

one or more selected from:

a going straight lane for guiding vehicles approaching the intersection region to move straight through the intersection on the same road;

a turning left lane for guiding vehicles approaching the intersection region to turn left at the intersection onto an intersecting road;

a combination going straight and turning left lane for guiding vehicles approaching the intersection region to move straight across the intersection on the same road or turn left at the intersection onto the other intersecting road; and one or more reconfigurable lanes for guiding vehicles approaching the intersection to move straight through the intersection on the same intersecting road;

at least one receiving lane for receiving vehicles moving from the intersection region into the road; and at least one turning right lane for guiding vehicles approaching the intersection region to turn right at the intersection onto the intersecting road;

wherein the turning right lane is spaced from the said at least one or more selected from the going straight lane and the turning left lane by at least one receiving lane;

a distal crossover zone distal of the proximate region;

a distal region distally of the distal crossover zone, in which the road defines a plurality of distal transit lanes, including at least:

at least one right turn approaching lane configured for guiding vehicles approaching the distal crossover zone from the distal region into the at least one turning right lane; and wherein the at least one right turn approaching lane is located left most of the distal transit lanes.

2. The traffic intersection as claimed in claim 1, wherein at least one or more of the reconfigurable lanes is configured to be reconfigurable as one or more selected from:

a) a traffic lane in which the direction of travel of vehicles is reversible;

b) at least one or more vehicle parking lanes.

3. The traffic intersection as claimed in claim 1, wherein the going straight lanes are configured for guiding vehicles over the intersection in a straight line to at least one or more going straight receiving lanes.

4. The traffic intersection as claimed in claim 1, wherein the proximate region further comprises at least one or more turning left lanes configured for guiding vehicles to turn left at the intersection onto the intersecting road.

5. The traffic intersection as claimed in claim 1, wherein the traffic intersection includes a bicycle receiving lane for receiving bicycles that have traversed the intersection region, the bicycle receiving lane extending between the turning right lane and the receiving lane in the proximate region.

6. The traffic intersection as claimed in claim 1, wherein the traffic intersection includes at least one or more bicycle right turn waiting zones in the intersection region for guiding bicycles wanting to turn right at the intersection, wherein the bicycle right turn waiting zones are located proximate a central island in the intersection region.

7. The traffic intersection as claimed in claim 1, wherein the distal region includes at least one or more going straight approaching lanes for guiding vehicles directly over the distal crossover zone and into one of the going straight lanes.

8. The traffic intersection as claimed in claim 1, wherein the traffic intersection includes a traffic guidance system configured for guiding vehicles in one of two phases, and wherein the two phases are selected from:

a phase wherein all vehicles along one of the intersecting roads are signalled to move straight across the intersection and to turn from the road that they are on, onto the intersecting road, while all vehicles are prevented from crossing the distal crossover zone to move into the turning right lane;

a phase wherein all vehicles along the other of the intersecting roads that are moving straight and/or turning right and/or turning left are signalled to stop at the intersection region, while vehicles in the distal right turning lane are signalled to move over the distal intersection region into the proximal right turning lane.

9. The traffic intersection as claimed in claim 1, wherein the proximate region further comprises one or more selected from:

a) a plurality of turning left lanes, wherein at least one or more of the turning left lanes is reconfigurable between a traffic lane for use during peak hours, and a parking lane during off-peak hours; and b) a plurality of turning right lanes, wherein at least one or more of the turning right lanes is reconfigurable between a traffic lane for use during peak hours, and a parking lane during off-peak hours.

10. The traffic intersection as claimed in claim 1, wherein the traffic intersection includes a traffic guidance system comprising at least one or more visual signalling devices configured for displaying guidance signals to vehicles on each intersecting road, wherein the at least one or more visual signalling devices are operable to display at least a green signal for indicating vehicles in associated lanes to proceed and a red signal for indicating to vehicles in associated lanes to stop;

a control system connected to the visual signalling devices and configured for controlling operation of the visual signalling devices to thereby guide vehicles to move safely across the intersection and the distal crossover zone in one of two main phases, and wherein the two main phases are selected from:

a first main phase wherein all vehicles along one of the intersecting roads are signalled by a green signal to proceed straight across the intersection or to turn from the intersecting road that the vehicles are on, onto the another intersecting road, while all vehicles are prevented from crossing the distal crossover zone on that intersecting road to move into the turning right lane;

a second main phase wherein all vehicles along the same intersecting road that are moving straight and/or turning right and/or turning left are signalled to stop at the intersection region, while vehicles in the distal right turning lane are signalled to move over the distal crossover zone into the proximal right turning lane; and wherein the control system is further configured for controlling the visual signalling devices during the first main phase in two sub phases, the two sub phases being:

a first sub-phase in which vehicles in the turning left lane from the intersecting road are guided to stop, and vehicles in the turning right lane from an opposed side of the same intersecting road are guided to proceed; and a second sub-phase in which vehicles in the turning left lane from one of the intersecting roads are guided by a green signal to proceed, and vehicles in the turning right lane from an opposed side of the same intersecting road are guided by a red signal to stop.

* * * * *